US010696449B2

(12) United States Patent
Hawley et al.

(10) Patent No.: US 10,696,449 B2
(45) Date of Patent: Jun. 30, 2020

(54) COMPOSITE PALLET

(71) Applicant: INTEGRATED COMPOSITE PRODUCTS, INC., Rochester, MN (US)

(72) Inventors: Ronald C. Hawley, Winona, MN (US); Derek J. Mazula, Sioux Falls, SD (US)

(73) Assignee: INTEGRATED COMPOSITE PRODUCTS, INC., Rochester, MN (US)

( * ) Notice: Subject to any disclaimer, the term of this patent is extended or adjusted under 35 U.S.C. 154(b) by 43 days.

(21) Appl. No.: 15/989,427

(22) Filed: May 25, 2018

(65) Prior Publication Data

US 2018/0339803 A1 Nov. 29, 2018

Related U.S. Application Data

(60) Provisional application No. 62/511,759, filed on May 26, 2017.

(51) Int. Cl.
*B65D 19/00* (2006.01)

(52) U.S. Cl.
CPC ..... *B65D 19/0073* (2013.01); *B65D 19/0095* (2013.01); *B65D 2519/00014* (2013.01);
(Continued)

(58) Field of Classification Search
CPC ..... B65D 19/0073; B65D 19/0012; B65D 19/0026; B65D 2519/00014;
(Continued)

(56) References Cited

U.S. PATENT DOCUMENTS 3,199,469 A 8/1965 Sullivan
3,307,504 A 3/1967 Cloyd et al.
(Continued)

FOREIGN PATENT DOCUMENTS

EP 0801001 * 10/1997
FR 2564430 * 11/1985
(Continued)

OTHER PUBLICATIONS

International Search Report and Written Opinion dated Aug. 9, 2018 for International Application No. PCT/US2018/034573.

*Primary Examiner* — Janet M Wilkens
(74) *Attorney, Agent, or Firm* — Seager, Tufte & Wickhem, LLP

(57) ABSTRACT

Composite pallets and methods for making and using composite pallets are disclosed. An example composite pallet may include a base layer. The base layer may include a first base board, a second base board, and a cross-member extending between the first base board and the second base board. The cross-member may include a first end region designed to be detachably coupled to the first base board, a second end region designed to be detachably coupled to the second base board, and at least one curved section positioned between the first end region and the second end region. The cross-member may include a polymer. An intermediate layer may be coupled to the base layer. The intermediate layer may include a plurality of intermediate boards. A top layer may be coupled to the intermediate layer. The top layer may include a plurality of top boards.

20 Claims, 65 Drawing Sheets

(52) U.S. Cl.
CPC ..... *B65D 2519/00034* (2013.01); *B65D 2519/00049* (2013.01); *B65D 2519/00069* (2013.01); *B65D 2519/0099* (2013.01); *B65D 2519/00104* (2013.01); *B65D 2519/00139* (2013.01); *B65D 2519/00273* (2013.01); *B65D 2519/00293* (2013.01); *B65D 2519/00308* (2013.01); *B65D 2519/00323* (2013.01); *B65D 2519/00333* (2013.01); *B65D 2519/00368* (2013.01); *B65D 2519/00373* (2013.01); *B65D 2519/00378* (2013.01); *B65D 2519/00407* (2013.01); *B65D 2519/00412* (2013.01); *B65D 2519/00417* (2013.01); *B65D 2519/00437* (2013.01); *B65D 2519/00442* (2013.01); *B65D 2519/00447* (2013.01); *B65D 2519/00572* (2013.01); *B65D 2519/00781* (2013.01)

(58) Field of Classification Search
CPC ..... B65D 2519/00049; B65D 2519/00273; B65D 2519/00293; B65D 2519/00323; B65D 2519/00368; B65D 2519/00572; B65D 2519/00034; B65D 2519/00069; B65D 2519/00104; B65D 2519/00373; B65D 2519/0029; B65D 2519/00288; B65D 2519/00333
USPC ... 108/51.11, 57.25, 57.27, 57.29, 901, 902; 206/386, 595–600
See application file for complete search history.

(56) References Cited

U.S. PATENT DOCUMENTS

| | | | | |
|---|---|---|---|---|
| 4,240,358 | A * | 12/1980 | Munroe | B65D 19/0069 108/57.1 |
| 4,292,900 | A * | 10/1981 | Bula | B65D 19/0012 108/57.1 |
| 5,351,628 | A * | 10/1994 | Breezer | B65D 19/0022 108/56.1 |
| 5,483,899 | A | 1/1996 | Christie | |
| 5,492,069 | A | 2/1996 | Alexander et al. | |
| 5,887,529 | A * | 3/1999 | John | B65D 19/0018 108/56.1 |
| 6,651,815 | B1 * | 11/2003 | Koefelda | B29C 66/54 206/527 |
| 6,745,703 | B2 | 6/2004 | Torrey et al. | |
| 7,487,730 | B2 | 2/2009 | Hedstrom | |
| 7,516,705 | B2 | 4/2009 | Hedstrom | |
| 7,779,764 | B2 | 8/2010 | Naidu et al. | |
| 7,874,256 | B2 | 1/2011 | Muirhead | |
| 7,878,127 | B2 | 2/2011 | Hedstrom | |
| 8,006,629 | B2 | 8/2011 | Naidu | |
| 8,141,500 | B2 | 3/2012 | Naidu et al. | |
| 8,261,673 | B2 * | 9/2012 | Ingham | B65D 19/0095 108/51.11 |
| 8,627,773 | B2 | 1/2014 | Storteboom et al. | |
| 8,667,905 | B2 | 3/2014 | Anderson et al. | |
| 8,800,456 | B2 | 8/2014 | Storteboom et al. | |
| 8,850,993 | B2 | 10/2014 | Storteboom et al. | |
| 9,340,320 | B2 | 5/2016 | Brandt et al. | |
| 9,409,673 | B2 | 8/2016 | Brandt et al. | |
| 9,434,506 | B2 | 9/2016 | Takyar | |
| 9,745,098 | B2 | 8/2017 | Takyar et al. | |
| 9,776,762 | B2 | 10/2017 | De Beer et al. | |
| 9,802,732 | B2 * | 10/2017 | Clark | B65D 19/0059 |
| D824,133 | S | 7/2018 | Hawley et al. | |
| 2003/0233963 | A1 * | 12/2003 | Fan | B65D 19/0012 108/51.11 |
| 2004/0000259 | A1 * | 1/2004 | Taft | B65D 19/0073 108/57.25 |
| 2005/0056193 | A1 | 3/2005 | Laender et al. | |
| 2006/0201402 | A1 * | 9/2006 | Moore, Jr. | B65D 19/0012 108/57.25 |
| 2010/0199891 | A1 * | 8/2010 | Miller | B65D 19/0091 108/57.17 |
| 2010/0206200 | A1 * | 8/2010 | Tosse | B65D 19/0073 108/56.1 |
| 2010/0229764 | A1 | 9/2010 | Ingham | |
| 2013/0153452 | A1 * | 6/2013 | Storteboom | B65D 19/0093 206/386 |
| 2015/0151506 | A1 | 6/2015 | Hawley et al. | |
| 2017/0232703 | A1 | 8/2017 | Hawley et al. | |
| 2018/0043643 | A1 | 2/2018 | Hawley et al. | |
| 2018/0215505 | A1 | 8/2018 | Hawley et al. | |

FOREIGN PATENT DOCUMENTS

| | | | |
|---|---|---|---|
| GB | 2449374 | A | 11/2008 |
| JP | S4945239 | U | 4/1974 |
| WO | 9422728 | * | 10/1994 |
| WO | 9511167 | * | 4/1995 |
| WO | 2005102853 | A1 | 11/2005 |
| WO | 2012012367 | A2 | 1/2012 |
| WO | 2013154415 | * | 10/2013 |

* cited by examiner

COMPOSITE PALLET

CROSS-REFERENCE TO RELATED APPLICATIONS

This application claims priority to U.S. Provisional Application Ser. No. 62/511,759, filed May 26, 2017, the entirety of which is incorporated herein by reference.

TECHNICAL FIELD

The present disclosure pertains to devices used to transport, store, and package goods. More particularly, the present disclosure pertains to pallets.

BACKGROUND

A wide variety of devices have been developed for transporting, storing, and packaging goods. Some of these devices include packages, pallets, containers, and the like. There is an ongoing need to provide alternative packages, pallets, containers, and the like.

BRIEF SUMMARY

This disclosure provides design, material, manufacturing method, and use alternatives for devices used to transport, store, and package goods. An example device includes a composite pallet. The composite pallet comprises: a base layer including a first base board, a second base board, and a cross-member extending between the first base board and the second base board; wherein the cross-member includes a first end region designed to be detachably coupled to the first base board, a second end region designed to be detachably coupled to the second base board, and at least one curved section positioned between the first end region and the second end region; wherein the cross-member includes a polymer; an intermediate layer coupled to the base layer, the intermediate layer including a plurality of intermediate boards; and a top layer coupled to the intermediate layer, the top layer including a plurality of top boards.

Alternatively or additionally to any of the embodiments above, the first base board has a first central region, wherein the second base board has a second central region, wherein the first end region of the cross-member is attached to the first central region, and wherein the second end region of the cross-member is attached to the second central region.

Alternatively or additionally to any of the embodiments above, the cross-member has a central region and wherein the at least one curved section extends between the first end region and the central region.

Alternatively or additionally to any of the embodiments above, the cross-member includes a second curved region extending between the central region and the second end region.

Alternatively or additionally to any of the embodiments above, the first base board and the second base board are designed to lie within a plane, wherein a region of the cross-member lies within the plane, and wherein the at least one curved section curves out from the plane.

Alternatively or additionally to any of the embodiments above, further comprising a wear pad coupled to the first base board.

Alternatively or additionally to any of the embodiments above, further comprising a plurality of support blocks that are positioned between the base layer and the intermediate layer.

Alternatively or additionally to any of the embodiments above, at least one of the plurality of support blocks are solid.

Alternatively or additionally to any of the embodiments above, a push support member is coupled to at least one of the plurality of support blocks.

Alternatively or additionally to any of the embodiments above, the plurality of top boards include a first end board and a second end board.

Alternatively or additionally to any of the embodiments above, the plurality of top boards include a structural board positioned between the first end board and the second end board.

Alternatively or additionally to any of the embodiments above, the top layer includes a first panel disposed between the first end board and the structural board.

Alternatively or additionally to any of the embodiments above, the top layer includes a second panel disposed between the second end board and the structural board.

Alternatively or additionally to any of the embodiments above, the first base board includes a longitudinal axis and wherein the first base board includes plurality of longitudinal ribs extending along the longitudinal axis.

Alternatively or additionally to any of the embodiments above, the first base board includes a plurality of transverse ribs extending between two or more adjacent longitudinal ribs.

Alternatively or additionally to any of the embodiments above, the first base board, the second base board, or both include a polymer.

Alternatively or additionally to any of the embodiments above, the first base board, the second base board, or both include a tension member.

Alternatively or additionally to any of the embodiments above, the first base board, the second base board, or both include a structural member.

Alternatively or additionally to any of the embodiments above, the first base board, the second base board, or both include an impact member.

Alternatively or additionally to any of the embodiments above, at least one of the plurality of intermediate boards include a polymer.

Alternatively or additionally to any of the embodiments above, at least one of the plurality of intermediate boards include a tension member.

Alternatively or additionally to any of the embodiments above, at least one of the plurality of intermediate boards include a structural member.

Alternatively or additionally to any of the embodiments above, at least one of the plurality of intermediate boards include an impact member.

Alternatively or additionally to any of the embodiments above, the plurality of intermediate boards includes a first intermediate board, wherein the first intermediate board includes a top surface, and wherein a first top-side rib is disposed along the top surface.

Alternatively or additionally to any of the embodiments above, a second top-side rib is disposed along the top surface and positioned adjacent to the first top-side rib.

Alternatively or additionally to any of the embodiments above, at least one of the plurality of top boards include a polymer.

Alternatively or additionally to any of the embodiments above, at least one of the plurality of top boards include a tension member.

Alternatively or additionally to any of the embodiments above, at least one of the plurality of top boards include a structural member.

Alternatively or additionally to any of the embodiments above, at least one of the plurality of top boards include an impact member.

A composite pallet is disclosed. The composite pallet comprises: a base layer including a plurality of base boards; an intermediate layer detachably coupled to the base layer, the intermediate layer including a plurality of intermediate boards; a plurality of support blocks disposed between the base layer and the intermediate layer; a top layer detachably coupled to the intermediate layer, the top layer including a first end board, a second end board, a structural board positioned between the first end board and the second end board, and a first panel disposed between the structural board and the first end board; wherein at least one of the first end board, the second end board, the structural board, and the first panel include a polymer.

Alternatively or additionally to any of the embodiments above, the base layer includes a first base board, a second base board, and a cross-member coupled to and extending between the first base board and the second base board.

Alternatively or additionally to any of the embodiments above, the cross-member includes one or more curved regions.

Alternatively or additionally to any of the embodiments above, further comprising a push support member coupled to at least one of the plurality of support blocks.

Alternatively or additionally to any of the embodiments above, further comprising one or more wear pads coupled to the base layer.

Alternatively or additionally to any of the embodiments above, further comprising a second panel disposed between the structural board and the second end board.

Alternatively or additionally to any of the embodiments above, the base layer includes a base board, and wherein the base board includes a tension member, a structural member, an impact member, or combinations thereof.

Alternatively or additionally to any of the embodiments above, the base layer includes a base board, and wherein the base board includes a plurality of longitudinal ribs and a plurality of transverse ribs.

A composite pallet is disclosed. The composite pallet comprises: a base layer including a first base board and a second base board; a cross-member extending between the first base board and the second base board; wherein the cross-member includes one or more curved sections; wherein the cross-member includes a polymer; a support block detachably coupled to the first base board, the second base board, or both; a push support member detachably coupled to the support block; an intermediate layer detachably coupled to the base layer, the intermediate layer including an intermediate board coupled to the support block; a top layer detachably coupled to the intermediate layer, the top layer including a first end board, a second end board, a structural board positioned between the first end board and the second end board, a first panel disposed between the structural board and the first end board, and a second panel disposed between the structural board and the second end board.

The above summary of some embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The disclosure may be more completely understood in consideration of the following detailed description in connection with the accompanying drawings, in which.

Figure 1:
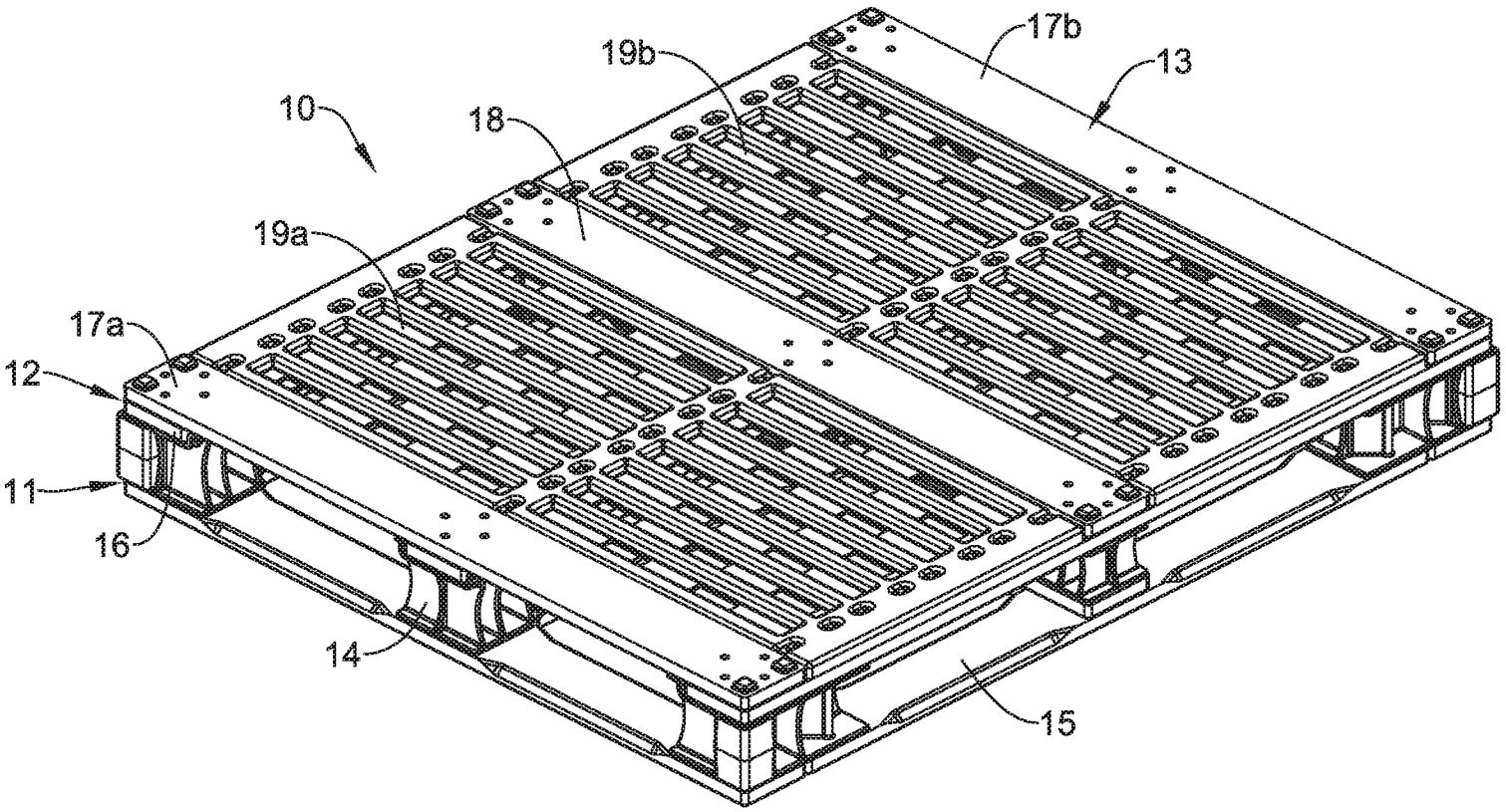
FIGS. 1-3 are perspective views of an example pallet.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the invention.

A number of devices may be utilized to transport, store, and package goods. Some of these devices include pallets. Pallets are typically made of wood and are widely used in a number of industries. Wooden pallets may provide a desirable level of strength for a variety of uses. However, because wooden pallets include boards that are secured together with nails, the maintenance and repair of the pallets may be cumbersome. For example, it may be difficult to remove nails in order to repair/replace a board without damaging the pallet. In addition, wooden pallets may be challenging to clean or sanitize. Wooden pallets may also have a number of additional shortcomings. It may be desirable to utilize pallets that are relatively easy to maintain, repair, clean, sanitize, or the like.

Disclosed herein are a number of pallets that are formed from composite materials. The composite pallets provide a desirable level of strength and durability for a variety of uses. In addition, the composite pallets are relatively easy to assemble, maintain, and repair. Furthermore, the composite pallets can be readily cleaned and/or sanitized. Some of the additional characteristics, features, and benefits of the composite pallets are disclosed herein.

Figure 2:
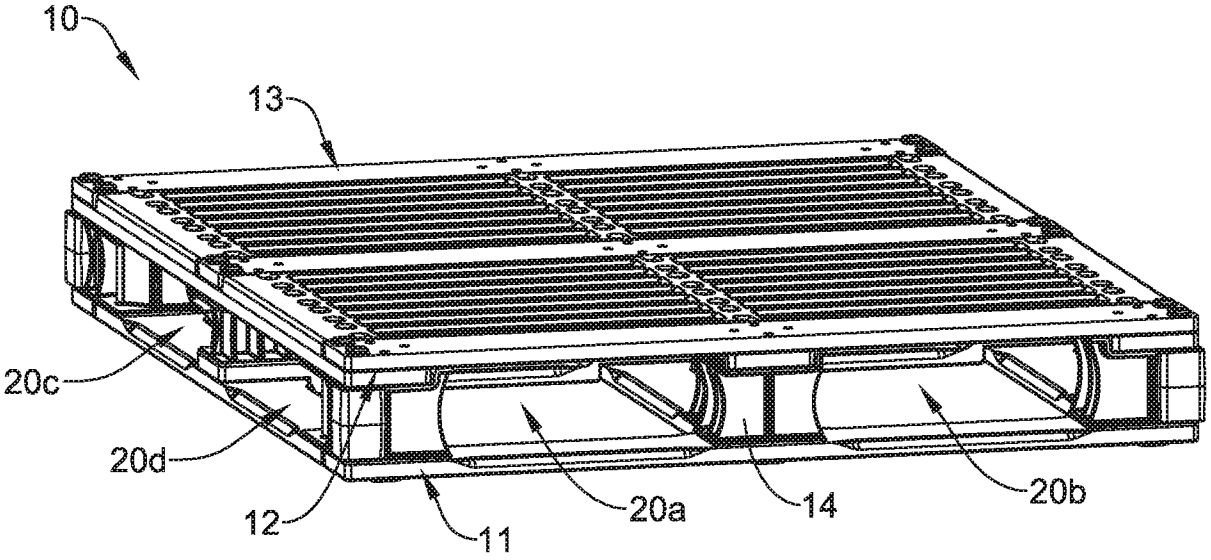
Figure 3:
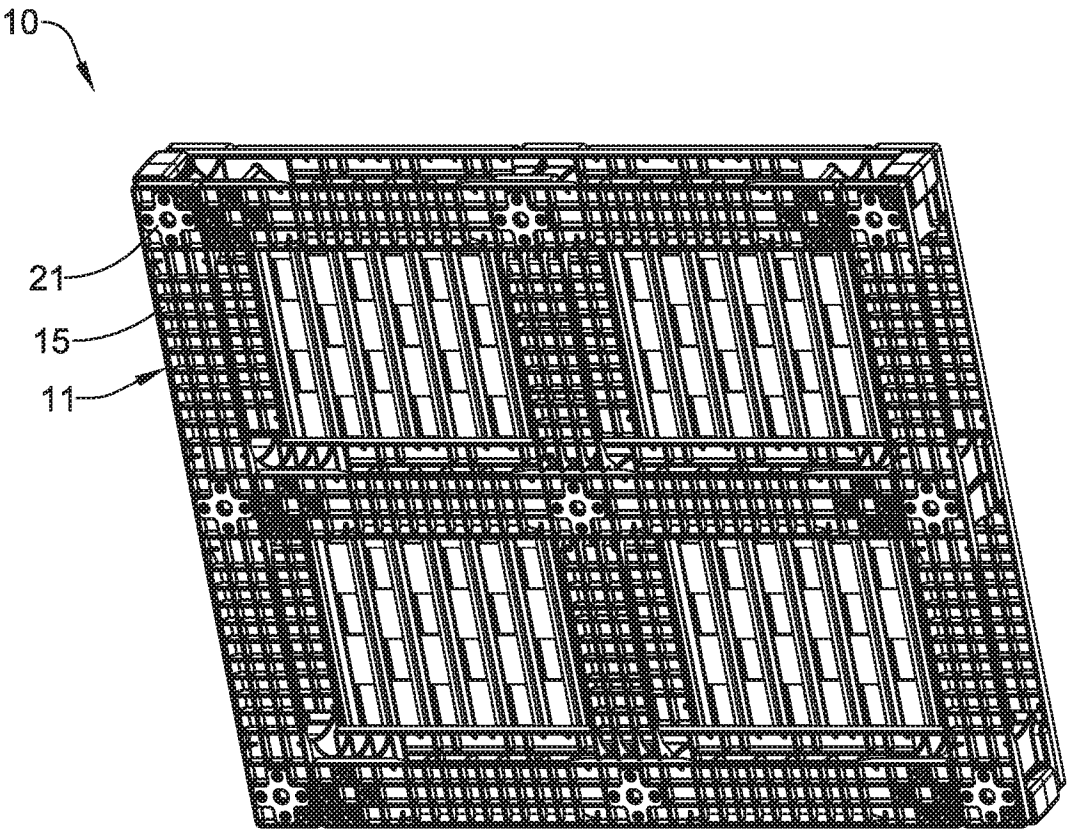

FIGS. 1-3 are perspective views of an example composite pallet 10. The composite pallet 10, as the name suggests, is at least partially formed from composite materials. In at least some instances, the composite pallet 10 includes one or more components that include a polymeric material (e.g., polypropylene, high density polyethylene, nylon, combinations thereof, and the like, or other materials disclosed herein). One or more of the polymeric materials/components may include a fiber reinforcement and/or other structural reinforcement. Some additional details regarding the components of the pallet 10 are disclosed herein.

The shape and configuration of the pallet 10 may vary. In some instances, the pallet 10 may have a generally polygonal shape. Because the pallet 10 may have a height, width, and depth, the pallet may be understood as a three-dimensional polygonal shape. In some instances, the shape of the pallet 10 may be described a rectangular prism. A number of additional shapes are contemplated. For convenience, the shape of the pallet 10 may be described in terms of the shape of the pallet 10 in two dimensions when viewing its top surface. For example, when viewing the top surface, the pallet 10 may have a shape that resembles a regular polygon or irregular polygon. In some of these and in other instances, the pallet 10 may have a rounded shape, an irregular shape, or the like. In some instances, the pallet 10 may be viewed as having 3 sides, 4 sides (e.g., a square, a rectangle, a parallelogram, etc.), 5 sides, 6 sides, 7 sides, 8 sides, or more. Some or all of the sides may be the same length. Alternatively, the sides may differ in length. The corners may be squared, rounded, or have another suitable shape. In one example, the pallet 10 may have a rectangular shape (e.g., when looking at the top surface) and may measure about 48 inches (1.2 m)×40 inches (1.0 m). Other sizes, shapes, and configurations are contemplated.

The pallet 10 may include a base or base layer 11, an intermediate layer 12, and a top layer 13. The base layer 11 may include a plurality of base boards 15 and the base layer 11 may be coupled to the intermediate layer 12 by a plurality of support blocks 14. The intermediate layer 12 may include a plurality of intermediate boards 16. The top layer 13 may include a plurality of end boards including a first end board 17*a* and a second end board 17*b*. The top layer 13 may also include a structural board 18. The structural board 18 may be the same or different from other boards of the top layer 13 (e.g., such as the first end board 17*a* and/or the second end board 17*b*). The top layer 13 may also include a number of panels including a first panel 19*a* and a second panel 19*b*.

Some additional description of the base layer 11, the intermediate layer 12, and the top layer 13 are described herein. Pallets are contemplated that utilize more or few layers.

The arrangement of the base layer 11, intermediate layer 12 and the support blocks 14 may allow a number of openings to be defined between the base layer 11 and the intermediate layer 12. For example, FIG. 2 illustrates that openings 20*a*, 20*b*, 20*c*, 20*d* may be defined between the base layer 11 and the intermediate layer 12. The openings 20*a*, 20*b*, 20*c*, 20*d* may allow a lifting device (e.g., tines of a mechanically assisted lifting device, such as a forklift, hand jack, walkie, or the like) to access the pallet 10 such that the pallet 10 may be lifted and moved. In some instances, the pallet 10 may define openings on each of the four side surfaces and, as such, the pallet 10 may be described as providing four-way entry because the lifting device may access the pallet 10 from each of those four side surfaces.

One or more wear pads 21 may be coupled to the base layer 11 as shown in FIG. 3. For example, one or more wear pads 21 may be attached to one or more of the base boards 15. The wear pads 21 may function as structures that allow the pallet 10 to be more easily moved, allow the pallet 10 to be less easily moved or otherwise resist motion, and/or allow the pallet 10 to have enhanced durability. For example, the wear pads 21 may include a friction-reducing surface or coating that provides a level of slipperiness that allows the pallet 10 to be more easily moved across a surface. The friction-reducing may take the form of a lubricous coating. Alternatively, the wear pads 21 may include a friction-increasing surface or coating that helps to reduce the pallet 10 moving or slipping across a surface. The friction-increasing surface may take the form of a tacky or sticky surface coating, a texturing, or the like. In at least some instances, the wear pads 21 are formed from or otherwise include a durable material (e.g. such as a durable polymer, metal, ceramic, carbon fiber, combinations thereof, or the like) designed to withstand wear. In addition, the wear pads 21 may be attached to the base boards 15 using a suitable fastener (e.g., a screw, nail, bolt, or the like) and may be easily replaced if desired.

Figure 4:
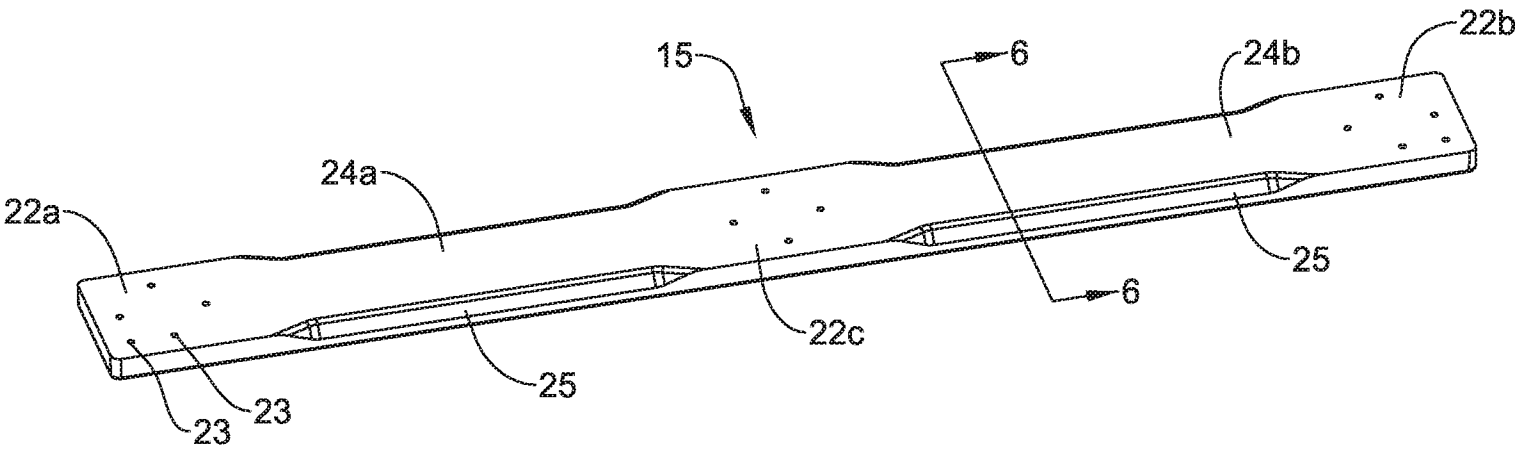
FIGS. 4-5 are perspective views of an example base board.

FIG. 4 is perspective view of one of the base boards 15. Here it can be seen that the base board 15 includes a first end region 22*a*, a second end region 22*b*, and a central region 22*c*. A first region 24*a* may extend between the first end region 22*a* and the central region 22*c*. A second region 24*b* may extend between the second end region 22*b* and the central region 22*c*. The first region 24*a*, the second region 24*b*, or both may include one or more ramped surfaces or bevels 25. The bevels 25 may allow a device such as a forklift, a mechanical assist device such as a "walkie", or the like to more easily roll over the base boards 15 (e.g., and into one or more of the openings 20*a*, 20*b*, 20*c*, 20*d*). In at least some instances, the first end region 22*a*, the second end region 22*b*, the central region 22*c*, the first region 24*a*, the second region 24*b*, or combinations thereof may include one or more openings or apertures 23. The apertures 23 may be used to secure the base boards 15 to other structures of the pallet 10 using a suitable fastener (e.g., a screw, bolt, nail, or the like). In some instances, the apertures 23 are positioned along the first end region 22*a*, the second end region 22*b*, and the central region 22*c*. In some of these and in other instances, the first region 24*a* and the second region 24*b* are free of apertures 23. Other instances are contemplated, however, where the first region 24*a* and/or the second region 24*b* (and/or other portions of the base board 15) may include apertures 23.

Figure 5:
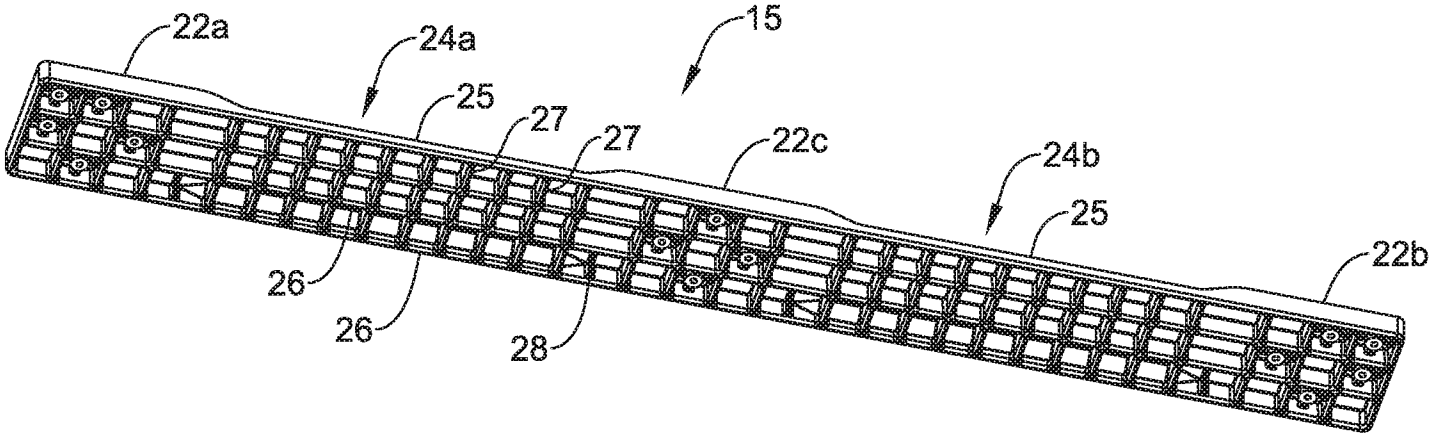

The underside or bottom of the base boards 15 may include a number of structural features. For example, as shown in FIG. 5, the base board 15 may include a number of longitudinal ribs 26. The longitudinal ribs 26 may provide structural support to the base board 15. A suitable number of longitudinal ribs 26 may be disposed along the base board 15. For example, the base board 15 may include one, two, three, four, five, six, seven, eight, or more longitudinal ribs 26. The longitudinal ribs 26 may be equally spaced from one another. Alternatively, the distance between one or more of the longitudinal ribs 26 may vary along the base board 15. In some instances, all of the longitudinal ribs 26 extend along the full length of the base board 15. In other instances, one or more of the longitudinal ribs 26 extend along only a portion of the length of the base board 15. The height (e.g., which may be understood as the distance from the bottom surface of the base board 15 to the bottom surface of the longitudinal ribs 26) of the longitudinal ribs 26 may be substantially constant along the length of the longitudinal ribs 26 or may vary. For example, longitudinal ribs 26 are contemplated where the height varies in a wave-like pattern. In general, the longitudinal ribs 26 extend along a path that is aligned with or parallel to the longitudinal axis of the base board 15. However, even though the longitudinal ribs 26 are named "longitudinal", this is not intended to limit the longitudinal ribs 26 to being only oriented in a straight line along the longitudinal axis of the base board 15. Longitudinal ribs 26 are contemplated that extend diagonally, include curves or bends, or otherwise extend in directions other than just along the longitudinal axis.

In at least some instances, the longitudinal ribs 26 may be arranged in a relatively dense pattern. For example, the space between adjacent longitudinal ribs 26 may be about 0.25-2 inches, or about 0.5-1.5 inches, or about 1 inch. By having the longitudinal ribs 26 arranged in a relatively dense pattern, the longitudinal ribs 26 can provide a greater amount of structural support to the base board 15. In some instances, all of the longitudinal ribs 26 may have the same thickness or width. In other instances, one or more of the longitudinal ribs 26 may have a different (e.g., increased) width or thickness. For example, the longitudinal ribs 26 nearest the periphery of the base board 15 may have an increased width or thickness relative to other longitudinal ribs 26. The same may be true of other components of the pallet 10 and/or the components of other pallets disclosed herein.

The base board 15 may include a number of transverse ribs 27. A suitable number of transverse ribs 27 may be disposed along the base board 15. For example, the base board 15 may include 1-100, or more, transverse ribs 27. The transverse ribs 27 may be equally spaced from one another. Alternatively, the distance between two or more of the transverse ribs 27 may vary along the base board 15. In some instances, all of the transverse ribs 27 extend along the full width of the base board 15. In other instances, one or more of the transverse ribs 27 extend along only a portion of the width of the base board 15. Indeed, a single transverse rib 27 may be considered to be a structure that extends between two adjacent longitudinal ribs 26. The height (e.g., which may be understood as the distance from the bottom surface of the base board 15 to the bottom surface of the transverse ribs 27) of the transverse ribs 27 may be substantially constant along the length of the transverse ribs 27 or may vary. For example, transverse ribs 27 are contemplated where the height varies in a wave-like pattern. In general, the transverse ribs 27 extend along a path that is transverse or perpendicular to the longitudinal axis of the base board 15.

However, even though the transverse ribs 27 are named "transverse", this is not intended to limit the transverse ribs 27 to being only oriented in a straight line transverse to the longitudinal axis of the base board 15. Transverse ribs 27 are contemplated that extend diagonally, include curves or bends, or otherwise extend in directions other than just transverse to the longitudinal axis.

The transverse ribs 27 may be disposed along essentially the entire length of the base board 15. Alternatively, the transverse ribs 27 may be disposed along one or more portions of the base board 15. For example, in the base board 15 depicted in FIG. 5, the transverse ribs 27 are shown disposed along the first region 24*a* and the second region 24*b*. In other words, the parts of the base board 15 where a mechanical assist device (e.g., a forklift, walkie, etc.) is more likely to pass over during use of the pallet 10 may have transverse ribs 27. This allows the transverse ribs 27 to provide structural support to the base board 15 along the first region 24*a* and the second region 24*b* where structural support may be desired while also allowing other portions of the base board 15 (e.g., those portions lacking transverse ribs 27) to have less material/weight. In this example, the central region 22*c* is at least partially free of transverse ribs 27. Other arrangements are contemplated. In some instances, the base board 15 may include one or more gussets 28. The gussets 28 may be disposed along the central region 22*c* (and/or other portions of the base board 15).

Figure 6:
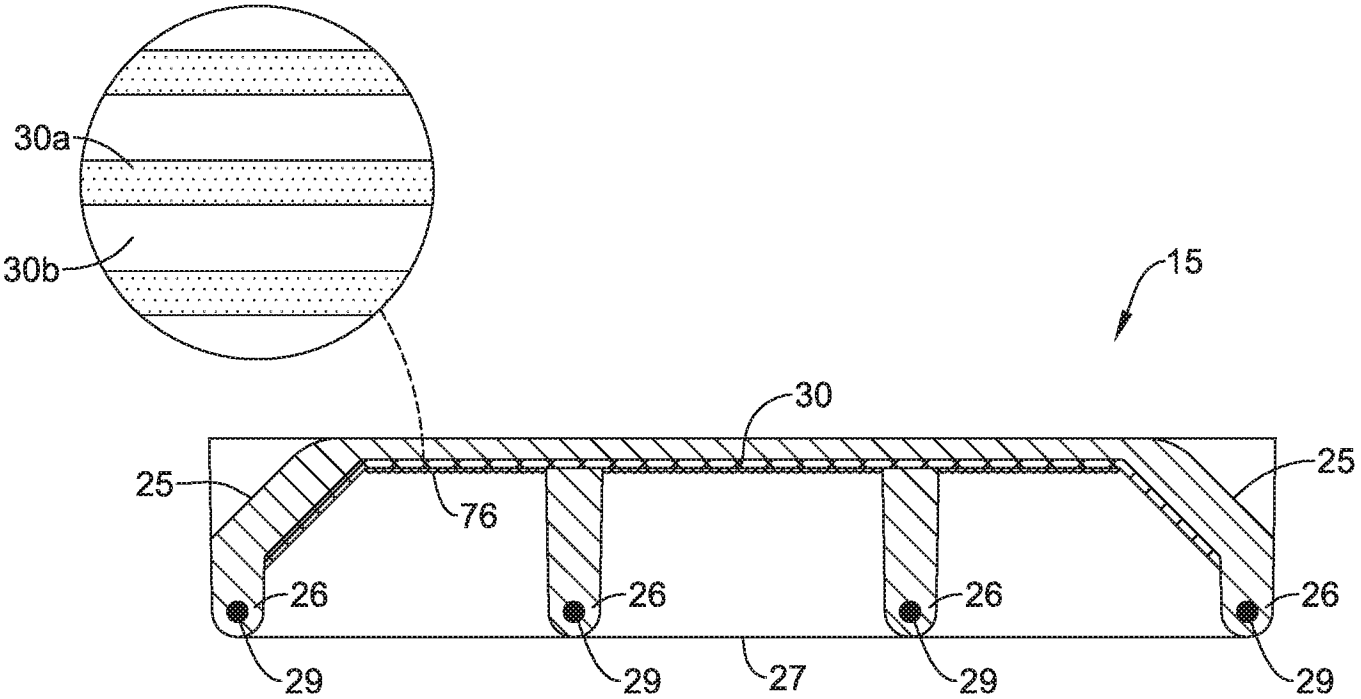
FIG. 6 is a cross-sectional view taken through line 6-6 in FIG. 4.

A cross-sectional view of the base board 15 is shown in FIG. 6. Here some of the other structural features of the base board 15 can be seen. For example, one or more of the longitudinal ribs 26 may include a tension member 29. In some instances, the tension member 29 may be described as a continuous fiber bundle that includes a plurality of fibers or filaments in a thermoplastic resin (e.g., which may resemble the fiber bundles described below with respect to the structural member 30). The tension member 29 may provide strength in tension to increase the overall strength of the base board 15, for example, by preventing the base board 15 from bowing or cracking or breaking when a force is applied thereto. The tension member 29 may include a range of thickness/filament counts. For example, the tension member 29 may define a thickness (e.g., a diameter) of about greater than or equal to 0.05 inches, greater than or equal to 0.1 inches, greater than or equal to 0.125 inches, etc. and/or less than or equal to 0.25 inches, less than or equal to 0.2 inches, less than or equal to 0.15 inches, etc. Also, for example, the tension member 29 may include at least between 1,000 and 20,000 continuous fibers dispersed in a thermoplastic material. In one or more embodiments, the tension member 29 may be twisted to further increase the tensile strength. For example, the tension member 29 may be grouped in portions of 4,000 continuous fibers that are twisted and combined with additional groups of continuous fibers that may be twisted. The tension member 29 (and/or a continuous fiber bundle) may be as described in U.S. patent application Ser. No. 14/621,188, filed on Feb. 12, 2015, and entitled, "COMPOSITE STRUCTURAL ARTICLE," and International Patent Application No. PCT/US16/17519, filed on Feb. 11, 2016, and entitled, "PRE-STRESSED FIBER REINFORCING MEMBER," and International Application No. PCT/US2015/044789, filed on Aug. 12, 2015, and entitled, "REINFORCING ARTICLE," which are both hereby incorporated herein by reference in their entirety to the extent that it does not conflict with the present disclosure.

The base board 15 may include a suitable number of tension members 29. For example, the base board 15 may include a tension member 29 in each of the longitudinal ribs 26. In at least some instances, the tension members 29 are positioned near an end or edge region of the longitudinal ribs 26. Other positions along the longitudinal ribs 26 may include tension members 29. In other instances, some or all of the longitudinal ribs 26 may lack tension members 29 and/or tension members 29 are disposed along other portions of the base board 15. Some base boards 15 are contemplated that do not have a tension member 29 at all.

The base board 15 may also include a structural member 30. The structural member 30 may include a plurality of fibers 30*a* (e.g., which may include glass fibers, carbon fibers, basalt fibers, graphite fibers, aramid fibers, ceramic fibers, natural fibers, polymeric fibers, metal fibers, combinations thereof, or the like) and, in some cases, a carrier material or mesh 30*b*. In at least some instances, the fibers 30*a* take the form of a fiber bundle or tow (e.g., that may include 1000 or more fibers) that is formed by coating the individual fibers with a resin (e.g., wetting-out) and compounding the individual fibers (e.g., via a pultrusion process). The fiber bundles 30*a* may include fibers (e.g., individual fibers or filaments) that are combined and/or shaped in such a way so as to result in fiber bundles 30*a* having a variety of widths, thicknesses, heights, diameters, etc. The arrangement of the fibers 30*a* (and/or fiber bundles 30*a*) can vary. For example, the fiber bundles 30*a* may be disposed along or otherwise parallel with the longitudinal axis of the base board 15. Alternatively, the fiber bundles 30*a* may be oriented at an angle of 0-90 degrees (+/−45 degrees) relative to the longitudinal axis of the base board 15. In some instances, the fiber bundles 30*a* are spaced from one another. In other instances the fiber bundles 30*a* may intersect or cross. The structural member 30 may be disposed at a suitable location along or within the base board 15. In at least some instances, the structural member 30 is disposed adjacent to the bottom of the base board 15. Other locations are contemplated.

As indicated above, the fiber bundles 30*a* may include individual fibers that may be coated with and/or otherwise penetrated by a resin. In some instances, the resin coating the fibers may be understood to be "compatible" with the resin/material(s) used to form the base board 15. In at least some instances, the resin coating the fibers may be considered compatible with the resin/materials(s) of the base board 15 when the resin coating the fibers is the same as (or similar to and/or bond compatible with) the resin/materials(s) of the base board 15. For example, if the base board 15 includes polypropylene, when the resin coating the fibers is also polypropylene, the resin is considered to be compatible. The use of "compatible" resins may allow the structural member 30 to bond or otherwise be molded with the base board 15 more completely or otherwise in a manner that allows the structural member 30 to provide structural support to the base board 15.

In some instances, the resin coating the fibers may be understood to be "non-compatible" or "less compatible" with the resin/material(s) used to form the base board 15. In at least some instances, the resin coating the fibers may be considered non-compatible with the resin/materials(s) of the base board 15 when the resin coating the fibers is different from the resin/materials(s) of the base board 15. For example, if the base board 15 includes polypropylene, when the resin coating the fibers is something other than polypropylene (e.g., such as any of the other materials disclosed herein), the resin may be considered to be non-compatible. The use of "non-compatible" resins may allow the structural member 30 to bond or otherwise be molded with the base board 15 in a manner that the structural member 30 that provides enhanced impact resistance (e.g., due to, for example, a less complete bond that allows the impact member 30 to "give" or cushion impact thereon). Thus, some "structural" members 30 are contemplated that utilize fibers encased in or otherwise penetrated by a non-compatible resin and such "structural" members 30 may be considered to be "impact" members 30 or "impact resistance" members 30. It is noted that the same reference number (reference number 30) is utilized in FIG. 6 to refer to a structure that can be described as either (a) a structural member 30 that provides structural support or (b) a structure, different from the structural member that provides structural support, that can be described as an impact member 30.

Collectively, some structural members 30 are contemplated that utilize the same resins for the fiber bundles 30*a* and for the base boards 15, and such structural members 30 may be considered to provide structural support and thus be considered structural members 30. Other structural members 30 are contemplated that utilize different resins for the fiber bundles 30*a* and the base boards 15, and such structural members 30 may be considered to provide impact resistance and thus be considered impact members 30. Some pallets 10 are contemplated that include both structural members 30 and impact members 30. Finally, the magnitude of the compatibility of the resin for use with the fiber bundles 30*a* can vary along a continuum, depending on the materials utilized. For example, some resin combinations may have a partial level of compatibility. Thus, structural members 30 are contemplated where the resins used with the fiber bundles 30*a* are partially compatible with the resins of the base board 15. Such structural members 30 may be understood as both a structural member (providing structural support) and an impact member (providing impact resistance). Accordingly, pallets 10 are contemplated that include structural members 30, impact members 30, a structural member 30 that is considered to be both a structural member and an impact member, or combinations thereof.

The base boards 15 may be formed from a suitable material. For example, the base boards 15 may be made from polypropylene, high density polyethylene, nylon, combinations thereof, and the like, or other materials disclosed herein. In addition to the tension members 29 and structural members 30 described above, the base boards 15 may include additional reinforcement such as fiber reinforcements (e.g., reinforcement with glass fibers, carbon fibers, basalt fibers, graphite fibers, aramid fibers, ceramic fibers, natural fibers, polymeric fibers, metal fibers, combinations thereof, or the like). In some instances, all of the base boards 15 are the same. In other instances, one or more of the base boards 15 may differ in structure. Some of the differences contemplated include differences where one or more of the base boards 15 include structures found in some of the other components of the pallet 10.

Figure 6A:
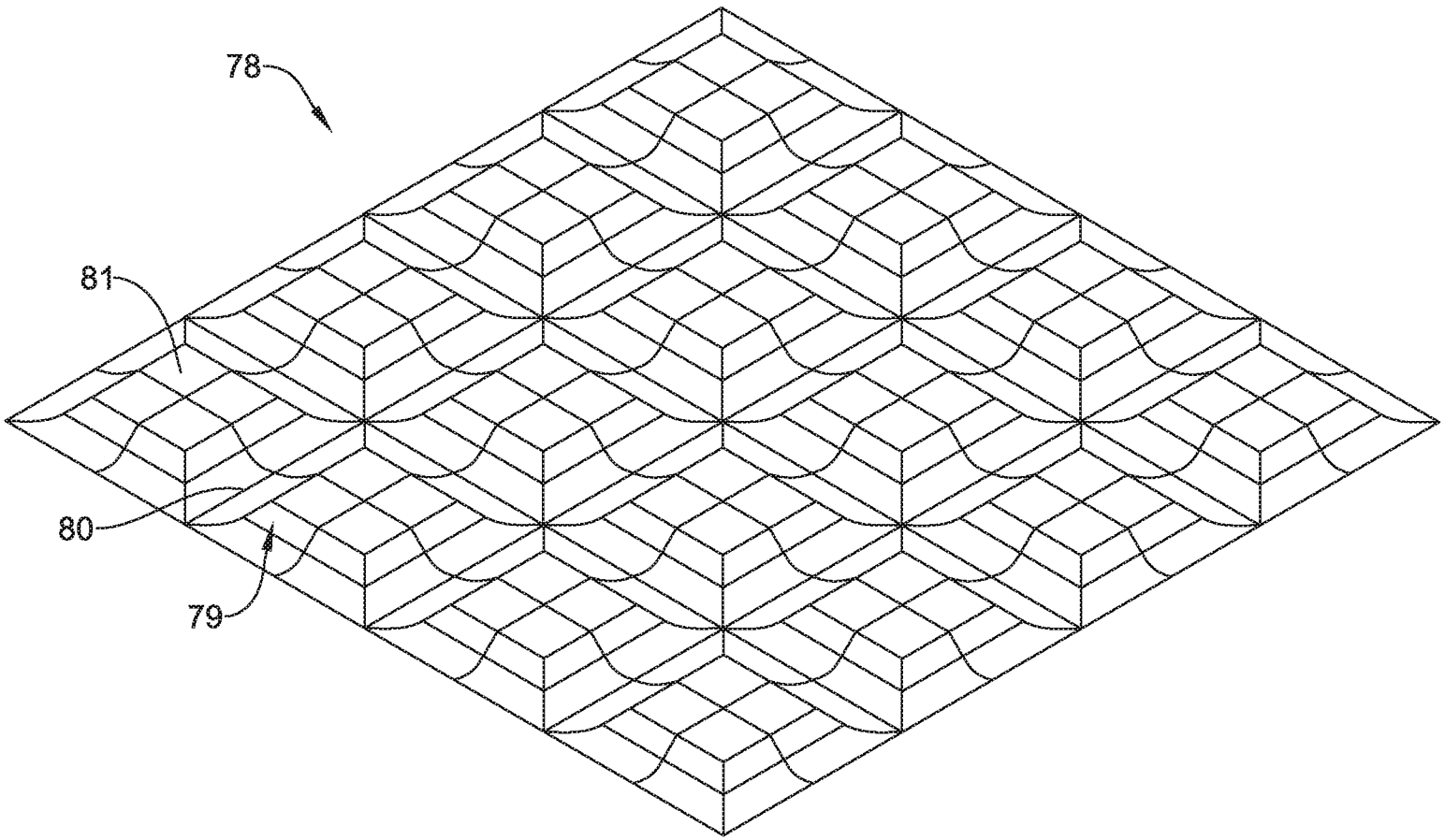
FIG. 6A illustrates a portion of an example mold for forming an example base board.
Figure 6B:
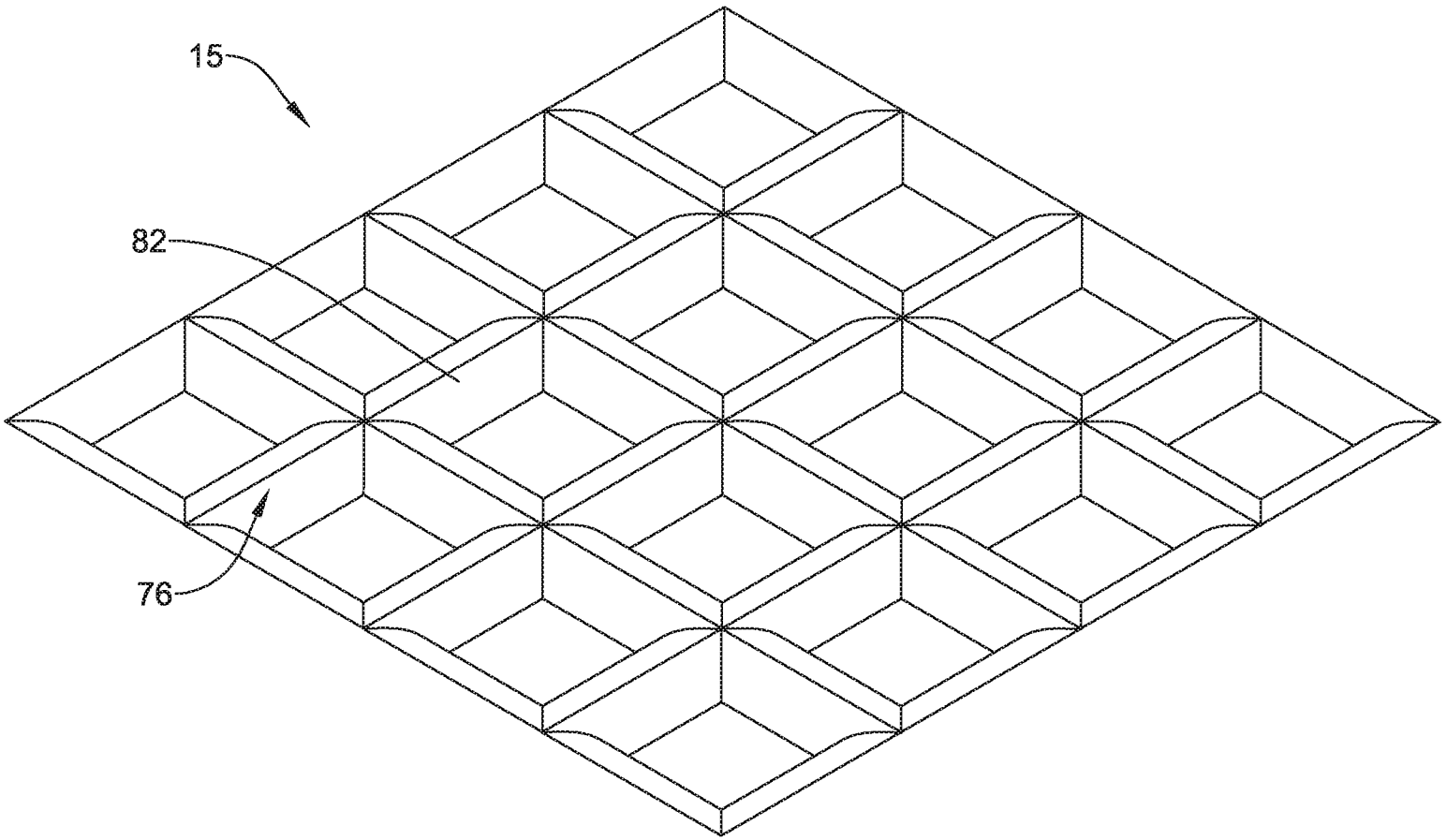
FIG. 6B illustrates a portion of an example base board.

The base boards 15 may be formed using a suitable process such as compression molding, transfer molding, injection molding, base molding, casting, or the like. In some instances, a mold 78 (a portion of which is shown in FIG. 6A, may be utilized). The mold 78 may have a textured surface 79 including one or more grooves 80 that are cut into the mold 78. Between the grooves 80 or otherwise along portions of the mold 78 where the grooves 80 are not formed, portions 81 of the mold 78 remain that appear raised in FIG. 6A. When a material is disposed in the mold 78, for example to form the base board 15, the textured surface 79 in the mold 78 may result in a corresponding textured surface 76 along a portion of the base board 15 (e.g., a bottom surface) as shown in FIG. 6B (and also depicted in FIG. 6). In this example, the textured surface 76 may include one or more ridges or bumps 82. The textured surface 76 may be desirable for a number of reasons. For example, the textured surface 79 of the mold 78 may allow material to flow underneath a structural member 30 placed in the mold 78 as part of the molding process. Because of this, the material flowing underneath the structural member 30 may encapsulate at least a portion of (and in some cases all of) the structural member 30. This may improve the bond between the structural member 30 and the base board 15. For example, the mechanical and/or chemical bond between the structural member 30 and the base board 15 may be enhanced by the textured surface 79 of the mold 78.

Figure 7:
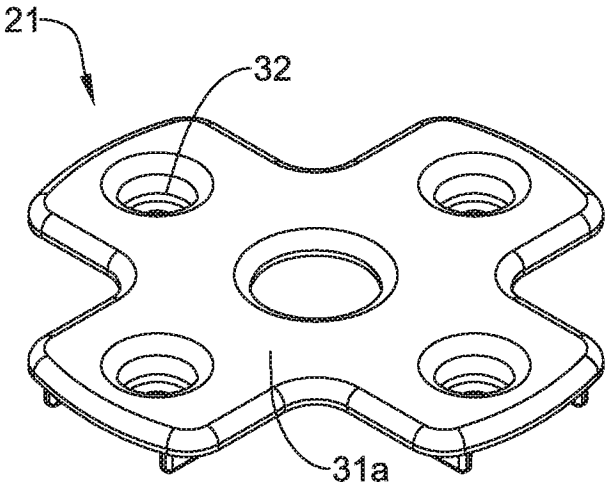
FIGS. 7-8 are perspective views of an example wear pad.
Figure 8:
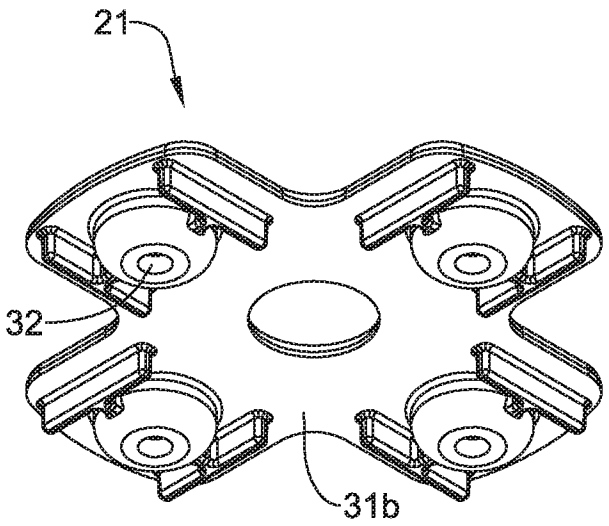
Figure 9:
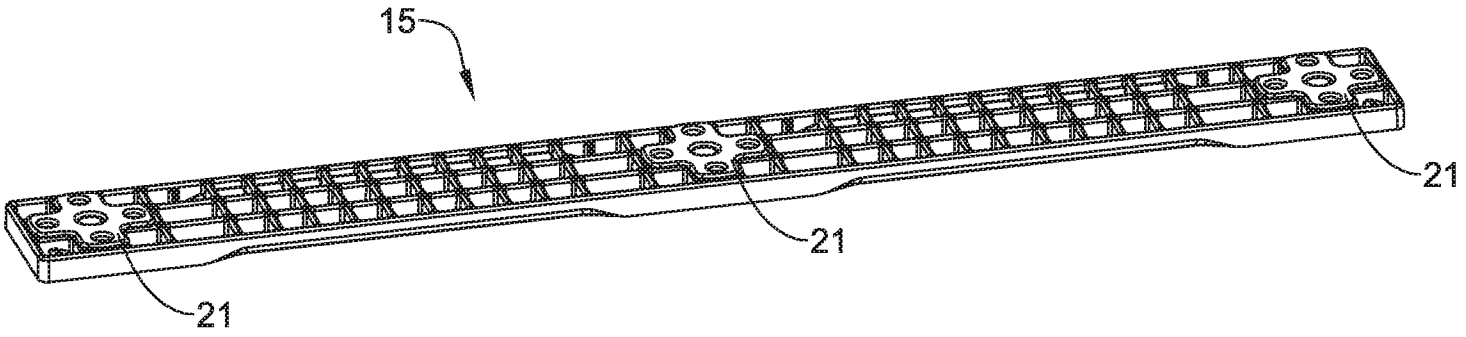
FIG. 9 is a perspective view of a number of wear pads secured to an example base board.

FIGS. 7-8 illustrate the wear pads 21. The wear pads 21 may include a first or "bottom" surface 31*a* (e.g., as shown in FIG. 7) and a second or "top" surface 31*b* (e.g., as shown in FIG. 8). A plurality of openings 32 may be formed in wear pads 21. The openings 32 may be used to secure the wear pads 21 to the base boards 15 as depicted in FIG. 9. For example, a suitable fastener (e.g., such as a screw, nail, bolt, or the like) may be used to secure the wear pads 21 to the base boards 15. If a particular type of wear pad 21 is desired, the pallet 10 can be modified to replace a first type of wear pad 21 (e.g., a "slippery" wear pad 21) with a second type of wear pad 21 (e.g., a 22121 with a high friction surface).

Figure 10:
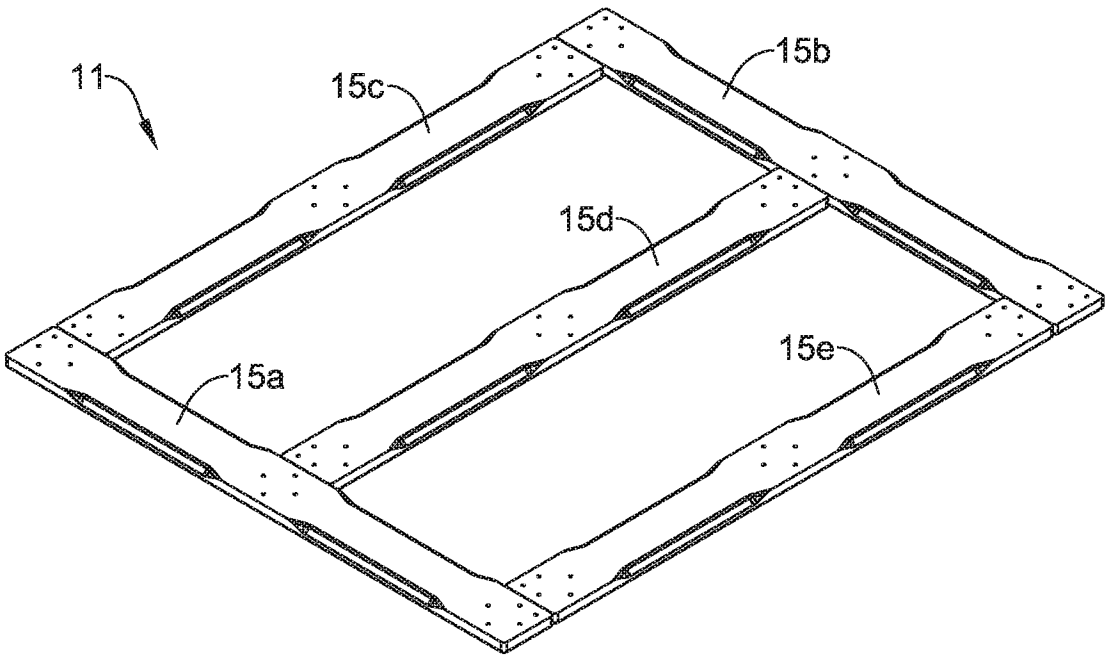
FIG. 10 is a perspective view of a portion of an example base layer.

FIG. 10 illustrates an example configuration of the base boards 15 in the base layer 11. Here it can be seen that the base layer 11 may include a plurality of base boards 15 including the base boards 15*a*, 15*b*, 15*c*, 15*d*, and 15*e* shown in FIG. 10. The number and arrangement of the base boards 15*a*, 15*b*, 15*c*, 15*d*, and 15*e* can vary. For example, some base layers 11 are contemplated that include five base boards 15*a*, 15*b*, 15*c*, 15*d*, and 15*e* as shown, whereas other base layers 11 may include more or fewer base boards 15. In some instances, all of the base boards 15*a*, 15*b*, 15*c*, 15*d*, and 15*e* are the same. In other instances, one or more of the base boards 15*a*, 15*b*, 15*c*, 15*d*, and 15*e* have a differing shape, size, structural configuration, material composition, or the like.

Figure 11:
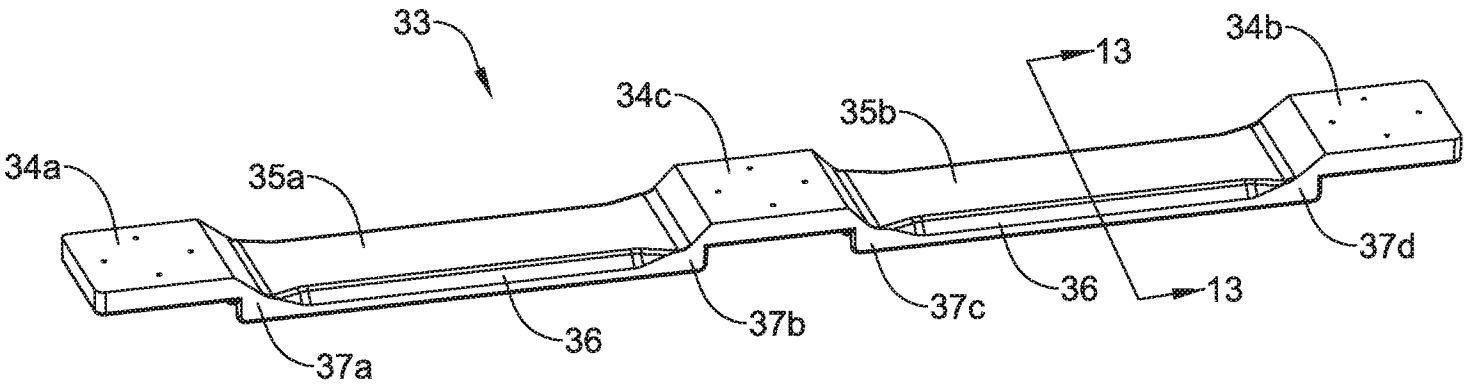
FIGS. 11-12 are perspective views of an example cross-member.
Figure 12:
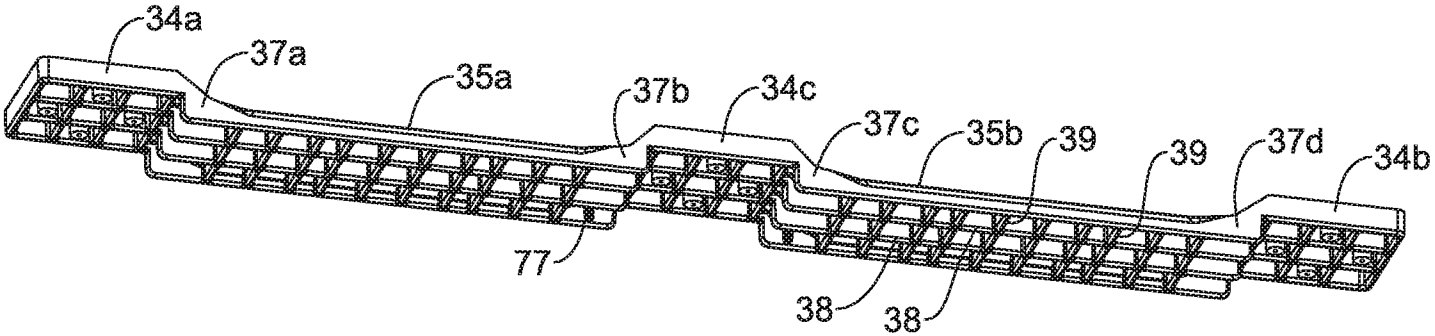

FIGS. 11-12 illustrate an example cross-member 33. Here it can be seen that the cross-member 33 may include a first end region 34*a*, a second end region 34*b*, and a central region 34*c*. A first region 35*a* may be disposed between the first end region 34*a* and the central region 34*c*. A second region 35*b* may be disposed between the second end region 34*b* and the central region 34*c*. The first region 35*a*, the second region 35*b*, or both may include one or more ramped surfaces or bevels 36.

The first end region 34*a*, the second end region 34*b*, and the central region 34*c* are substantially coplanar and lie within a first plane. The first region 35*a* and the second region 35*b* may be coplanar and lie within a second plane. In at least some instances, the first plane and the second plane are spaced from one another and, for example, may be substantially parallel with one another. The cross-member 33 may include one or more curved regions that form transitions between the first plane and the second plane. For example, the cross-member 33 may include a first curved region 37*a*, a second curved region 37*b*, a third curved region 37*c*, and a fourth curved region 37*d*. The first curved region 37*a* may be disposed between the first end region 34*a* and the first region 35*a*. The second curved region 37*b* may be disposed between the first region 35*a* and the central region 34*c*. The third curved region 37*c* may be disposed between the central region 34*c* and the second region 35*b*. The fourth curved region 37*d* may be disposed between the second region 35*b* and the second end region 34*b*. The curving of the curved regions 37*a*, 37*b*, 37*c*, and 37*d* may have a suitable radius of curvature. The radius of curvature may be constant or may vary along each of the curved regions 37*a*, 37*b*, 37*c*, and 37*d* (and/or may vary amongst different curved regions 37*a*, 37*b*, 37*c*, and 37*d*).

The cross-member 33 may include a number of longitudinal ribs 38. The longitudinal ribs 38 may provide structural support to the cross-member 33. A suitable number of longitudinal ribs 38 may be disposed along the cross-member 33. For example, the cross-member 33 may include one, two, three, four, five, six, seven, eight, or more longitudinal ribs 38. The longitudinal ribs 38 may be equally spaced from one another. Alternatively, the distance between one or more of the longitudinal ribs 38 may vary along the cross-member 33. In some instances, all of the longitudinal ribs 38 extend along the full length of the cross-member 33. In other instances, one or more of the longitudinal ribs 38 extend along only a portion of the length of the cross-member 33. The height (e.g., which may be understood as the distance from the bottom surface of the cross-member 33 to the bottom surface of the longitudinal ribs 38) of the longitudinal ribs 38 may be substantially constant along the length of the longitudinal ribs 38 or may vary. For example, longitudinal ribs 38 are contemplated where the height varies in a wave-like pattern. In general, the longitudinal ribs 38 extend along a path that is aligned with or parallel to the longitudinal axis of the cross-member 33. However, even though the longitudinal ribs 38 are named "longitudinal", this is not intended to limit the longitudinal ribs 38 to being only oriented in a straight line along the longitudinal axis of the cross-member 33. Longitudinal ribs 38 are contemplated that extend diagonally, include curves or bends, or otherwise extend in directions other than just along the longitudinal axis.

In at least some instances, the longitudinal ribs 38 may be arranged in a relatively dense pattern. For example, the space between adjacent longitudinal ribs 38 may be about 0.25-2 inches, or about 0.5-1.5 inches, or about 1 inch. By having the longitudinal ribs 38 arranged in a relatively dense pattern, the longitudinal ribs 38 can provide a greater amount of structural support to the cross-member 33. In some instances, all of the longitudinal ribs 38 may have the same thickness or width. In other instances, one or more of the longitudinal ribs 38 may have a different (e.g., increased) width or thickness. For example, the longitudinal ribs 38 nearest the periphery of the cross-member 33 may have an increased width or thickness relative to other longitudinal ribs 38. The same may be true of other components of the pallet 10 and/or the components of other pallets disclosed herein.

The cross-member 33 may include a number of transverse ribs 39. A suitable number of transverse ribs 39 may be disposed along the cross-member 33. For example, the cross-member 33 may include 1-100, or more, transverse ribs 39. The transverse ribs 39 may be equally spaced from one another. Alternatively, the distance between two or more of the transverse ribs 39 may vary along the cross-member 33. In some instances, all of the transverse ribs 39 extend along the full width of the cross-member 33. In other instances, one or more of the transverse ribs 39 extend along only a portion of the width of the cross-member 33. Indeed, a single transverse rib 39 may be considered to be a structure that extends between two adjacent longitudinal ribs 38. The height (e.g., which may be understood as the distance from the bottom surface of the cross-member 33 to the bottom surface of the transverse ribs 39) of the transverse ribs 39 may be substantially constant along the length of the transverse ribs 39 or may vary. For example, transverse ribs 39 are contemplated where the height varies in a wave-like pattern. In general, the transverse ribs 39 extend along a path that is transverse or perpendicular to the longitudinal axis of the cross-member 33. However, even though the transverse ribs 39 are named "transverse", this is not intended to limit the transverse ribs 39 to being only oriented in a straight line transverse to the longitudinal axis of the cross-member 33. Transverse ribs 39 are contemplated that extend diagonally, include curves or bends, or otherwise extend in directions other than just transverse to the longitudinal axis. In some instances, the intersections of the longitudinal ribs 38 and the transverse ribs 39 may define sockets or compartments into which other structures of the pallet 10 may extend. This may help to secure or interlock various structures of the pallet 10. In some instances, the cross-member 33 may include one or more gussets 77.

Figure 13:
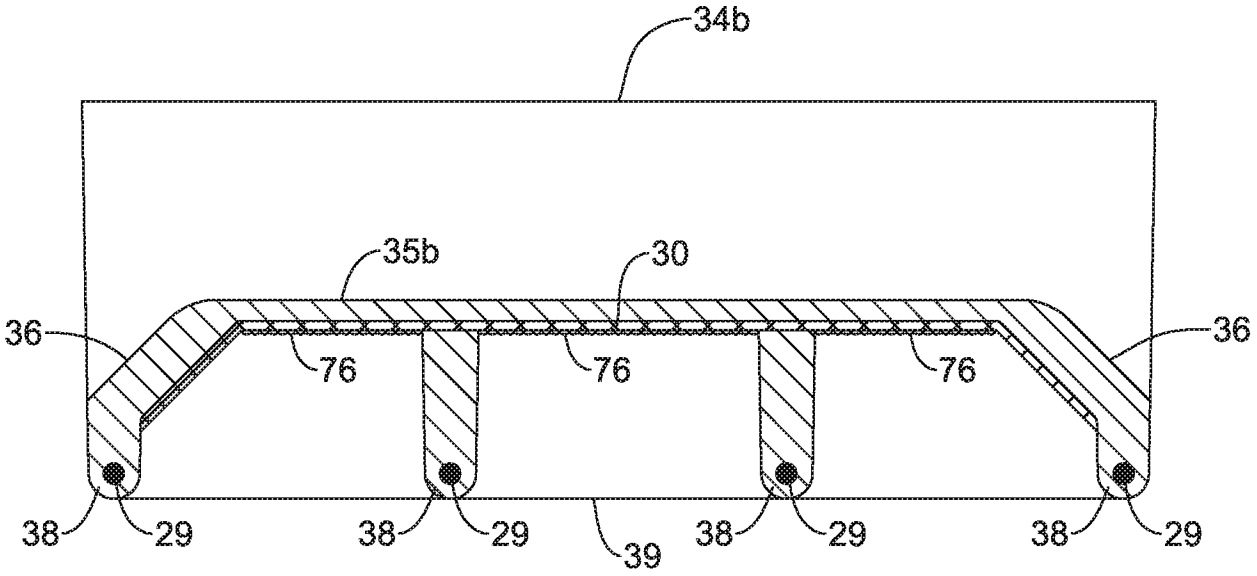
FIG. 13 is a cross-sectional view taken through line 13-13 in FIG. 11.

A cross-sectional view of the cross-member 33 is shown in FIG. 13. Here some of the other structural features of the cross-member 33 can be seen. For example, one or more of the longitudinal ribs 38 may include a tension member 29 (e.g., that may be similar in form and function to the tension member 29 described above with respect to the base board 15). The cross-member 33 may also include a structural member 30 (e.g., that may be similar in form and function to the structural member 30 described above with respect to the base board 15). As described above in relation to the base board 15, the "structural" member 30 may take the form of a structural member 30, an impact member 30, a member 30 that provides both structural support and impact resistance, or combinations thereof. The cross-member 33 may also have a textured bottom surface 76, similar to that of the base board 15.

Figure 14:
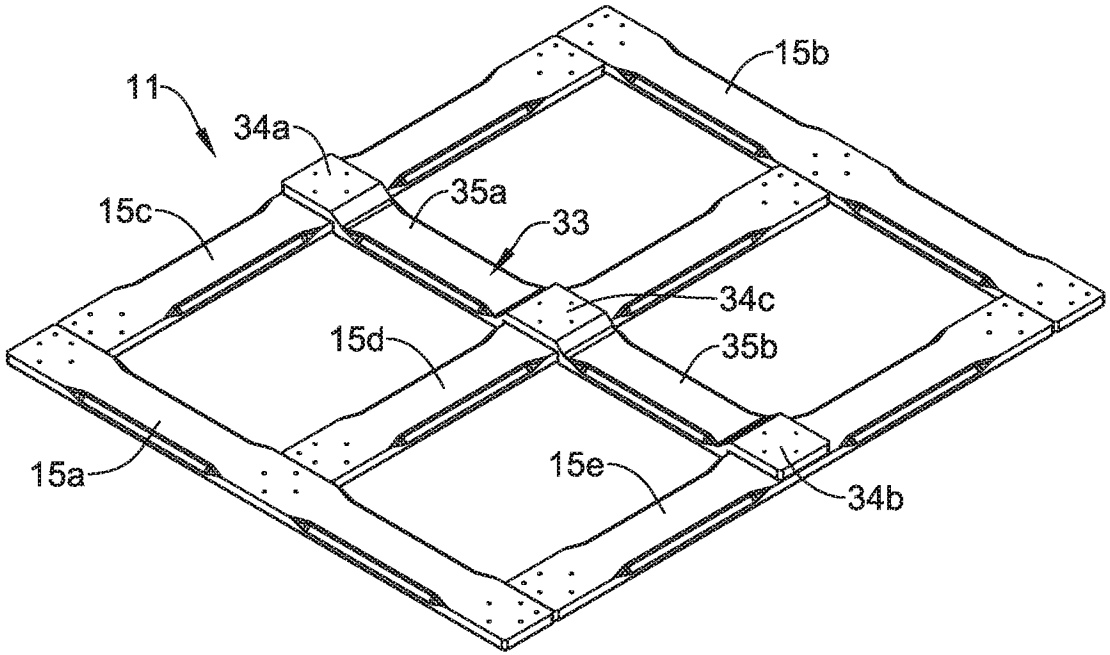
FIG. 14 is a perspective view of an example base layer.

FIG. 14 illustrates the base layer 11. Here it can be seen that the base layer 11 may include a plurality of base boards 15 including the base boards 15*a*, 15*b*, 15*c*, 15*d*, and 15*e*. The base layer 11 may also include the cross-member 33. As shown in FIG. 14, the base boards 15*a*, 15*b*, 15*c*, 15*d*, and 15*e* may be coplanar with the first region 35*a* and the second region 35*b*. The first end region 34*a*, the second end region 34*b*, and the central region 34*c* may lie in a plane that is spaced from and substantially parallel to the plane in which the base boards 15*a*, 15*b*, 15*c*, 15*d*, and 15*e* as well as the first region 35*a* and the second region 35*b* of the cross-member 33 lie.

Figure 15:
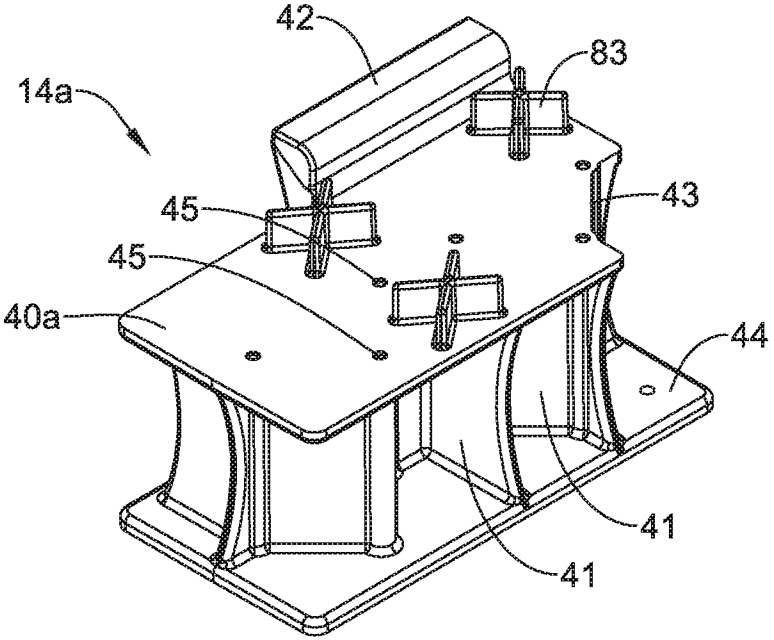
FIGS. 15-16 are perspective views of an example support block.
Figure 16:
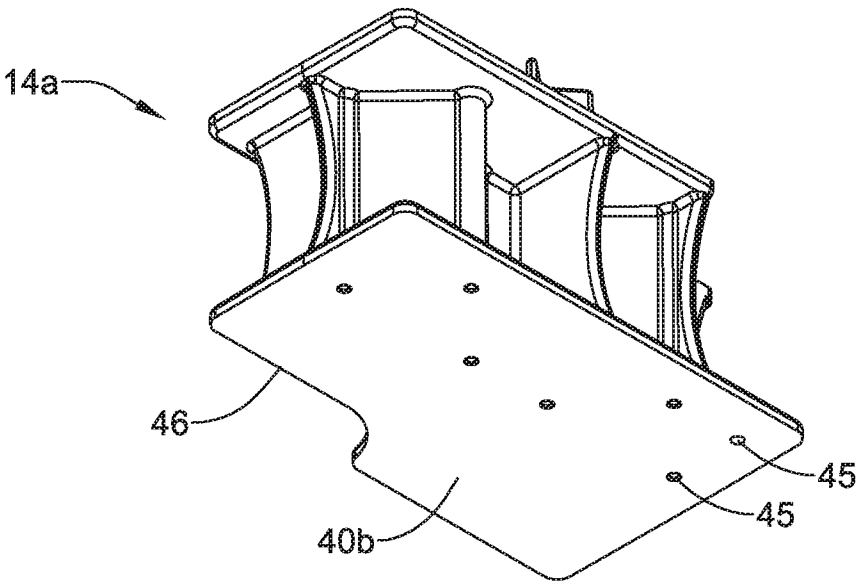

As indicated herein, the composite pallet 10 may include a plurality of support blocks 14. In some instances, different types of support blocks 14 may be utilized. FIGS. 15-16 illustrate a first support block 14*a*. The first support block 14*a* may include a top surface 40*a* and a bottom surface 40*b*. A number of openings 45 may be formed in the first support block 14*a*. In at least some instance, fasteners (e.g., screws, nails, bolts, or the like) may be extended through the openings to secure the first support block 14*a* to other components of the pallet 10. The first support block 14*a* may also include one or more projections 83. The projections 83 are designed so that the first support block 14*a* can fit within and/or interlock with a corresponding socket formed along a bottom surface of a board (e.g., an intermediate board 16) that is disposed along the top surface 40*a*. The shape and/or configuration of the projections 83 can vary. For example, the projections 83 may have a "X" shape, as shown. Other shapes are contemplated including squared shapes (e.g., cubic, rectangular prism, or the like), rounded shapes (spherical, cylindrical, conical, or the like), irregular shapes, or the like. In some instances, the shape of the socket is designed to key with or mate with the projections 83. In other instances, the shape of the socket may differ from that of projections 83 (e.g., the sockets have a squared shape defined by the intersection of longitudinal and transverse ribs but still allow the projections 83 to fit therein).

In at least some instance, the first support block 14*a* is a solid (e.g., non-hollow) structure. A plurality of ribs 41 may be disposed between the top surface 40*a* and the bottom surface 40*b*. The ribs 41 may allow the first support block 14*a* to provide structural support (e.g., to the intermediate boards 16) while taking up less space and while having a reduced weight. The ribs 41 can have a variety of arrangements and/or configurations. The first support block 14*a* may also include a lip or flanged region 42. The lip 42 may be designed to be positioned along an inside surface of an intermediate board 16 and provide support thereto.

In addition to what is described above, the shape, configuration and/or arrangement of the first support block 14*a* can vary. For example, the first support block 14*a* may include a cutout region 43 and a platform region 44. The cutout region 43 and the platform region may be used to house a push support member (not shown in FIGS. 15-16, but an example push support member 47 can be seen, for example, in FIGS. 17-19). A cutout region 46 may be formed along the bottom surface 40*b*.

Figure 17:
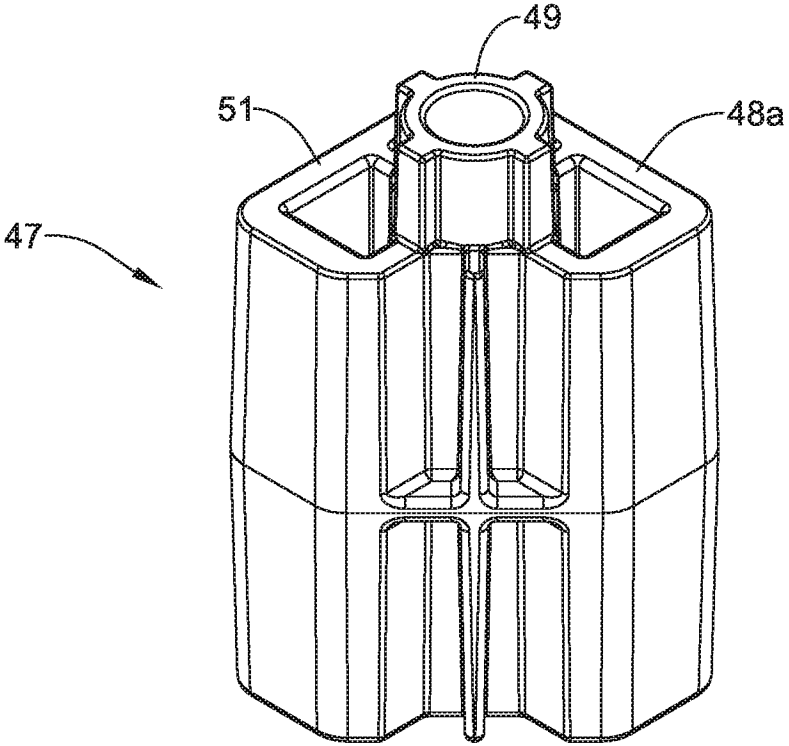
FIGS. 17-18 are perspective views of an example push support member.
Figure 18:
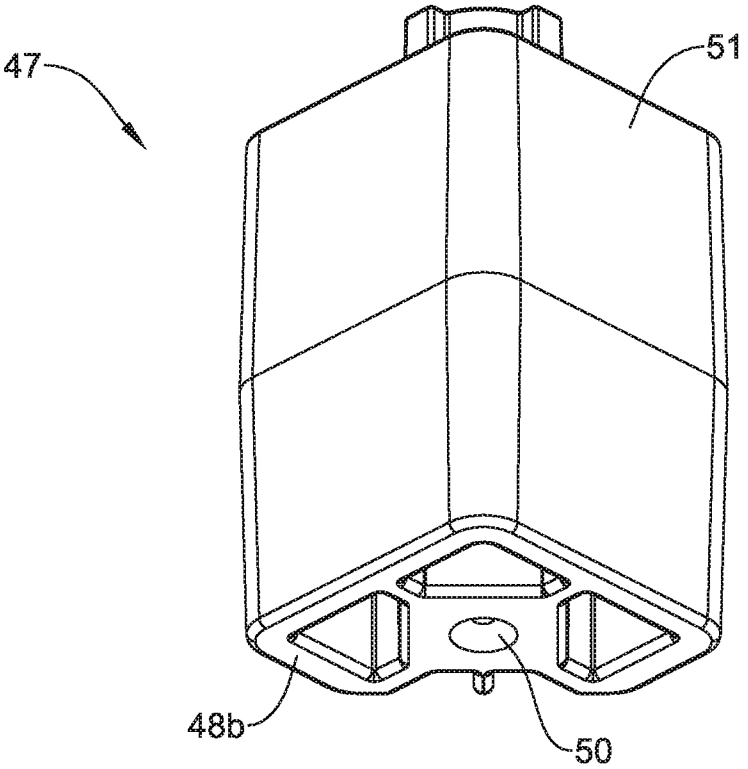

FIGS. 17-18 illustrate an example push support member 47. The push support member 47 may include a first or "top" surface 48*a* and a second or "bottom" surface 48*b*. A boss or projection 49 may extend from the top surface 48*a*. An opening 50 may be formed in the bottom surface 48*b*. The push support member 47 may include a bumper or push surface 51. The push surface 51 (and/or the complete push support members 47) may be formed from a ductile, soft, rubbery, and/or impact absorbing material. Some example materials may include rubber, a thermoplastic elastomer, other elastomers, or the like.

Figure 19:
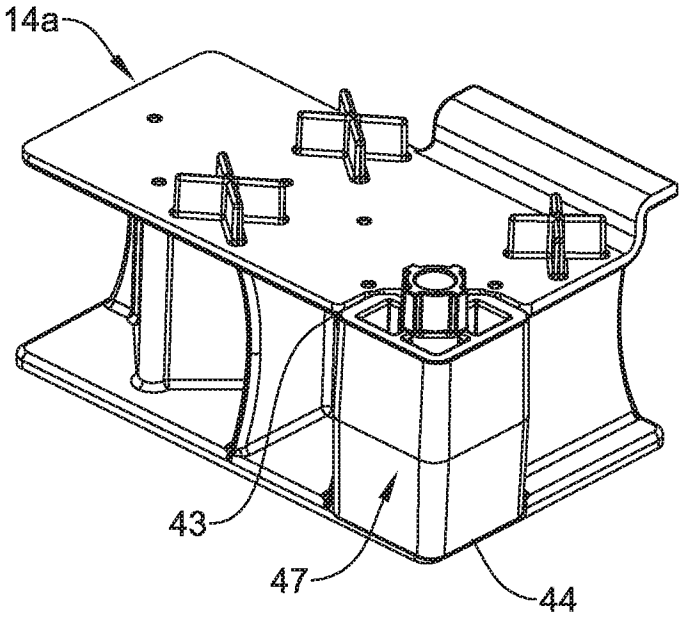
FIG. 19 is a perspective view of an example support block coupled to an example push support member.

FIG. 19 illustrates the push support member 47 coupled to the first support block 14*a*. When doing so, the push support member 47 may be disposed adjacent to the cutout region 43 and positioned along the platform region 44. The push support members 47 may be secured to the first support block 14*a* using a suitable fastener such as a screw, nail, bolt, or the like.

Figure 20:
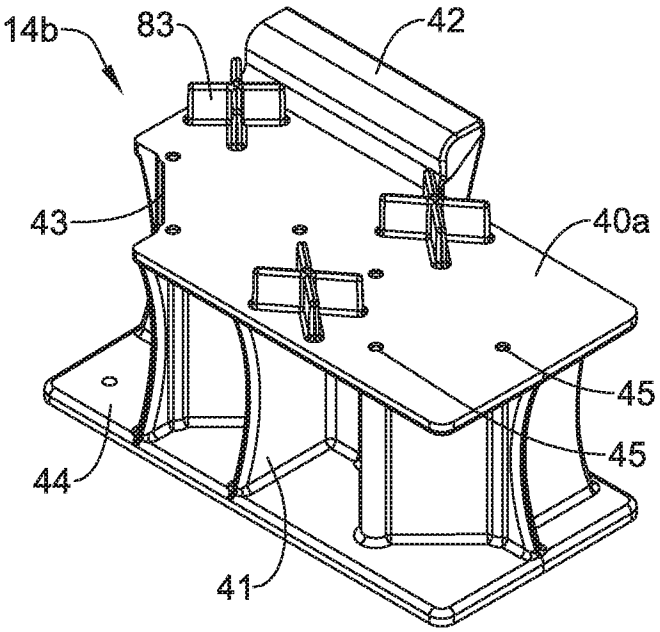
FIGS. 20-21 are perspective views of an example support block.
Figure 21:
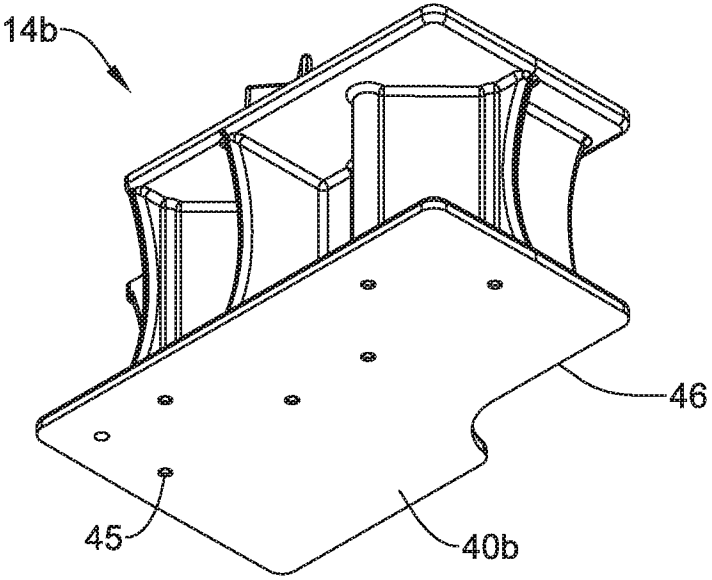
Figure 22:
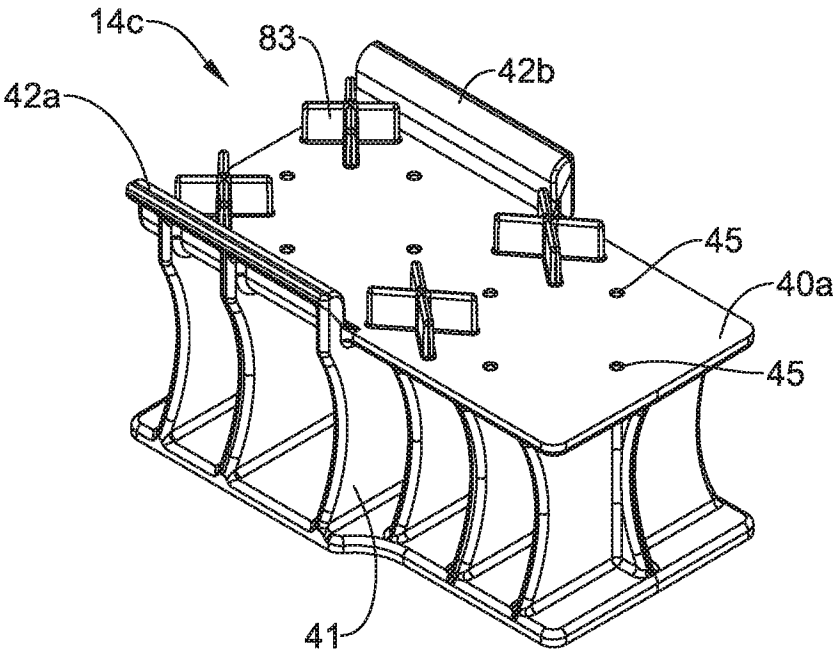
FIGS. 22-23 are perspective views of an example support block.
Figure 23:
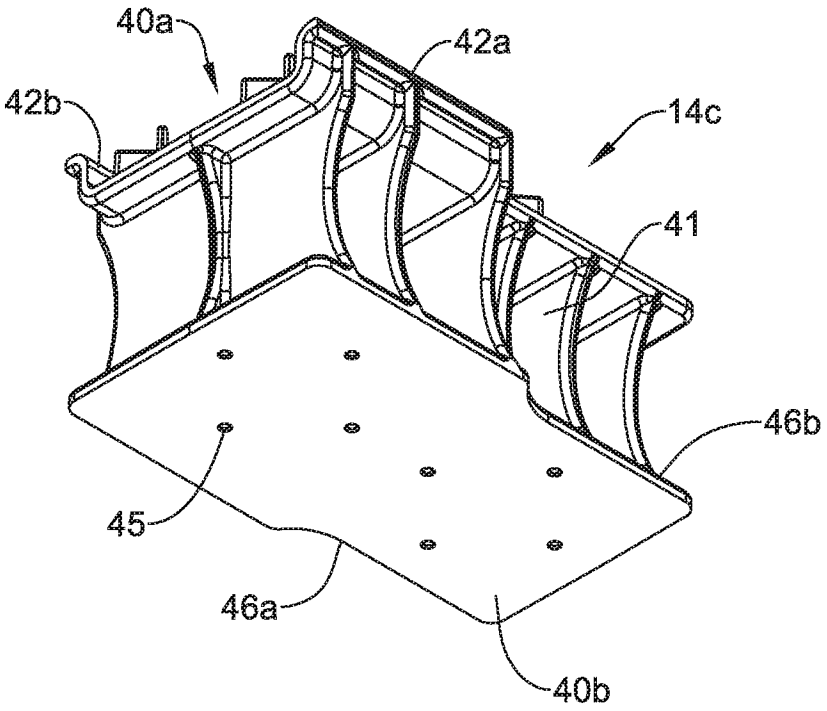
Figure 24:
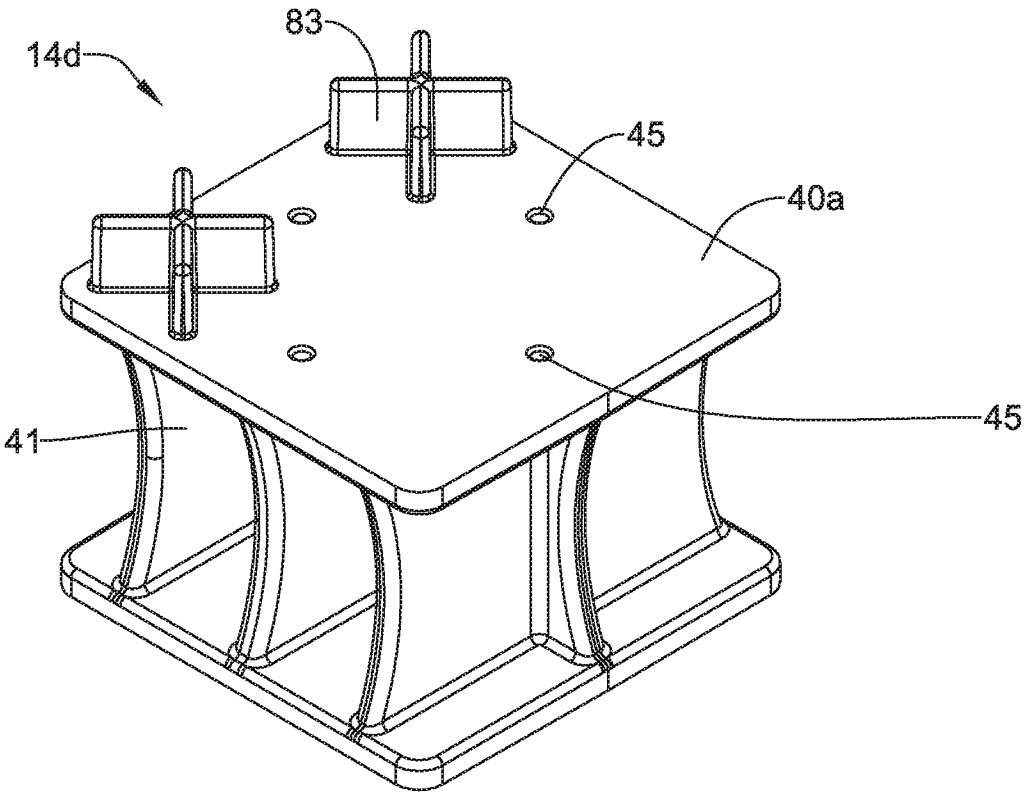
FIGS. 24-25 are perspective views of an example support block.
Figure 25:
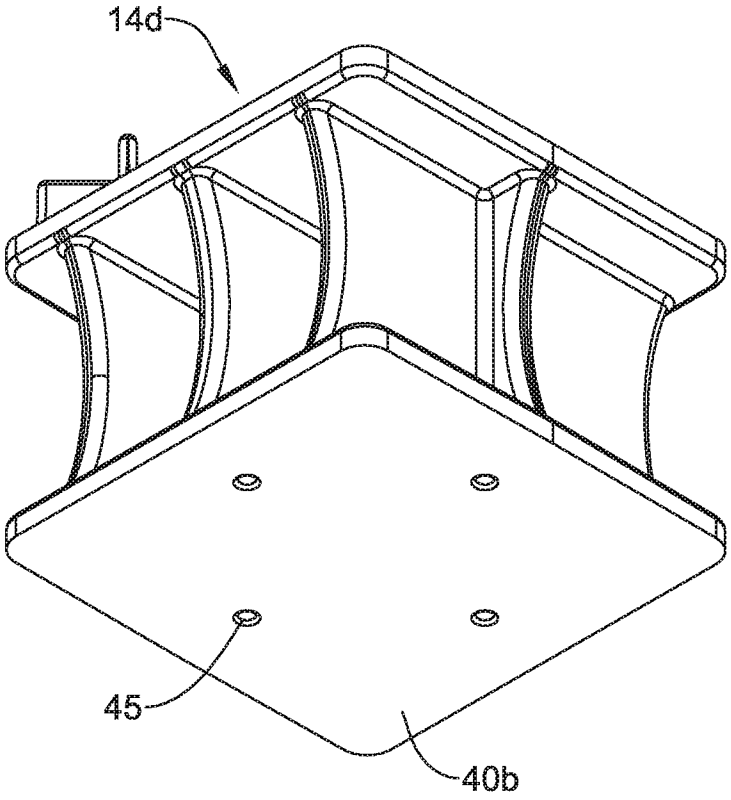

FIGS. 20-25 illustrate additional support blocks that may have some similarity to the first support block 14*a*. For example, FIGS. 20-21 illustrates a second support block 14*b* similar in form and function to other support blocks disclosed herein. Like the first support block 14*a*, the second support block 14*b* may include a top surface 40*a*, a bottom surface 40*b*, ribs 41, a lip 42, a cutout region 43, a platform region 44, openings 45, and projections 83. FIG. 22-23 illustrate a third support block 14*c* similar in form and function to other support blocks disclosed herein. The third support block 14*c* may include a top surface 40*a*, a bottom surface 40*b*, ribs 41, a pair of flanges 42*a*, 42*b* along the top surface 40*a*, openings 45, projections 83, and a pair of cutouts 46*a*, 46*b* along the bottom surface 40*b*. FIGS. 24-25 illustrate a fourth support block 14*d*. The fourth support block 14*d* may include a top surface 40*a*, a bottom surface 40*b*, ribs 41, openings 45, and projections 83.

Figure 26:
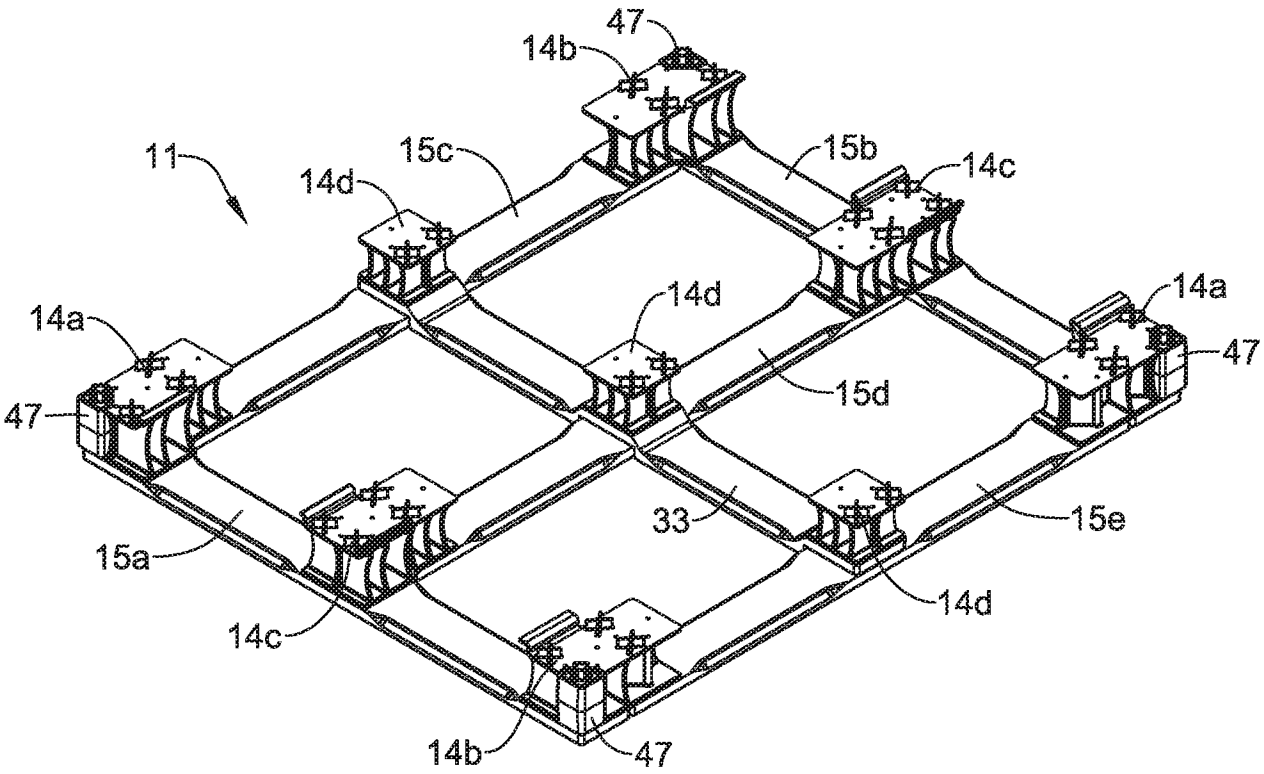
FIG. 26 is a perspective view of a subassembly including a base layer and a plurality of support blocks.

FIG. 26 illustrates a sub assembly of the base layer 11 along with the support blocks 14*a*, 14*b*, 14*c*, and 14*d*. Here, one example arrangement of the support blocks 14*a*, 14*b*, 14*c*, and 14*d* can be seen. For example, the first support blocks 14*a* may be positioned at opposite corners of the base layer 11. These support blocks 14*a* may be considered to be "left-hand corner" support blocks 14*a*. Similarly, the second support blocks 14*b* may be positioned at opposite corners of the base layer 11. These support blocks 14*b* may be considered to be "right-hand corner" support blocks 14*a*. Two of the third support blocks 14*c* may be positioned along the middle portion of the base boards 15*a*, 15*b*. In at least some instances, three support blocks 14*d* are disposed along the cross-member 33. At these positions, the base layer 11 includes both a base board (e.g., a base board 15*c*, 15*d*, or 15*e*) and the cross-member 33. Because of the thickness of the base board 15*c*, 15*d*, 15*e* in combination with the thickness of the cross-member 33, the support blocks 14*d* may have a reduced height when compared with the remaining support blocks 14*a*, 14*b*, and 14*c* so that, for example, the top surfaces of the support blocks 14*a*, 14*b*, 14*c*, and 14*d* are arranged at the same position or height.

In addition, the push support members 47 are shown disposed along the corners of both the first support blocks 14*a* and the second support blocks 14*b*. While this is one arrangement, other arrangements are contemplated. For example, more or fewer push support members 47 may be utilized. The push support members 47 may be disposed at different positions/sides of the first support blocks 14*a* and/or the second support blocks 14*b*. In addition, the other support blocks 14*c*, 14*d* may also include push support members 47, as desired.

Figure 27:
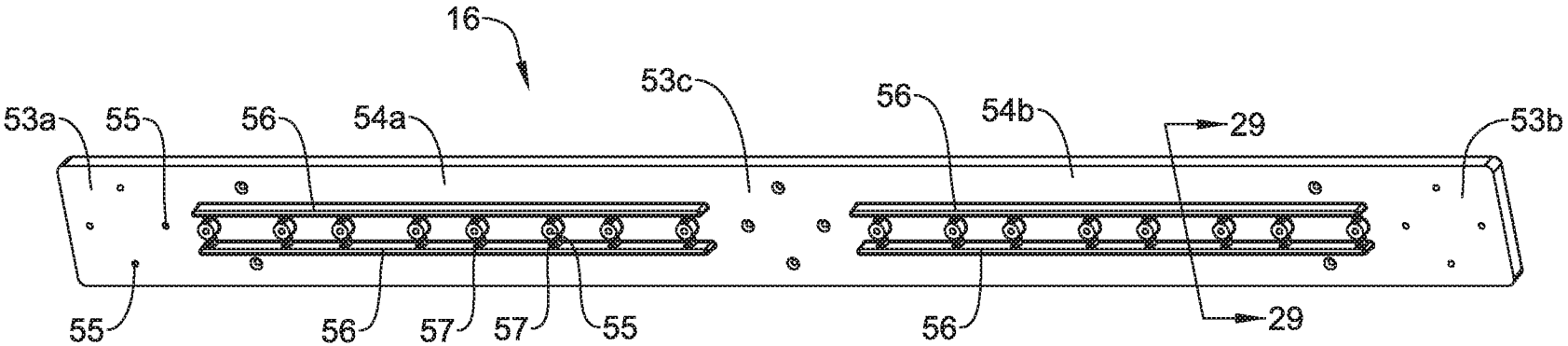
FIGS. 27-28 are perspective views of an example intermediate board.
Figure 28:
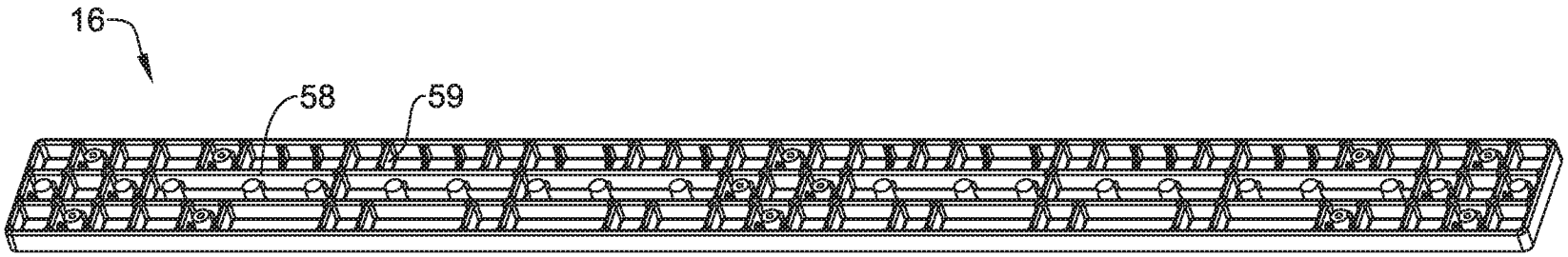

FIGS. 27-28 illustrate an example intermediate board 16. The intermediate board 16 may include a first end region 53*a*, a second end region 53*b*, and a central region 53*c*. A first section 54*a* may be disposed between the first end region 53*a* and the central region 53*c*. A second section 54*b* may be disposed between the second end region 53*b* and the central region 53*c*. A plurality of apertures 55 may be disposed along the intermediate board 16.

The first section 54*a*, the second section 54*b*, or both may include one or more top surface ribs 56. The top surface ribs 56 may provide additional structural support, aid in assembly, and/or the like. One or more bosses 57 may be disposed along the first section 54, the second section 54*b*, or both. At least some of the bosses 57 may have apertures 55 formed therein. The apertures 55 may be designed to be used with a suitable fastener (e.g., a screw, nail, bolt, or the like) to secure the intermediate board 16 to other structures of the pallet 10. The bosses 57 may be designed to interlock with another structure such as a top board 17 disposed thereon.

The underside or bottom of the intermediate board 16 may include a number of structural features. For example, as shown in FIG. 28, the intermediate board 16 may include a number of longitudinal ribs 58. The longitudinal ribs 58 may provide structural support to the intermediate board 16. A suitable number of longitudinal ribs 58 may be disposed along the intermediate board 16. For example, the intermediate board 16 may include one, two, three, four, five, six, seven, eight, or more longitudinal ribs 58. The longitudinal ribs 58 may be equally spaced from one another. Alternatively, the distance between one or more of the longitudinal ribs 58 may vary along the intermediate board 16. In some instances, all of the longitudinal ribs 58 extend along the full length of the intermediate board 16. In other instances, one or more of the longitudinal ribs 58 extend along only a portion of the length of the intermediate board 16. The height (e.g., which may be understood as the distance from the bottom surface of the intermediate board 16 to the bottom surface of the longitudinal ribs 58) of the longitudinal ribs 58 may be substantially constant along the length of the longitudinal ribs 58 or may vary. For example, longitudinal ribs 58 are contemplated where the height varies in a wave-like pattern. In general, the longitudinal ribs 58 extend along a path that is aligned with or parallel to the longitudinal axis of the intermediate board 16. However, even though the longitudinal ribs 58 are named "longitudinal", this is not intended to limit the longitudinal ribs 58 to being only oriented in a straight line along the longitudinal axis of the intermediate board 16. Longitudinal ribs 58 are contemplated that extend diagonally, include curves or bends, or otherwise extend in directions other than just along the longitudinal axis.

In at least some instances, the longitudinal ribs 58 may be arranged in a relatively dense pattern. For example, the space between adjacent longitudinal ribs 58 may be about 0.25-2 inches, or about 0.5-1.5 inches, or about 1 inch. By having the longitudinal ribs 26 arranged in a relatively dense pattern, the longitudinal ribs 58 can provide a greater amount of structural support to the intermediate board 16. In some instances, all of the longitudinal ribs 58 may have the same thickness or width. In other instances, one or more of the longitudinal ribs 58 may have a different (e.g., increased) width or thickness. For example, the longitudinal ribs 58 nearest the periphery of the intermediate board 16 may have an increased width or thickness relative to other longitudinal ribs 58.

The intermediate board 16 may include a number of transverse ribs 59. A suitable number of transverse ribs 59 may be disposed along the intermediate board 16. For example, the intermediate board 16 may include 1-100, or more, transverse ribs 59. The transverse ribs 59 may be equally spaced from one another. Alternatively, the distance between two or more of the transverse ribs 59 may vary along the intermediate board 16. In some instances, all of the transverse ribs 59 extend along the full width of the intermediate board 16. In other instances, one or more of the transverse ribs 59 extend along only a portion of the width of the intermediate board 16. Indeed, a single transverse rib 59 may be considered to be a structure that extends between two adjacent longitudinal ribs 58. The height (e.g., which may be understood as the distance from the bottom surface of the intermediate board 16 to the bottom surface of the transverse ribs 59) of the transverse ribs 59 may be substantially constant along the length of the transverse ribs 59 or may vary. For example, transverse ribs 59 are contemplated where the height varies in a wave-like pattern. In general, the transverse ribs 59 extend along a path that is transverse or perpendicular to the longitudinal axis of the intermediate board 16. However, even though the transverse ribs 59 are named "transverse", this is not intended to limit the transverse ribs 59 to being only oriented in a straight line transverse to the longitudinal axis of the intermediate board 16. Transverse ribs 59 are contemplated that extend diagonally, include curves or bends, or otherwise extend in directions other than just transverse to the longitudinal axis. In some instances, the intersections of the longitudinal ribs 58 and the transverse ribs 59 may define sockets or compartments into which other structures of the pallet 10 may extend. This may help to secure or interlock various structures of the pallet 10.

Figure 29:
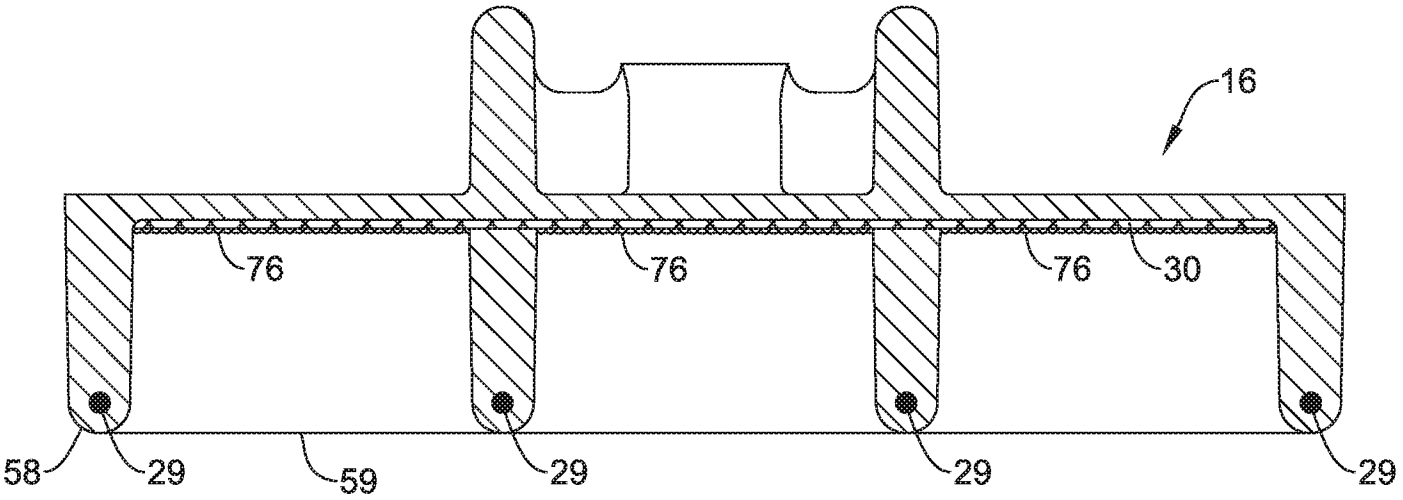
FIG. 29 is a cross-sectional view taken through line 29-29 in FIG. 27.

A cross-sectional view of the intermediate board 16 is shown in FIG. 29. Here some of the other structural features of the intermediate board 16 can be seen. For example, one or more of the longitudinal ribs 58 may include a tension member 29. In some instances, the tension member 29 may be described as a continuous fiber bundle that includes a plurality of fibers in a thermoplastic resin. The tension member 29 may provide strength in tension to increase the overall strength of the intermediate board 16, for example, by preventing the intermediate board 16 from bowing or cracking or breaking when a force is applied thereto. The tension member 29 may include a range of thickness/filament counts. For example, the tension member 29 may define a thickness (e.g., a diameter) of about greater than or equal to 0.05 inches, greater than or equal to 0.1 inches, greater than or equal to 0.125 inches, etc. and/or less than or equal to 0.25 inches, less than or equal to 0.2 inches, less than or equal to 0.15 inches, etc. Also, for example, the tension member 29 may include at least between 1,000 and 20,000 continuous fibers dispersed in a thermoplastic material. In one or more embodiments, the tension member 29 may be twisted to further increase the tensile strength. For example, the tension member 29 may be grouped in portions of 4,000 continuous fibers that are twisted and combined with additional groups of continuous fibers that may be twisted.

The intermediate board 16 may include a suitable number of tension members 29. For example, the intermediate board 16 may include a tension member 29 in each of the longitudinal ribs 58. In at least some instances, the tension members 29 are positioned near an end or edge region of the longitudinal ribs 58. Other positions along the longitudinal ribs 58 may include tension members 29. In other instances, some or all of the longitudinal ribs 58 may lack tension members 29 and/or tension members 29 are disposed along other portions of the intermediate board 16. Some intermediate boards 16 are contemplated that do not have a tension member 29 at all.

The intermediate board 16 may also include a structural member 30. As described above in relation to the base board 15, the "structural" member 30 may take the form of a structural member 30, an impact member 30, a member 30 that provides both structural support and impact resistance, or combinations thereof. Some intermediate boards 16 are contemplated that do not have a structural member 30 at all. The intermediate board 16 may also have a textured bottom surface 76, similar to that of the base board 15.

The intermediate board 16 may be formed from a suitable material. For example, the intermediate board 16 may be made from polypropylene, high density polyethylene, nylon, combinations thereof, and the like, or other materials disclosed herein. In addition to the tension members 29 and structural members 30 described above, the intermediate board 16 may include additional reinforcement such as fiber reinforcements (e.g., reinforcement with glass fibers, carbon fibers, basalt fibers, graphite fibers, aramid fibers, ceramic fibers, natural fibers, polymeric fibers, metal fibers, combinations thereof, or the like). The intermediate board 16 may be formed using a suitable process such as injection molding, base molding, casting, or the like. In some instances, all of the intermediate boards 16 are the same. In other instances, one or more of the intermediate boards 16 may differ in structure. Some of the differences contemplated include differences where one or more of the intermediate boards 16 include structures found in some of the other components of the pallet 10.

Figure 30:
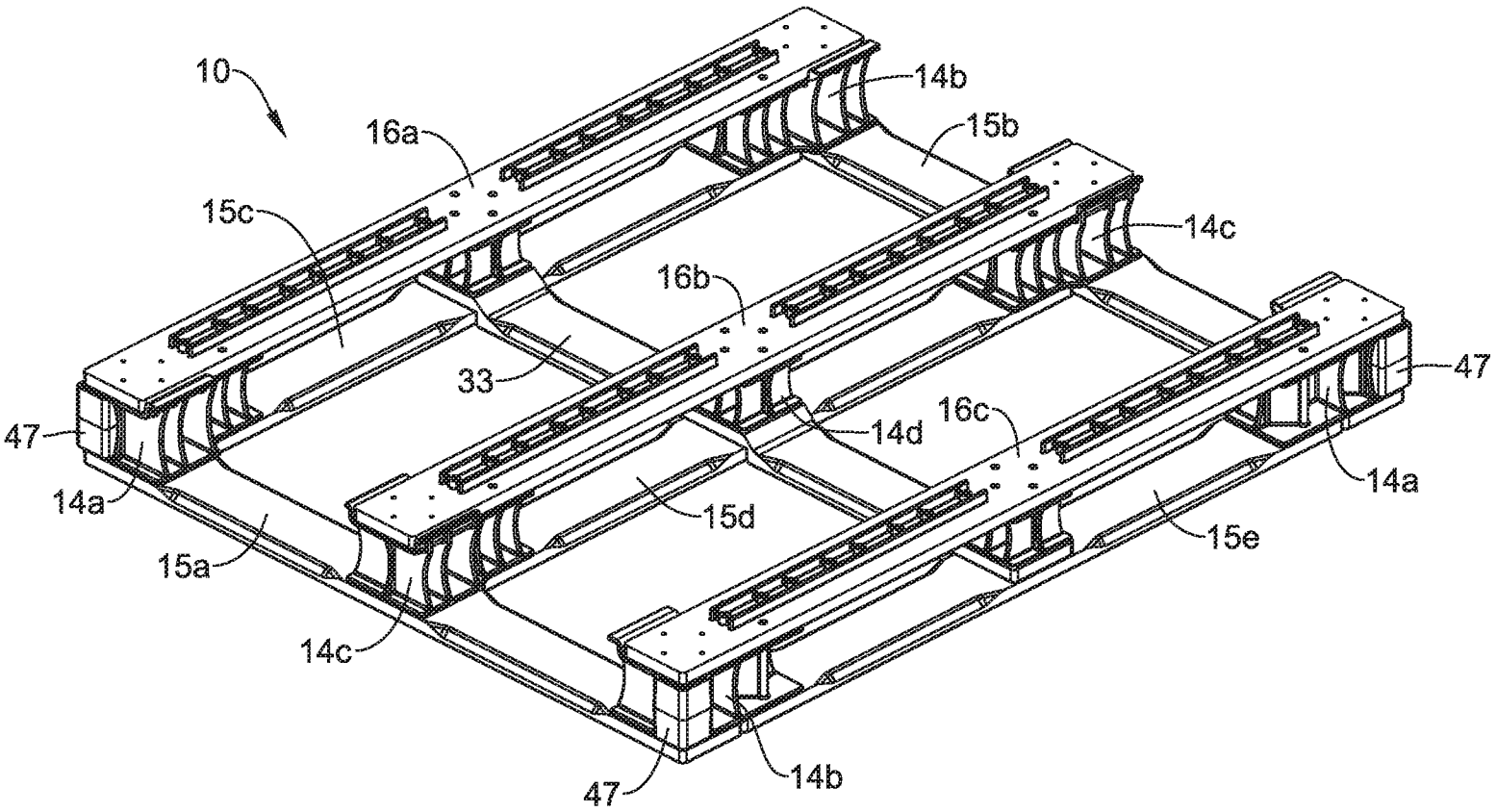
FIG. 30 is a perspective view of a subassembly including a base layer, a plurality of support blocks, and intermediate boards.

FIG. 30 illustrates a subassembly of the pallet 10 where the intermediate boards 16 are coupled to the support blocks 14*a*, 14*b*, 14*c*, 14*d*. In this example, three intermediate boards 16*a*, 16*b*, 16*c* are utilized. However, more or fewer intermediate boards may be utilized. In at least some instances, the intermediate boards 16*a*, 16*b*, and 16*c* are arranged perpendicularly relative to the cross-member 33. However, other arrangements are contemplated.

Figure 31:
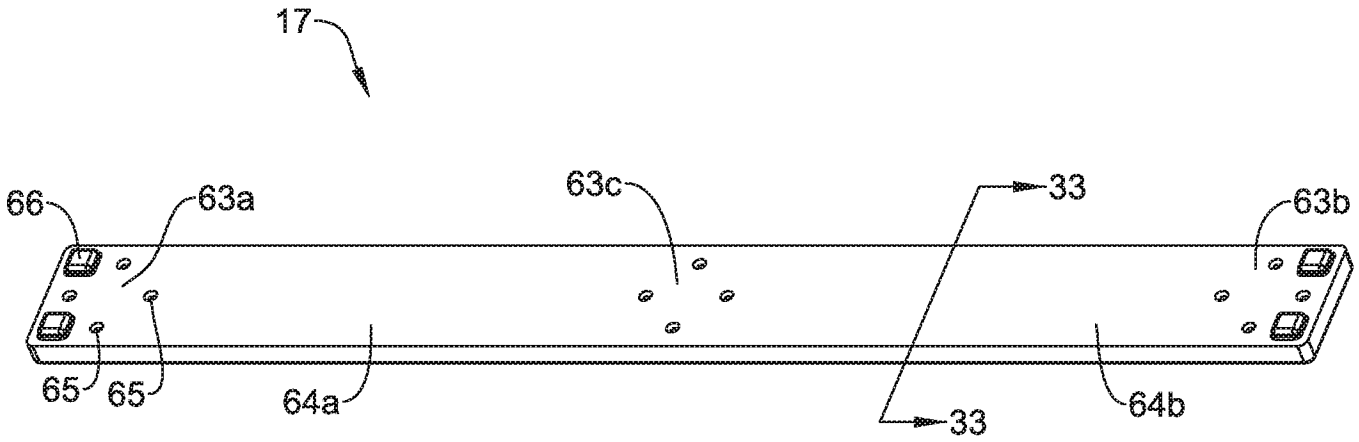
FIGS. 31-32 are perspective views of an example top board.
Figure 32:
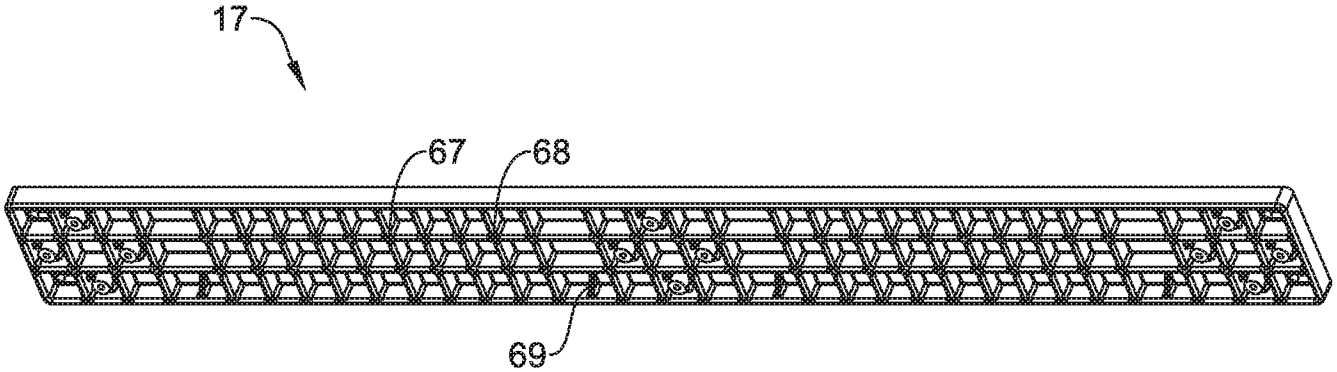

FIGS. 31-32 illustrate an example top board 17. The top board 17 may include a first end region 63*a*, a second end region 63*b*, and a central region 63*c*. A first section 64*a* may be disposed between the first end region 63*a* and the central region 63*c*. A second section 64*b* may be disposed between the second end region 63*b* and the central region 63*c*. A plurality of apertures 65 may be disposed along the top board 17.

In at least some instances, the top board 17 may include one or more projections 66. The projections 66 may be attached to the top board 17 or may be integral parts of the top board 17 (e.g., the projections 66 are part of a common mold that is used to form the top board 17). The projections 66 may serve as stops or structural features that allow goods placed on the pallet 10 to engage so that the good can be substantially prevented from sliding off of the pallet 10. In addition, the projections 66 may aid in stacking a plurality of pallets 10 upon one another. For example, the projections 66 may interlock with grooves or sockets formed along the bottom surface of a base board 15 of an adjacent pallet 10. In some instances, the projections 66 are disposed along the first end region 63*a*, the second end region 63*b*, or both. However, this is not intended to be limiting. The projections 66 may be disposed along any suitable portion of the top board 17 such as along the central region 63*c*, the first section 64*a*, the second section 64*b*, and/or combinations thereof.

The underside or bottom of the top board 17 may include a number of structural features. For example, as shown in FIG. 32, the top board 17 may include a number of longitudinal ribs 67. The longitudinal ribs 67 may provide structural support to the top board 17. A suitable number of longitudinal ribs 67 may be disposed along the top board 17. For example, the top board 17 may include one, two, three, four, five, six, seven, eight, or more longitudinal ribs 67. The longitudinal ribs 67 may be equally spaced from one another. Alternatively, the distance between one or more of the longitudinal ribs 67 may vary along the top board 17. In some instances, all of the longitudinal ribs 67 extend along the full length of the top board 17. In other instances, one or more of the longitudinal ribs 67 extend along only a portion of the length of the top board 17. The height (e.g., which may be understood as the distance from the bottom surface of the top board 17 to the bottom surface of the longitudinal ribs 67) of the longitudinal ribs 67 may be substantially constant along the length of the longitudinal ribs 67 or may vary. For example, longitudinal ribs 67 are contemplated where the height varies in a wave-like pattern. In general, the longitudinal ribs 67 extend along a path that is aligned with or parallel to the longitudinal axis of the top board 17. However, even though the longitudinal ribs 67 are named "longitudinal", this is not intended to limit the longitudinal ribs 67 to being only oriented in a straight line along the longitudinal axis of the top board 17. Longitudinal ribs 67 are contemplated that extend diagonally, include curves or bends, or otherwise extend in directions other than just along the longitudinal axis.

In at least some instances, the longitudinal ribs 67 may be arranged in a relatively dense pattern. For example, the space between adjacent longitudinal ribs 67 may be about 0.25-2 inches, or about 0.5-1.5 inches, or about 1 inch. By having the longitudinal ribs 26 arranged in a relatively dense pattern, the longitudinal ribs 67 can provide a greater amount of structural support to the top board 17. In some instances, all of the longitudinal ribs 67 may have the same thickness or width. In other instances, one or more of the longitudinal ribs 67 may have a different (e.g., increased) width or thickness. For example, the longitudinal ribs 67 nearest the periphery of the top board 17 may have an increased width or thickness relative to other longitudinal ribs 67. The same may be true of other components of the pallet 10 and/or the components of other pallets disclosed herein.

The top board 17 may include a number of transverse ribs 68. A suitable number of transverse ribs 68 may be disposed along the top board 17. For example, the top board 17 may include 1-100, or more, transverse ribs 68. The transverse ribs 68 may be equally spaced from one another. Alternatively, the distance between two or more of the transverse ribs 68 may vary along the top board 17. In some instances, all of the transverse ribs 68 extend along the full width of the top board 17. In other instances, one or more of the transverse ribs 68 extend along only a portion of the width of the top board 17. Indeed, a single transverse rib 68 may be considered to be a structure that extends between two adjacent longitudinal ribs 67. The height (e.g., which may be understood as the distance from the bottom surface of the top board 17 to the bottom surface of the transverse ribs 68) of the transverse ribs 68 may be substantially constant along the length of the transverse ribs 68 or may vary. For example, transverse ribs 68 are contemplated where the height varies in a wave-like pattern. In general, the transverse ribs 68 extend along a path that is transverse or perpendicular to the longitudinal axis of the top board 17. However, even though the transverse ribs 68 are named "transverse", this is not intended to limit the transverse ribs 68 to being only oriented in a straight line transverse to the longitudinal axis of the top board 17. Transverse ribs 68 are contemplated that extend diagonally, include curves or bends, or otherwise extend in directions other than just transverse to the longitudinal axis. In some instances, the intersections of the longitudinal ribs 67 and the transverse ribs 68 may define sockets or compartments into which other structures of the pallet 10 may extend. This may help to secure or interlock various structures of the pallet 10.

Figure 33:
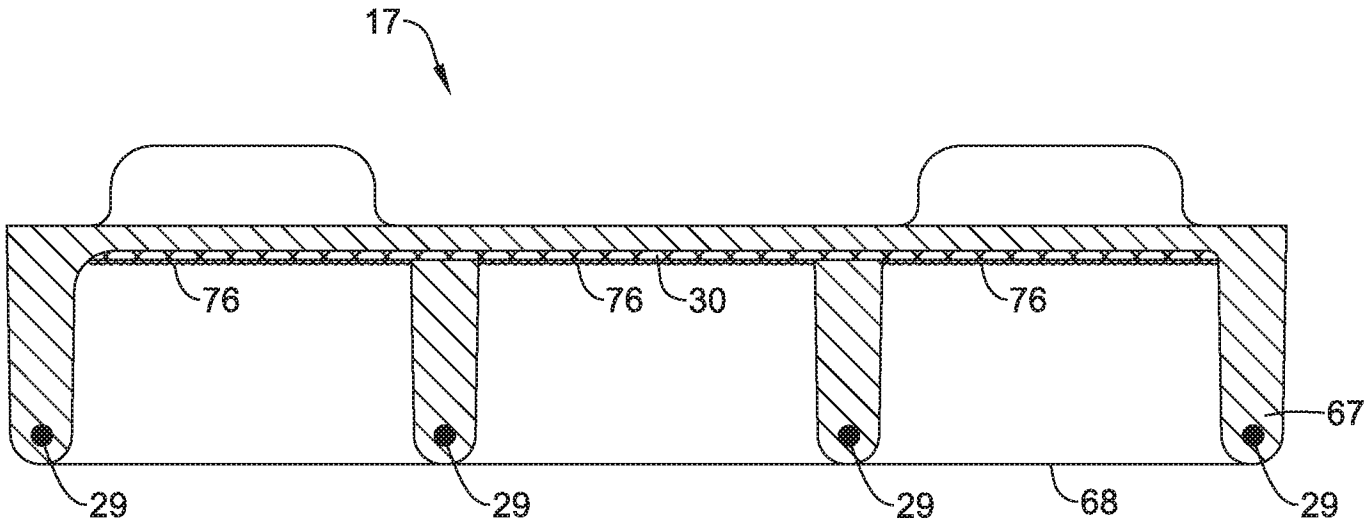
FIG. 33 is a cross-sectional view taken through line 33-33 in FIG. 31.

A cross-sectional view of the top board 17 is shown in FIG. 33. Here, some of the other structural features of the top board 17 can be seen. For example, one or more of the longitudinal ribs 67 may include a tension member 29. In some instances, the tension member 29 may be described as a continuous fiber bundle that include a plurality of fibers in a thermoplastic resin. The tension member 29 may provide strength in tension to increase the overall strength of the top board 17, for example, by preventing the top board 17 from bowing or cracking or breaking when a force is applied thereto. The tension member 29 may include a range of thickness/filament counts. For example, the tension member 29 may define a thickness (e.g., a diameter) of about greater than or equal to 0.05 inches, greater than or equal to 0.1 inches, greater than or equal to 0.125 inches, etc. and/or less than or equal to 0.25 inches, less than or equal to 0.2 inches, less than or equal to 0.15 inches, etc. Also, for example, the tension member 29 may include at least between 1,000 and 20,000 continuous fibers dispersed in a thermoplastic material. In one or more embodiments, the tension member 29 may be twisted to further increase the tensile strength. For example, the tension member 29 may be grouped in portions of 4,000 continuous fibers that are twisted and combined with additional groups of continuous fibers that may be twisted.

The top board 17 may include a suitable number of tension members 29. For example, the top board 17 may include a tension member 29 in each of the longitudinal ribs 67. In at least some instances, the tension members 29 are positioned near an end or edge region of the longitudinal ribs 67. Other positions along the longitudinal ribs 67 may include tension members 29. In other instances, some or all of the longitudinal ribs 67 may lack tension members 29 and/or tension members 29 are disposed along other portions of the top board 17. Some top boards 17 are contemplated that do not have a tension member 29 at all.

The top board 17 may also include a structural member 30. As described above in relation to the base board 15, the "structural" member 30 may take the form of a structural member 30, an impact member 30, a member 30 that provides both structural support and impact resistance, or combinations thereof. Some top boards 17 are contemplated that do not have a structural member 30 at all. The top board 17 may also have a textured bottom surface 76, similar to that of the base board 15.

The top board 17 may be formed from a suitable material. For example, the top board 17 may be made from polypropylene, high density polyethylene, nylon, combinations thereof, and the like, or other materials disclosed herein. In addition to the tension members 29 and structural members 30 described above, the top board 17 may include additional reinforcement such as glass or polymeric fibers. The top board 17 may be formed using a suitable process such as injection molding, base molding, casting, or the like. In some instances, all of the top boards 17 are the same. In other instances, one or more of the top board 17 may differ in structure. Some of the differences contemplated include differences where one or more of the top board 17 include structures found in some of the other components of the pallet 10. The top board 17 may also include one or more gussets 69.

Figure 34:
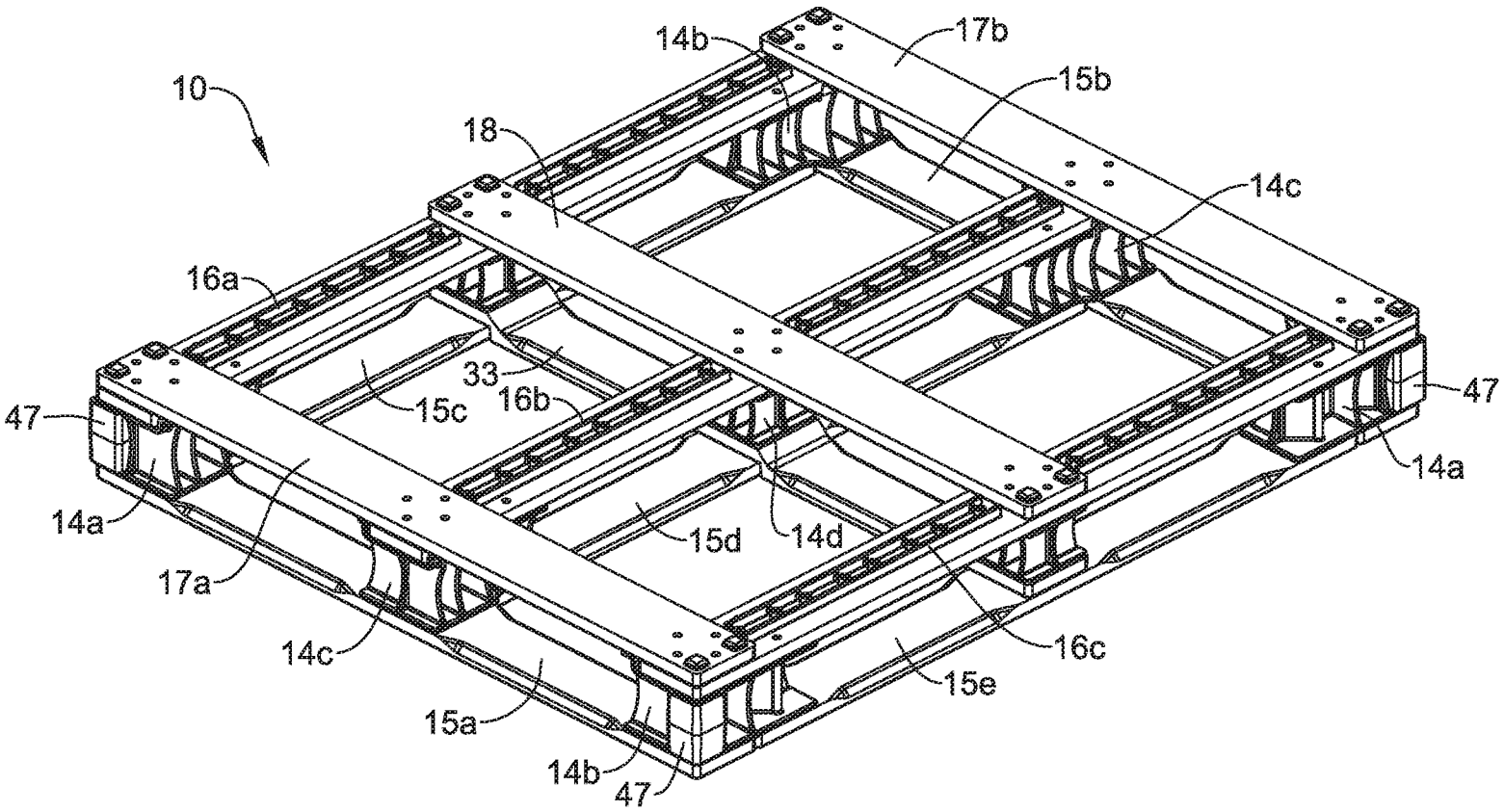
FIG. 34 is a perspective view of a subassembly including a base layer, a plurality of support blocks, intermediate boards, and top boards.

FIG. 34 illustrates a subassembly of the pallet 10 where the two top boards 17*a*, 17*b* are coupled to the intermediate boards 16. In addition, a structural board 18 is also shown coupled to the intermediate boards 16. The structural board 18 may have the same structure as the top boards 17*a*, 17*b*, or may be different. For example, the structural board 18 may include features described in relation to other components of the pallet 10.

Figure 35:
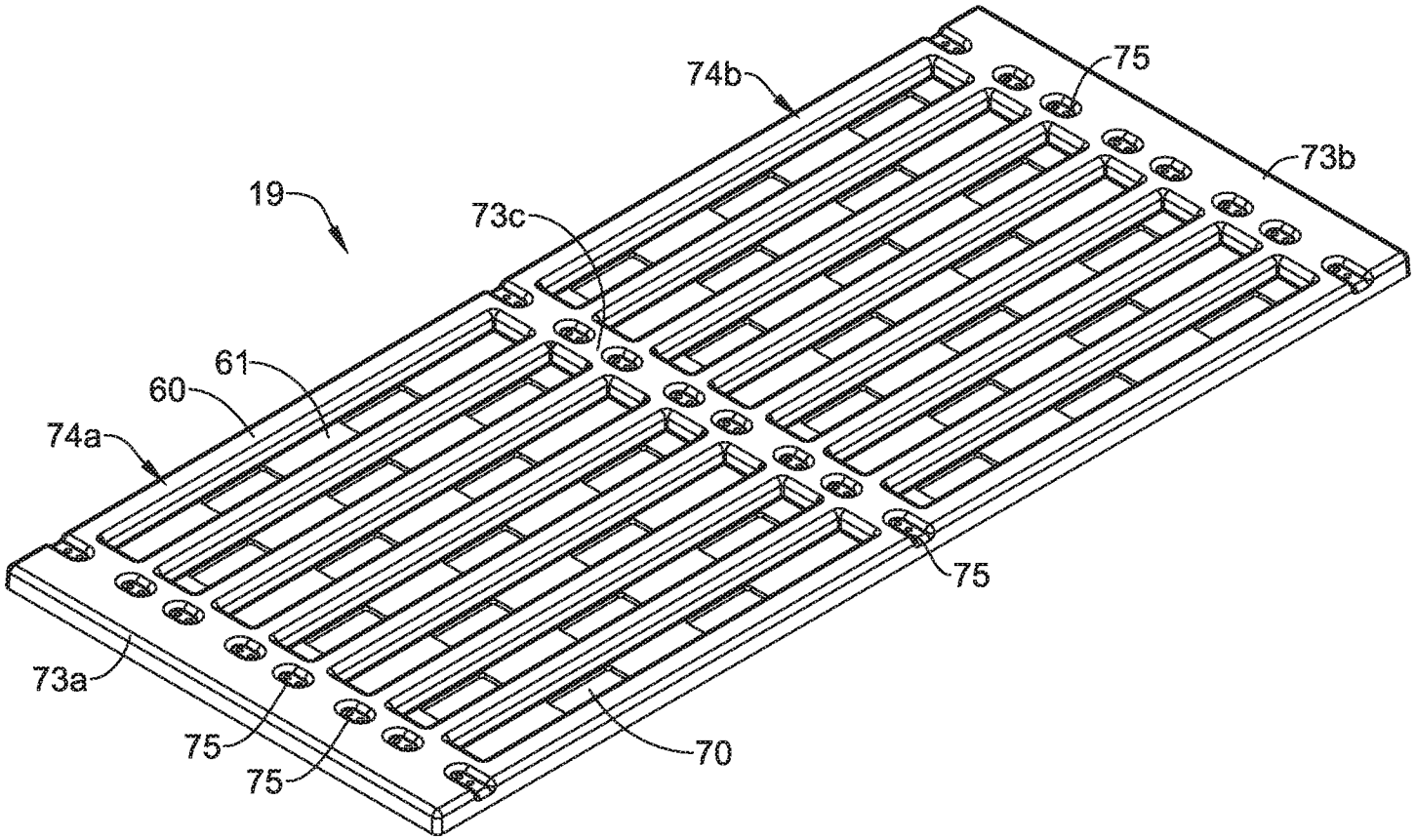
FIGS. 35-36 are perspective views of an example panel.
Figure 36:
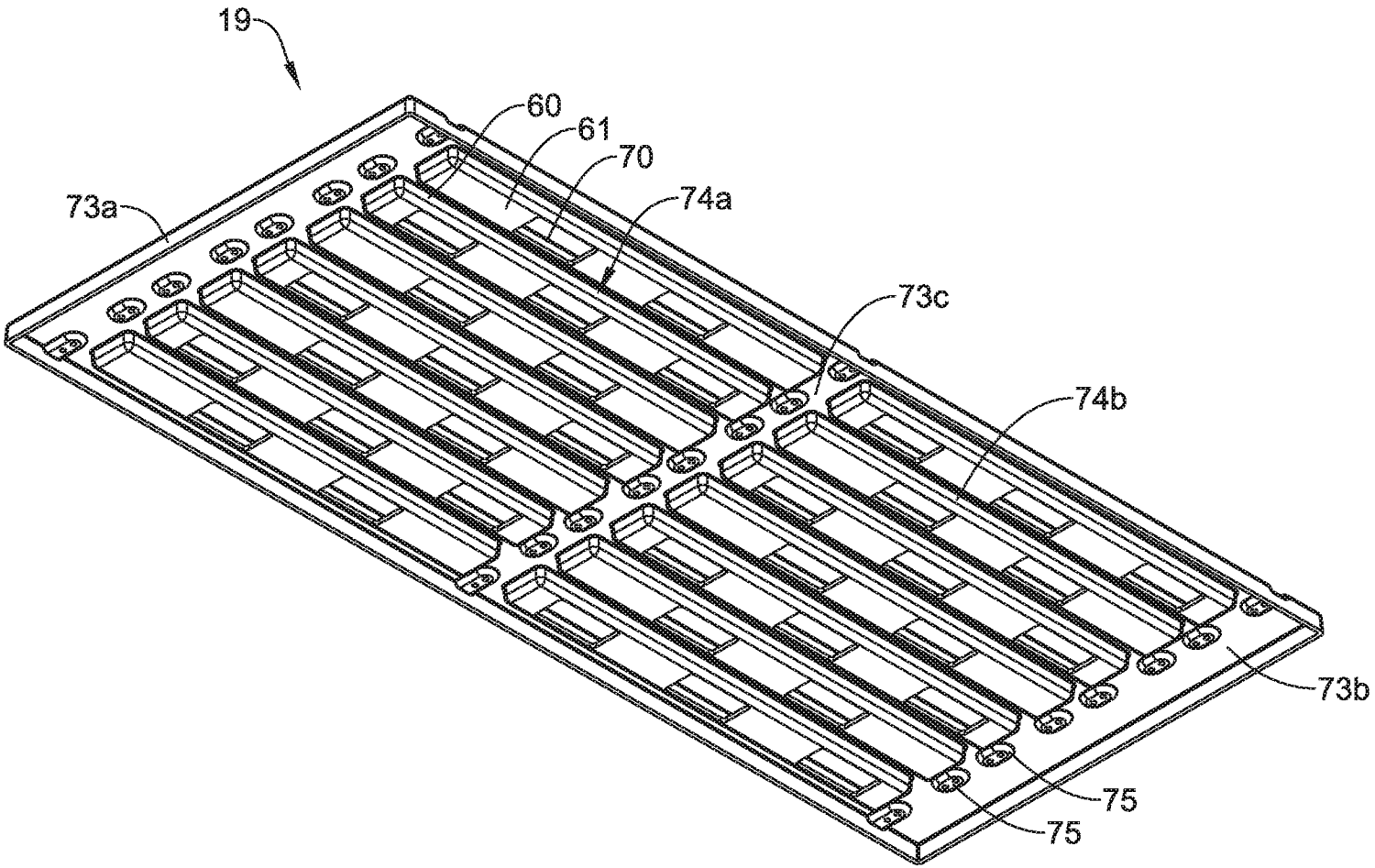

FIGS. 35-36 illustrate an example panel 19. The panel may have a first end region 73*a*, a second end region 73*b*, and a central region 73*c*. A first section 74*a* may be disposed between the first end region 73*a* and the central region 73*c*. A second section 74*b* may be disposed between the second end region 73*b* and the central region 73*c*. The panel 19 may include a plurality of depressions or dimples 75. The dimples 75 may be used to secure the panel 19 to other components of the pallet 10 (e.g., via a screw, bolt, nail, or the like). For example, the dimples 75 may be designed to fit over, fit between, interlock with, and/or otherwise engage with the bosses 57 of the intermediate board 16. In FIGS. 35-36, each of the dimples 75 is shown having a pair of apertures (e.g., openings that a fastener may pass through). The pair of apertures allows the panels 19 to have greater compatibility with different pallets. The first section 74*a* and the second section 74*b* may be arranged as a plurality of ribs or projections 60 with recessed regions 61 between the ribs. The recessed regions 61 may include a plurality of openings 70. The openings 70 may be arranged in a pattern. For example, one of the recessed regions 61 may end in an opening 70 adjacent to a first end region 73*a* and at the opposite end of the recessed region 61, an opening 70 may be spaced from the second end region 73*b*. The arrangement may vary among the recessed regions 61. Such an offset pattern of the openings 70 may allow a number of pallets 10 to be stacked upon one another in a way so that there is not a direct fluid pathway through a stacked group of pallets 10. Instead, water (e.g., which may come from a sprinkler) may cascade through a stack of pallets 10, which may improve the fire rating of the pallets 10. When the panel 19 (or a pair of panels 19*a*, 19*b*), as well as the remainder of the top layer 13, are secured to the intermediate boards 16, the result is the composite pallet 10 as shown in FIG. 1.

In addition to what is described above, the pallet 10 may include a number of additional features. For example, the individual components of the pallet 10 may be designed to detachably coupled or connected to other components. For the purposes of this disclosure, detachably coupled or connected may be understood to mean that the components may be a collection of distinct structures that can be secured to one another using a suitable fastener (e.g., a screw, nail, bolt, or the like) and then, if desired, the components may be detached from one another by releasing the fastener (e.g., "unscrewing the screw"). For example, the support blocks 14 may be detachably coupled to the base boards 15. The intermediate boards 16 may be detachably coupled to the support blocks 14. The top boards and/or the panels 19 may be detachably coupled to the intermediate boards 16. Accordingly, the components of the pallet 10 can be assembled in a desired manner or order and, if desired, one or more of the components can be detached for repair, replacement, or the like. Some of the pallets 10 contemplated include components that are secured without the use of an adhesive bond, thermal bond, or the like. Indeed, some of the pallets 10 contemplated are completely free of adhesive bonds/glue, free of thermal bonds, etc. Pallets with components that are detachably coupled/connected, such as pallet 10, differ from wood pallets that can often break when components are removed. Pallet 10 also differs from other pallets that may include components, including composite pallets, that are molded as a singular unit or that include components that are fixedly attached (e.g., with an adhesive bond, thermal bond, or the like).

Figure 37:
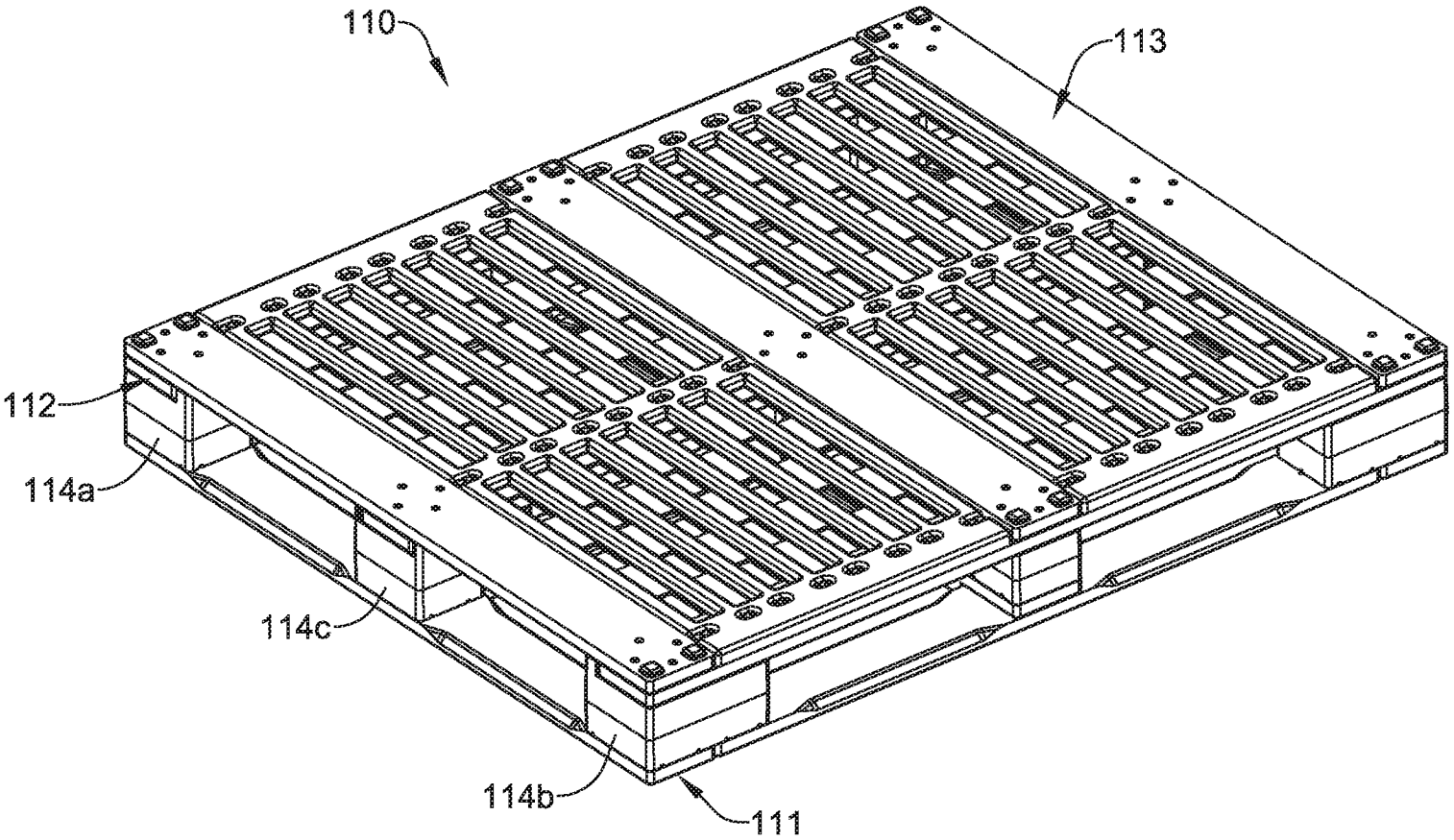
FIG. 37 is a perspective view of an example pallet.

FIG. 37 illustrates another example composite pallet 110 that may be similar in form and function to other pallets disclosed herein. The pallet 110 may include a base layer 111, an intermediate layer 112, and a top layer 113. A plurality of support blocks 114*a*, 114*b*, 114*c*, and 114*d* (not shown in FIG. 37, can be seen in FIG. 41) may be disposed between the base layer 111 and the intermediate layer 112.

Figure 38:
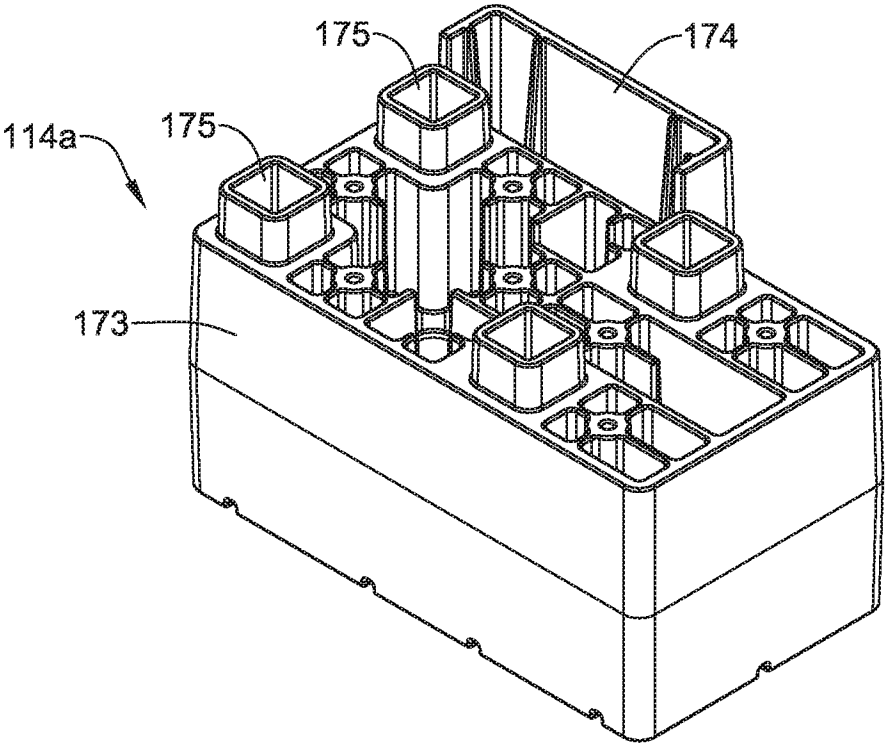
FIGS. 38-41 are perspective views of example support blocks.
Figure 39:
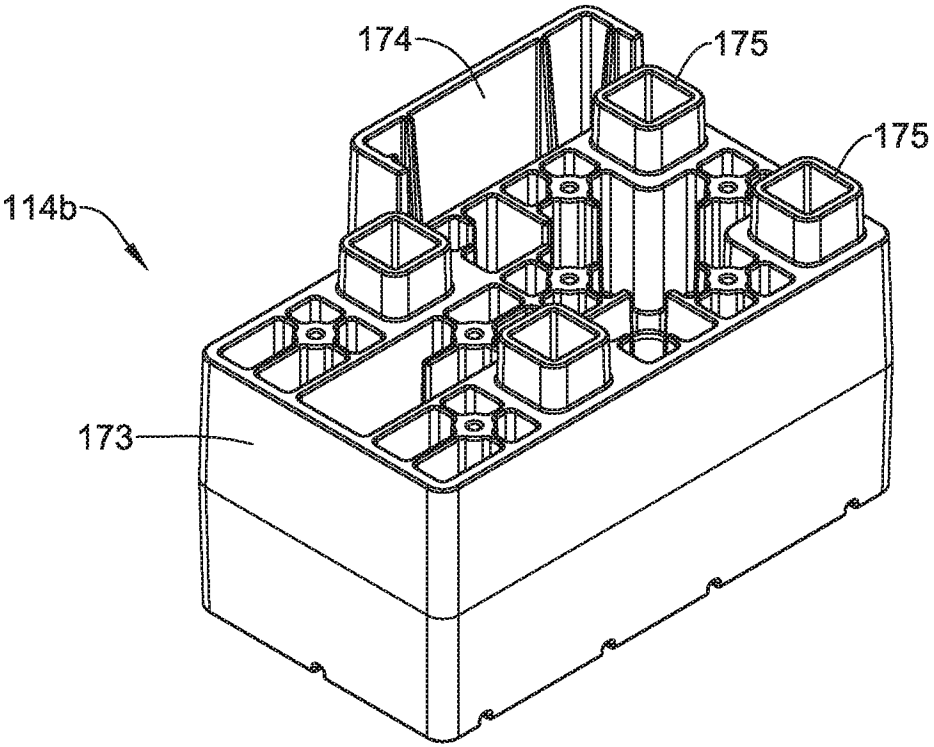
Figure 40:
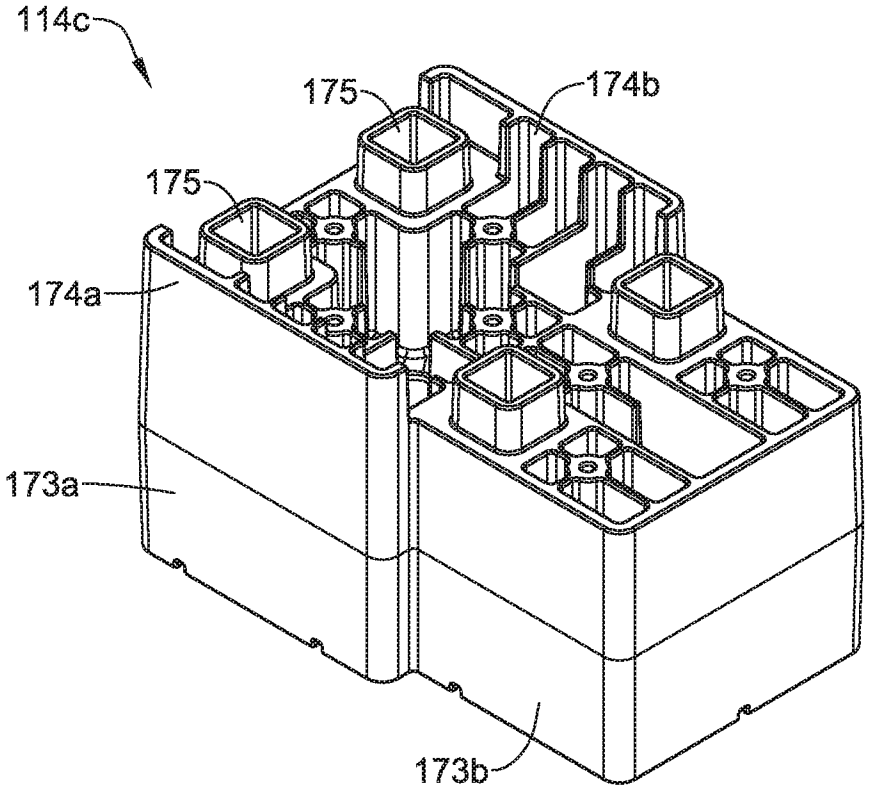
Figure 41:
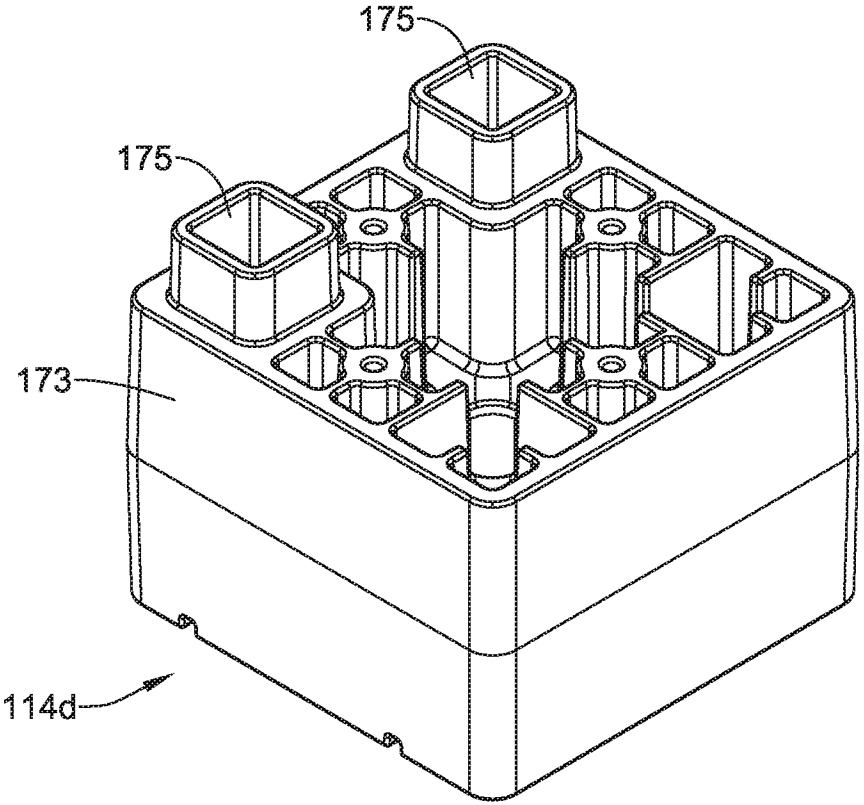

The support blocks 114*a*, 114*b*, 114*c*, and 114*d* of the composite pallet 110 may differ from those of the composite pallet 10. FIGS. 38-41 illustrate the support blocks 114*a*, 114*b*, 114*c*, and 114*d* individually. For example, FIG. 38 illustrates the support block 114*a*. The support block 114*a* may include a base 173, a lip 174, and one or more projections 175. The projections 175 may be utilized to help secure the support block 114*a* relative to other components of the pallet 110, for example by interlocking with a socket or groove along the underside of another board. FIG. 39 illustrates the support block 114*b*. The support block 114*b* may include a base 173, a lip 174, and one or more projections 175. FIG. 40 illustrates the support block 114*c*. The support block 114*c* may include a first base section 173*a*, a second base section 173*b*, a first lip 174*a*, a second lip 174*b*, and one or more projections 175. FIG. 41 illustrates the support block 114*d*. The support block 114*d* may include a base 173 and one or more projections 175.

Figure 42:
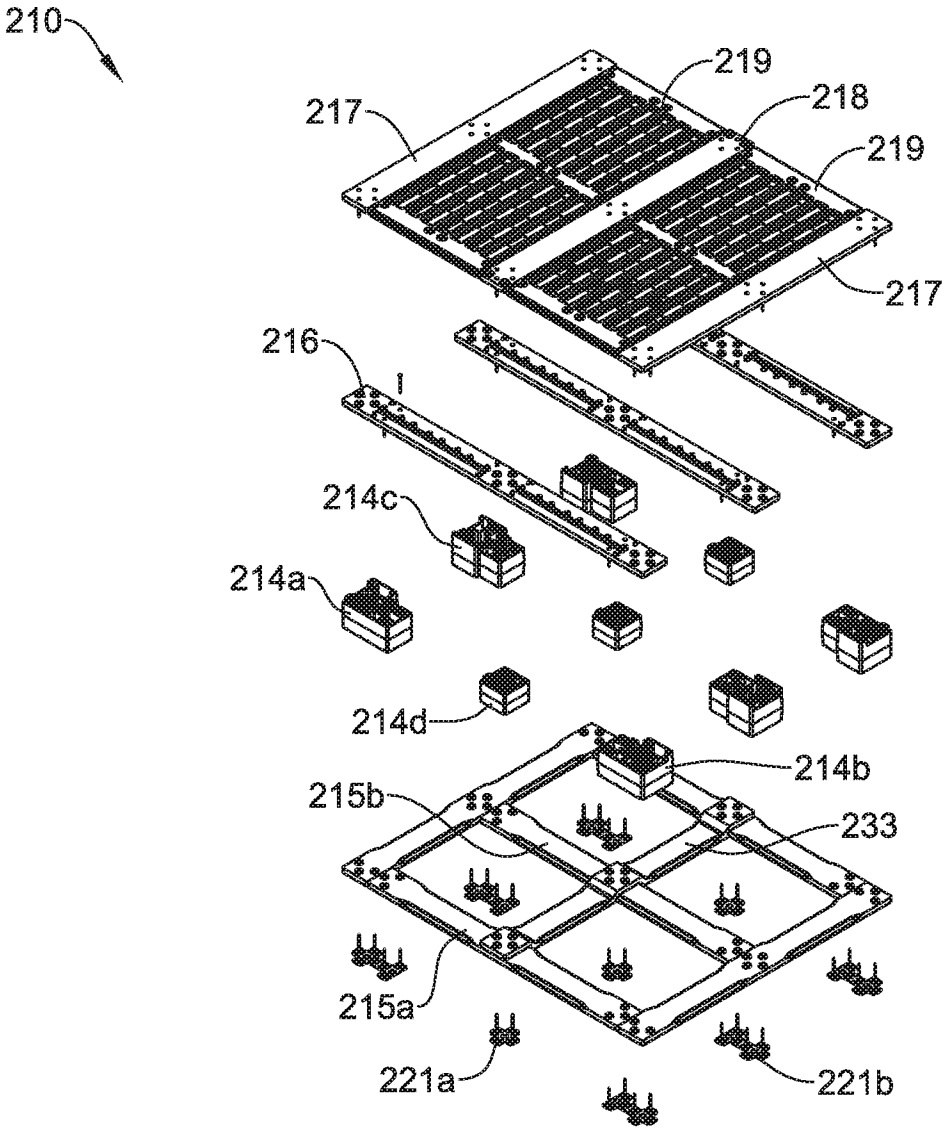
FIG. 42 is an exploded view of an example pallet.

FIG. 42 is an exploded view of another example pallet 210 that may be similar in form and function to other pallets described herein. The pallet 210 may include a plurality of base boards (e.g., including a plurality of peripheral base boards 215*a* and a central base board 215*b*), a plurality of wear pads (e.g., including wear pads 221*a* and wear pads 221*b*) coupled to one or more of the base boards 215*a*, 215*b*, a cross member 233, a plurality of support blocks (e.g., including support blocks 214*a*, 214*b*, 214*c*, and 214*d*), a plurality of intermediate boards 216, a pair of top end boards 217, a top central board 218, and a pair of top panels 219. The various components of the pallet 210 may include a number of structural features similar to other pallets disclosed herein. Thus, disclosure of features of the various components of the pallets 10, 110 may be attributed to similar (e.g., like-named) components of the pallet 210.

Figure 43:
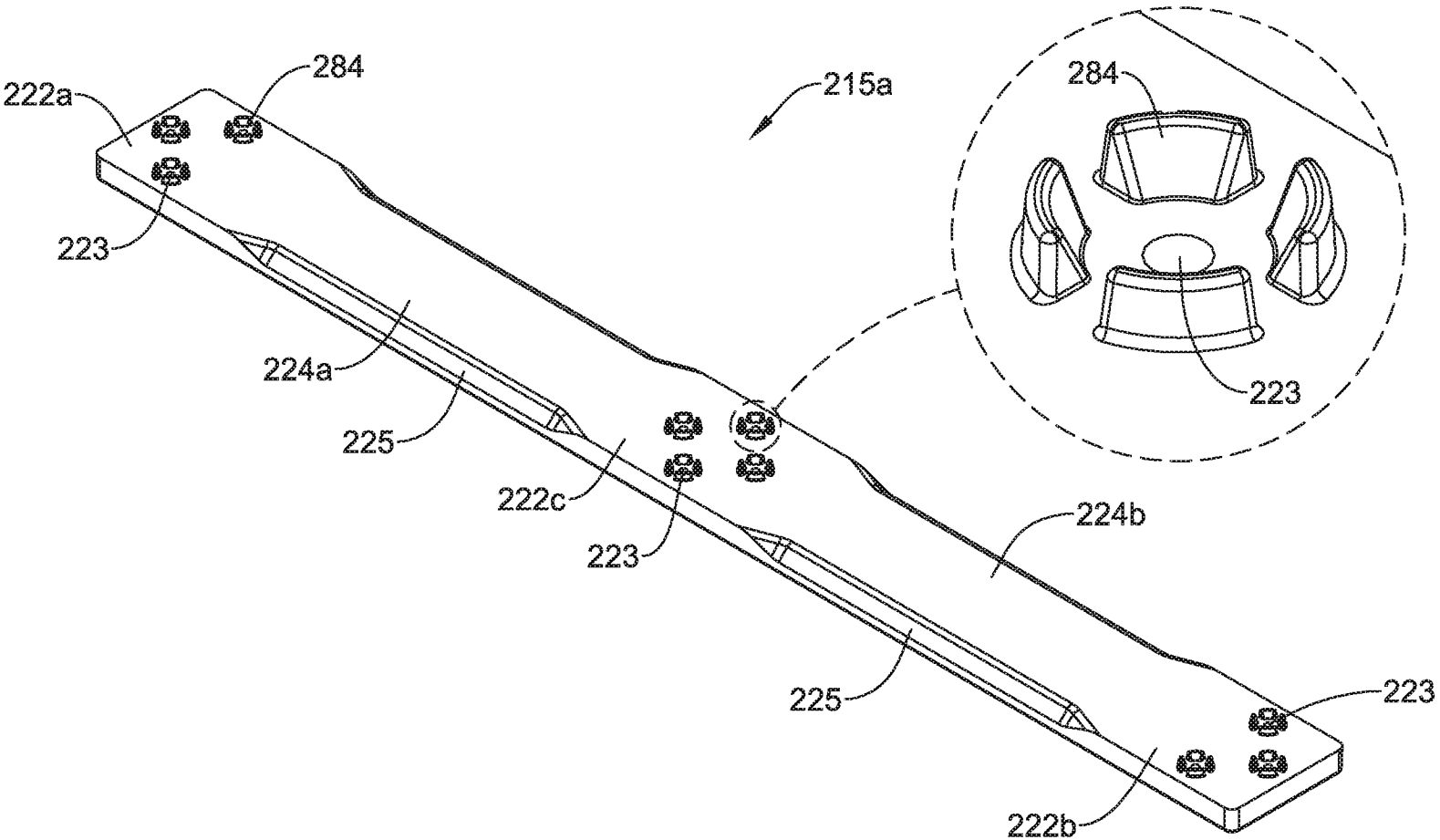
FIG. 43 is a perspective view of an example peripheral base board.

FIG. 43 is a perspective view depicting one of the peripheral base boards 215*a*. Here it can be seen that the base board 215*a* includes a first end region 222*a*, a second end region 222*b*, and a central region 222*c*. A first region 224*a* may extend between the first end region 222*a* and the central region 222*c*. A second region 224*b* may extend between the second end region 222*b* and the central region 222*c*. The first region 224*a*, the second region 224*b*, or both may include one or more ramped surfaces or bevels 225. In this example, the central region 222*c* is free of a bevel 225.

In at least some instances, the first end region 222*a*, the second end region 222*b*, the central region 222*c*, the first region 224*a*, the second region 224*b*, or combinations thereof may include one or more openings or apertures 223. The apertures 223 may be used to secure the base boards 215 to other structures of the pallet 210 using a suitable fastener (e.g., a screw, bolt, nail, or the like). In some instances, the apertures 223 are positioned along the first end region 222*a*, the second end region 222*b*, and the central region 222*c*. In some of these and in other instances, the first region 224*a* and the second region 224*b* are free of apertures 223.

The peripheral base boards 215*a* may include a locating member 284. In some instances, each of the locating members 284 may take the form of one more relatively short projections that are extend around and/or are otherwise disposed about one of the apertures 223. Because the locating members 284 extend about the apertures 223, the locating members 284 may be described as resembling rings (either as a continuously extending, single ring-like projection that extends around the aperture 223 or as a plurality of discrete/discontinuous projections that are arranged in a ring-like pattern about the aperture in the manner depicted in FIG. 43). However, this need not be the case as locating members 284 are contemplated that extend around only a portion of the apertures 290. In at least some instances, at least a portion of the locating members 284 are canted outward so that the locating members 284 may have a funnel-like arrangement. This may aid in securing the peripheral base boards 215*a* to other structures of the pallet 210.

The peripheral base boards 215*a* may include a tension member, a structural member, an impact member, or a combination thereof similar to those disclosed herein.

Figure 44:
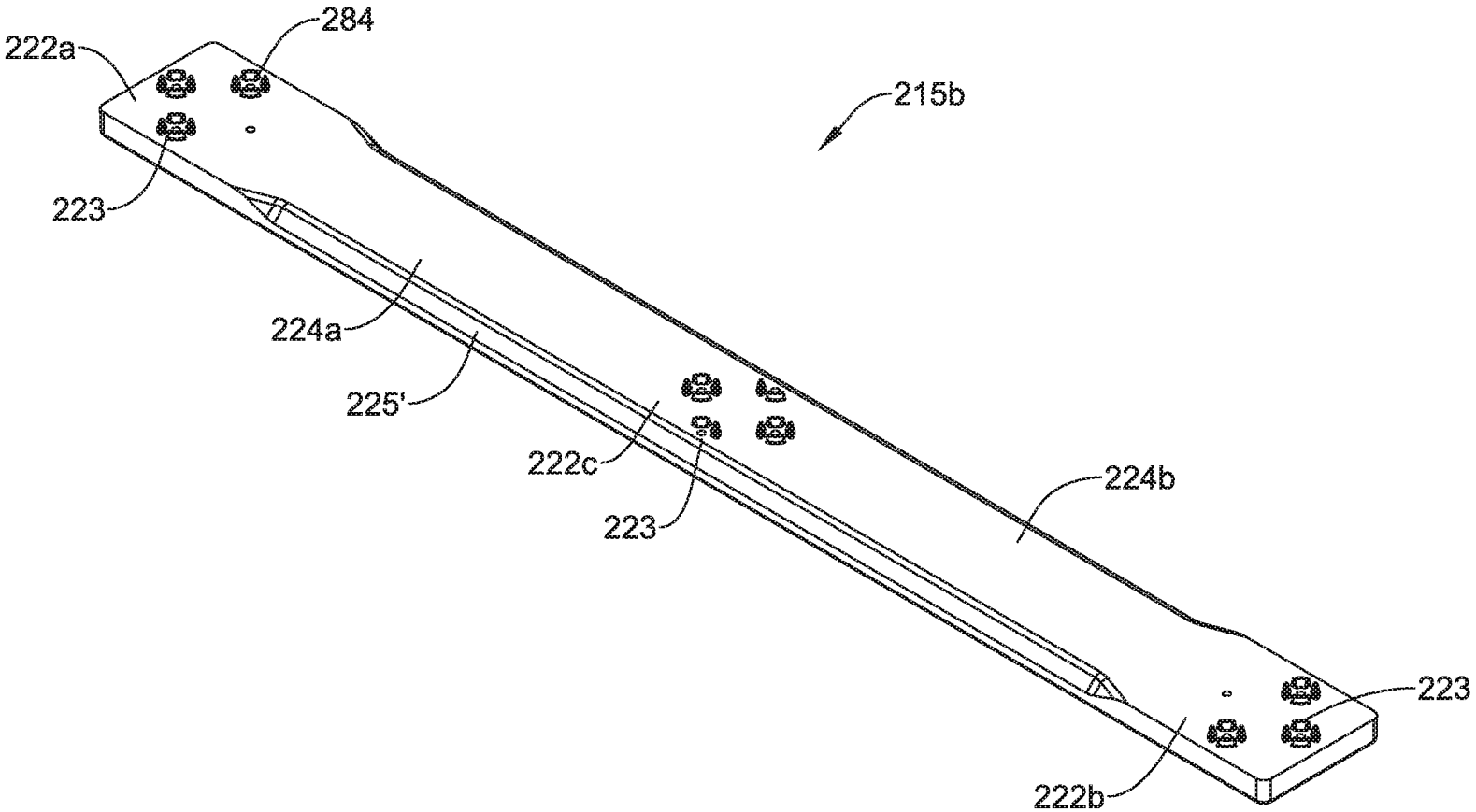
FIG. 44 is a perspective view of an example central base board.

FIG. 44 is a perspective view of the base board 215*b*. Here it can be seen that the base board 215*b* includes a first end region 222*a*, a second end region 222*b*, and a central region 222*c*. A first region 224*a* may extend between the first end region 222*a* and the central region 222*c*. A second region 224*b* may extend between the second end region 222*b* and the central region 222*c*. The first region 224*a*, the second region 224*b*, or both may include one or more ramped surfaces or bevels 225'. In this example, the central region 222*c* includes the bevel 225' such that the bevel 225' extends along the first region 224*a*, across the central region 222*c*, and along the second region 224*b*.

In at least some instances, the first end region 222*a*, the second end region 222*b*, the central region 222*c*, the first region 224*a*, the second region 224*b*, or combinations thereof may include one or more openings or apertures 223. The apertures 223 may be used to secure the base boards 215 to other structures of the pallet 210 using a suitable fastener (e.g., a screw, bolt, nail, or the like). In some instances, the apertures 223 are positioned along the first end region 222*a*, the second end region 222*b*, and the central region 222*c*. In some of these and in other instances, the first region 224*a* and the second region 224*b* are free of apertures 223.

The central base board 215*b* may include a locating member 284. In some instances, each of the locating members 284 may take the form of one more relatively short projections that are extend around and/or are otherwise disposed about one of the apertures 223. Because the locating members 284 extend about the apertures 223, the locating members 284 may be described as resembling rings (either as a continuously extending, single ring-like projection that extends around the aperture 223 or as a plurality of discrete/discontinuous projections that are arranged in a ring-like pattern about the aperture in the manner depicted in FIG. 44). However, this need not be the case as locating members 284 are contemplated that extend around only a portion of the apertures 290 (e.g., such as some of the locating members 284 disposed along the central region 222*c* as shown in FIG. 44). In at least some instances, at least a portion of the locating members 284 are canted outward so that the locating members 284 may have a funnel-like arrangement. This may aid in securing the central base board 215*b* to other structures of the pallet 210.

The central base boards 215*b* may include a tension member, a structural member, an impact member, or a combination thereof similar to those disclosed herein.

Figure 45A:
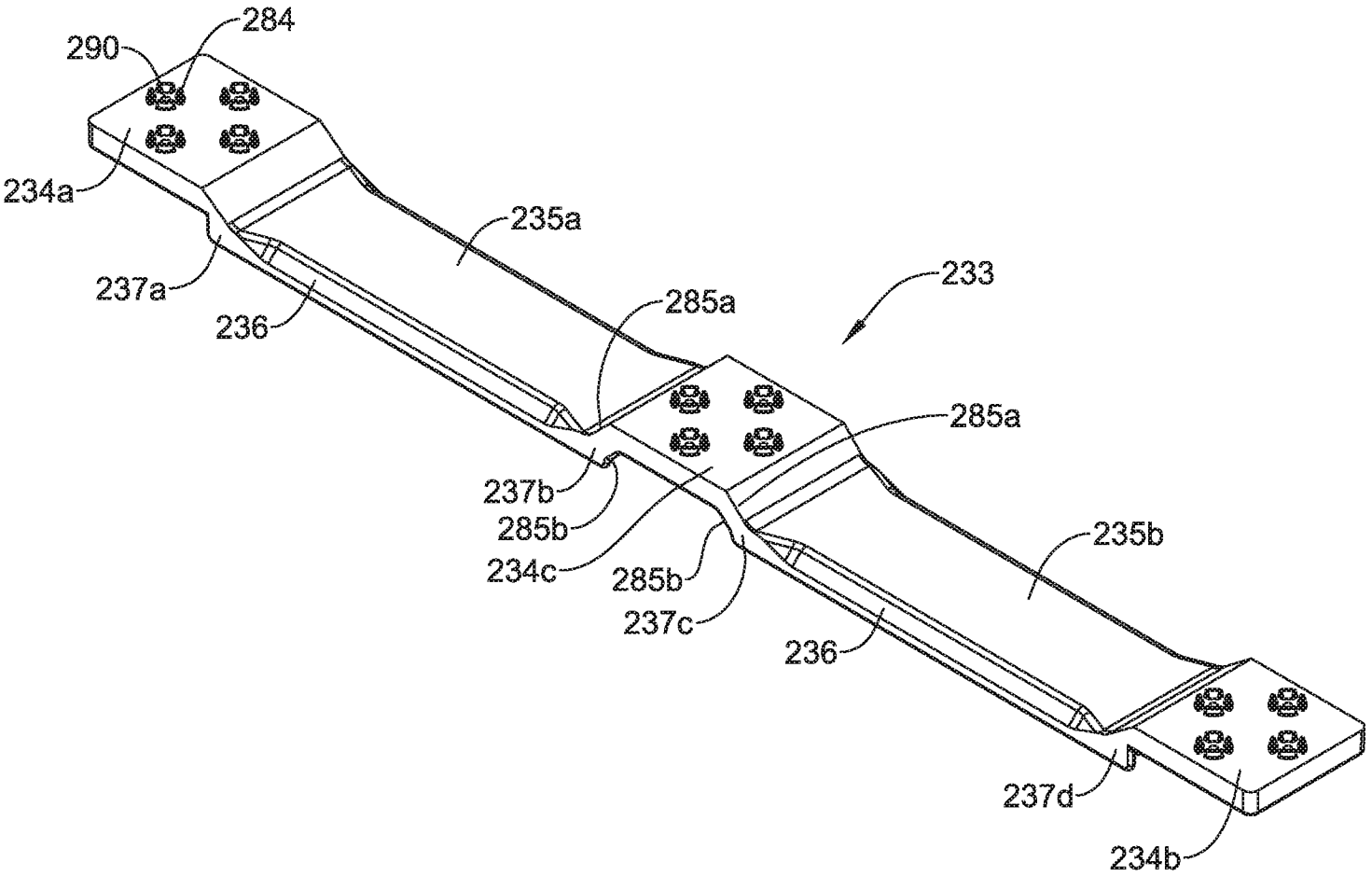
FIGS. 45A-45B are perspective views of an example cross member.
Figure 45B:
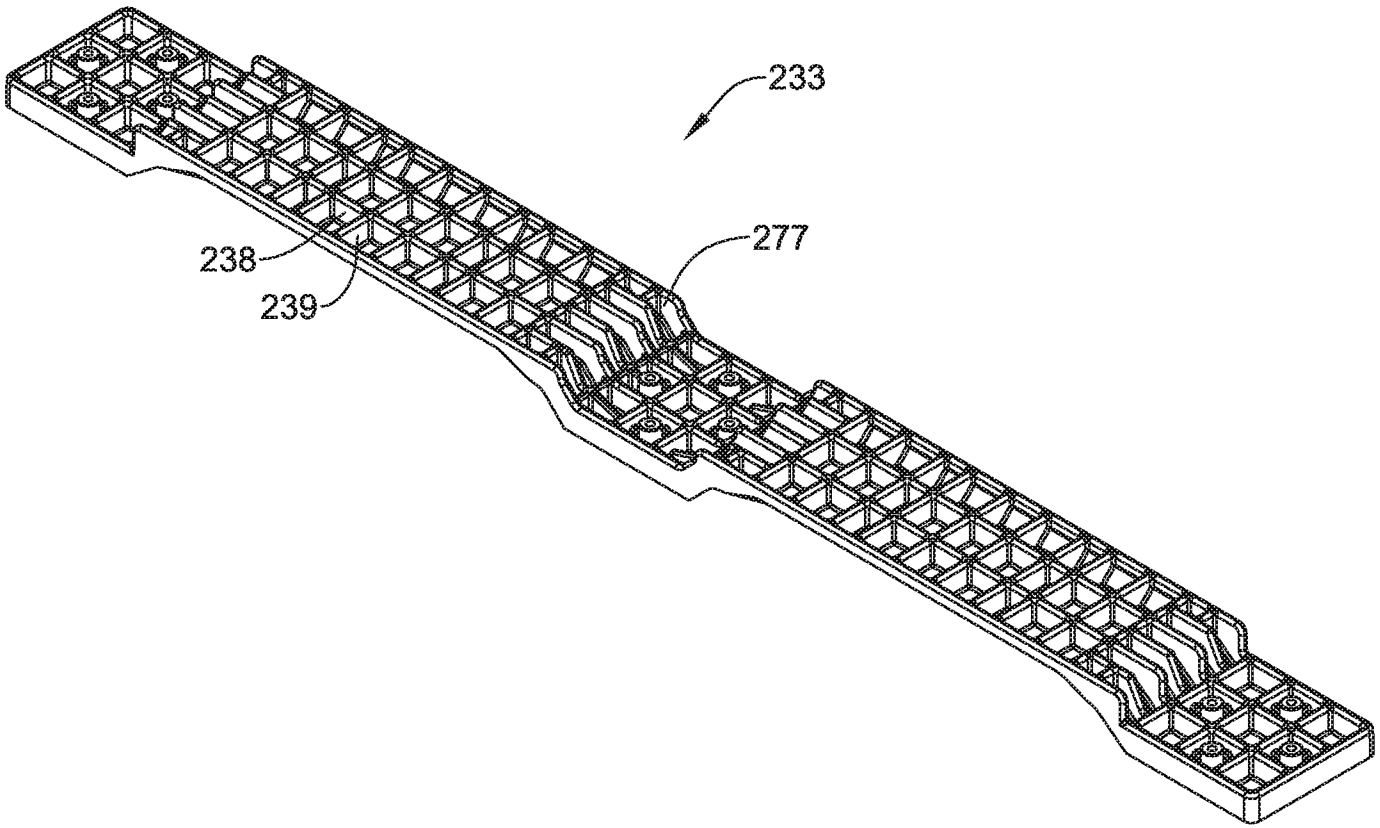

FIGS. 45A-45B are top and bottom perspective views, respectively, of the cross member 233. Here it can be seen that the cross-member 233 may include a first end region 234*a*, a second end region 234*b*, and a central region 234*c*. A first region 235*a* may be disposed between the first end region 234*a* and the central region 234*c*. A second region 235*b* may be disposed between the second end region 234*b* and the central region 234*c*. The first region 235*a*, the second region 235*b*, or both may include one or more ramped surfaces or bevels 236.

The first end region 234*a*, the second end region 234*b*, and the central region 234*c* are substantially coplanar and lie within a first plane. The first region 235*a* and the second region 235*b* may be coplanar and lie within a second plane. In at least some instances, the first plane and the second plane are spaced from one another and, for example, may be substantially parallel with one another. The cross-member 233 may include one or more curved regions that form transitions between the first plane and the second plane. For example, the cross-member 233 may include a first curved region 237*a*, a second curved region 237*b*, a third curved region 237*c*, and a fourth curved region 237*d*. The first curved region 237*a* may be disposed between the first end region 234*a* and the first region 235*a*. The second curved region 237*b* may be disposed between the first region 235*a* and the central region 234*c*. The third curved region 237*c* may be disposed between the central region 234*c* and the second region 235*b*. The fourth curved region 237*d* may be disposed between the second region 235*b* and the second end region 234*b*. The curving of the curved regions 237*a*, 237*b*, 237*c*, and 237*d* may have a suitable radius of curvature. The radius of curvature may be constant or may vary along each of the curved regions 237*a*, 237*b*, 237*c*, and 237*d* (and/or may vary amongst different curved regions 237*a*, 237*b*, 237*c*, and 237*d*).

One or more of the curved regions 237*a*, 237*b*, 237*c*, and 237*d* may include opposing surfaces designed to maintain the thickness of the cross-member 233. For example, the curved region 237*b* may include opposing surfaces 285*a*, 285*b* that are angled so as to maintain the thickness of the curved region 237*b* as it transitions from the first region 235*a* to the central region 234*c*. In some instances, the curved region 237*c* (and/or other curved regions) may also include similar opposing surfaces 285*a*, 285*b*.

In at least some instances, the cross-member 233 may also include apertures 290 and/or locating members 284. These features may resemble the similarly-named features of other structures/boards disclosed herein.

As shown in FIG. 45B, the cross-member 233 may include a number of longitudinal ribs 238. The longitudinal ribs 238 may provide structural support to the cross-member 233. A suitable number of longitudinal ribs 238 may be disposed along the cross-member 233. For example, the cross-member 233 may include one, two, three, four, five, six, seven, eight, or more longitudinal ribs 38. The longitudinal ribs 238 may be equally spaced from one another. Alternatively, the distance between one or more of the longitudinal ribs 238 may vary along the cross-member 233. In some instances, all of the longitudinal ribs 238 extend along the full length of the cross-member 233. In other instances, one or more of the longitudinal ribs 238 extend along only a portion of the length of the cross-member 233. The height (e.g., which may be understood as the distance from the bottom surface of the cross-member 233 to the bottom surface of the longitudinal ribs 238) of the longitudinal ribs 238 may be substantially constant along the length of the longitudinal ribs 238 or may vary. For example, longitudinal ribs 238 are contemplated where the height varies in a wave-like pattern. In general, the longitudinal ribs 238 extend along a path that is aligned with or parallel to the longitudinal axis of the cross-member 233. However, even though the longitudinal ribs 238 are named "longitudinal", this is not intended to limit the longitudinal ribs 238 to being only oriented in a straight line along the longitudinal axis of the cross-member 233. Longitudinal ribs 238 are contemplated that extend diagonally, include curves or bends, or otherwise extend in directions other than just along the longitudinal axis.

In at least some instances, the longitudinal ribs 238 may be arranged in a relatively dense pattern. For example, the space between adjacent longitudinal ribs 238 may be about 0.25-2 inches, or about 0.5-1.5 inches, or about 1 inch. By having the longitudinal ribs 238 arranged in a relatively dense pattern, the longitudinal ribs 238 can provide a greater amount of structural support to the cross-member 233. In some instances, all of the longitudinal ribs 238 may have the same thickness or width. In other instances, one or more of the longitudinal ribs 238 may have a different (e.g., increased) width or thickness. For example, the longitudinal ribs 238 nearest the periphery of the cross-member 233 may have an increased width or thickness relative to other longitudinal ribs 238. The same may be true of other components of the pallet 210 and/or the components of other pallets disclosed herein.

The cross-member 233 may include a number of transverse ribs 239. A suitable number of transverse ribs 239 may be disposed along the cross-member 233. For example, the cross-member 233 may include 1-100, or more, transverse ribs 239. The transverse ribs 239 may be equally spaced from one another. Alternatively, the distance between two or more of the transverse ribs 239 may vary along the cross-member 233. In some instances, all of the transverse ribs 239 extend along the full width of the cross-member 233. In other instances, one or more of the transverse ribs 239 extend along only a portion of the width of the cross-member 233. Indeed, a single transverse rib 239 may be considered to be a structure that extends between two adjacent longitudinal ribs 238. The height (e.g., which may be understood as the distance from the bottom surface of the cross-member 233 to the bottom surface of the transverse ribs 239) of the transverse ribs 239 may be substantially constant along the length of the transverse ribs 239 or may vary. For example, transverse ribs 239 are contemplated where the height varies in a wave-like pattern. In general, the transverse ribs 239 extend along a path that is transverse or perpendicular to the longitudinal axis of the cross-member 233. However, even though the transverse ribs 239 are named "transverse", this is not intended to limit the transverse ribs 239 to being only oriented in a straight line transverse to the longitudinal axis of the cross-member 233. Transverse ribs 239 are contemplated that extend diagonally, include curves or bends, or otherwise extend in directions other than just transverse to the longitudinal axis. In some instances, the intersections of the longitudinal ribs 38 and the transverse ribs 239 may define sockets or compartments into which other structures of the pallet 210 may extend. This may help to secure or interlock various structures of the pallet 210. In some instances, the cross-member 233 may include one or more gussets 277.

The cross-member 233 may include a tension member, a structural member, an impact member, or a combination thereof similar to those disclosed herein.

Figure 46A:
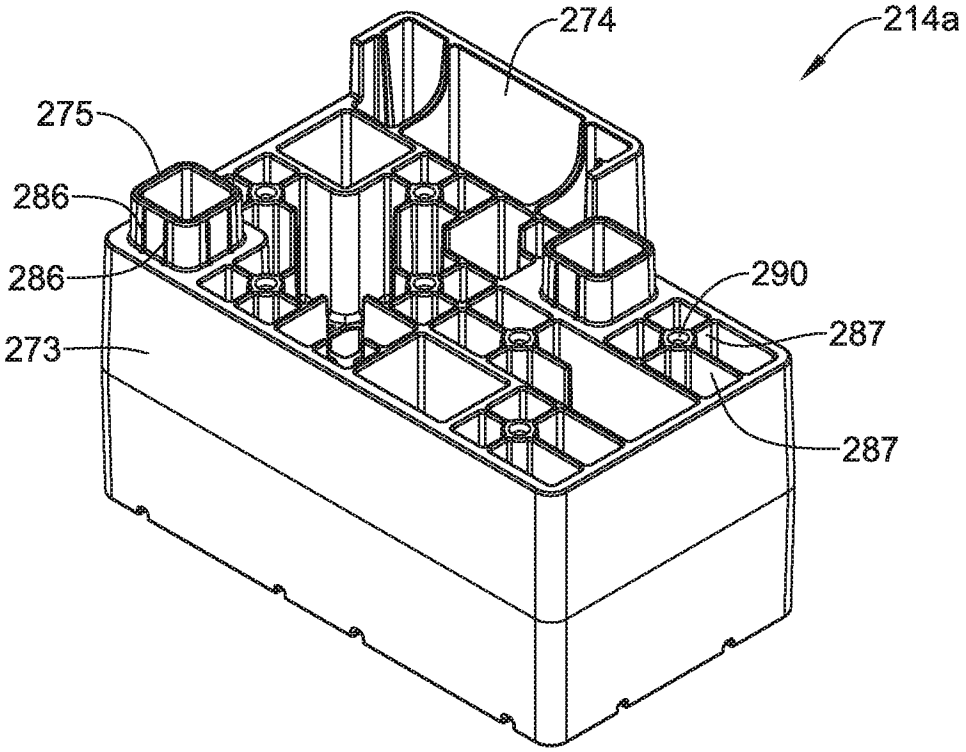
FIGS. 46A-46B are perspective views of an example support member.
Figure 46B:
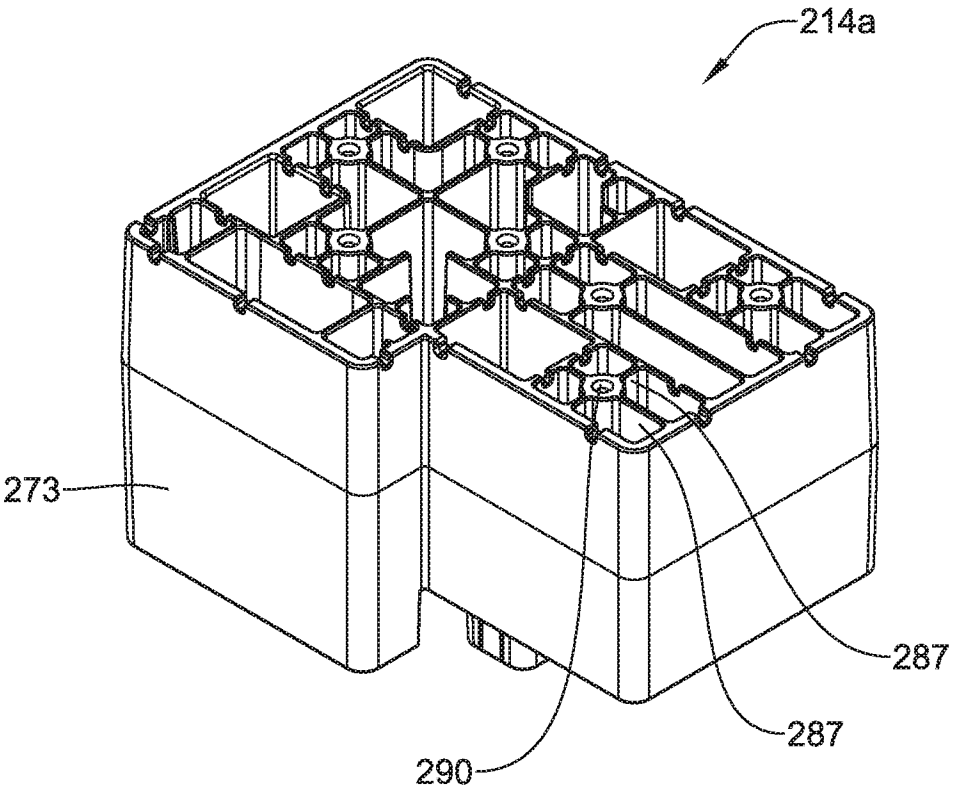

FIGS. 46A-46B are top and bottom perspective views, respectively, of the support block 214*a*. The support block 214*a* may include a base 273, a lip 274, and one or more projections 275. The projections 275 may be utilized to help secure the support block 214*a* relative to other components of the pallet 210, for example by interlocking with a socket or groove along the underside of another board. In at least some instances, the projections 275 may include one or more crush ridges 286. The crush ridges 286, which may be capable of collapsing when another structure is fitted over the projection 275, may be designed to further aid by interlocking with a socket or groove along the underside of another board. The support block 214*a* may also include a plurality of apertures 290, for example that may be designed to be used with a suitable fastener in order to secure the support block 214*a* with one or more other components of the pallet 210. In some instances, the support block 214*a* may include one or more support ribs 287 designed to help provide structural support for the apertures 290. The support block 214*a* may include one or more additional ribs.

Figure 47A:
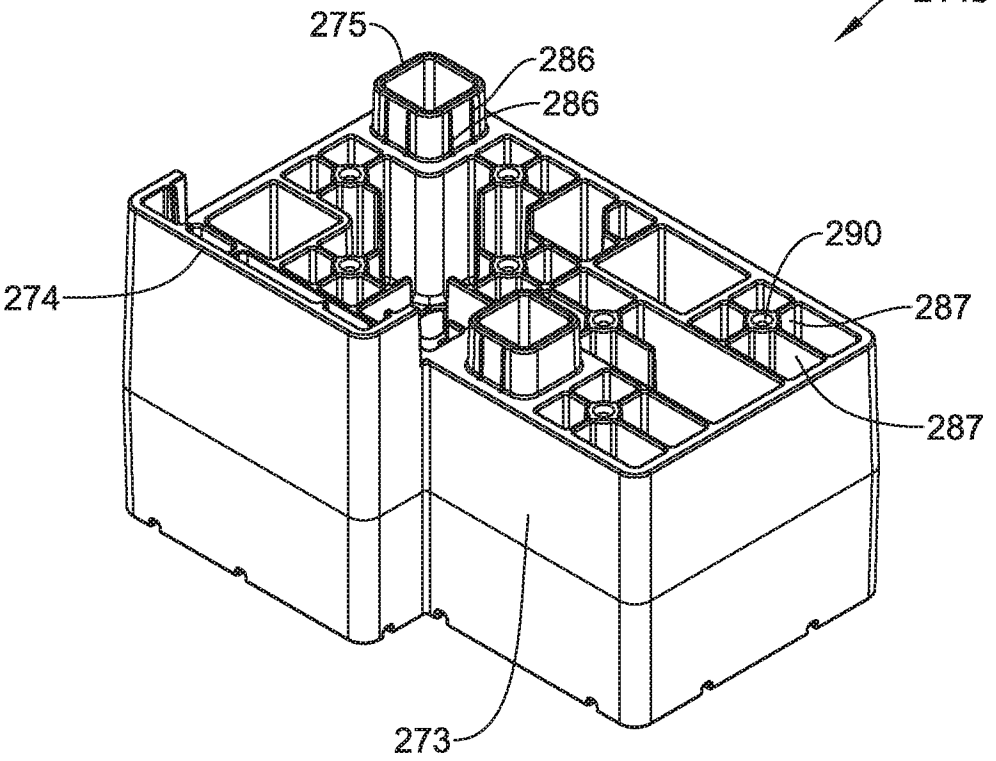
FIGS. 47A-47B are perspective views of an example support member.
Figure 47B:
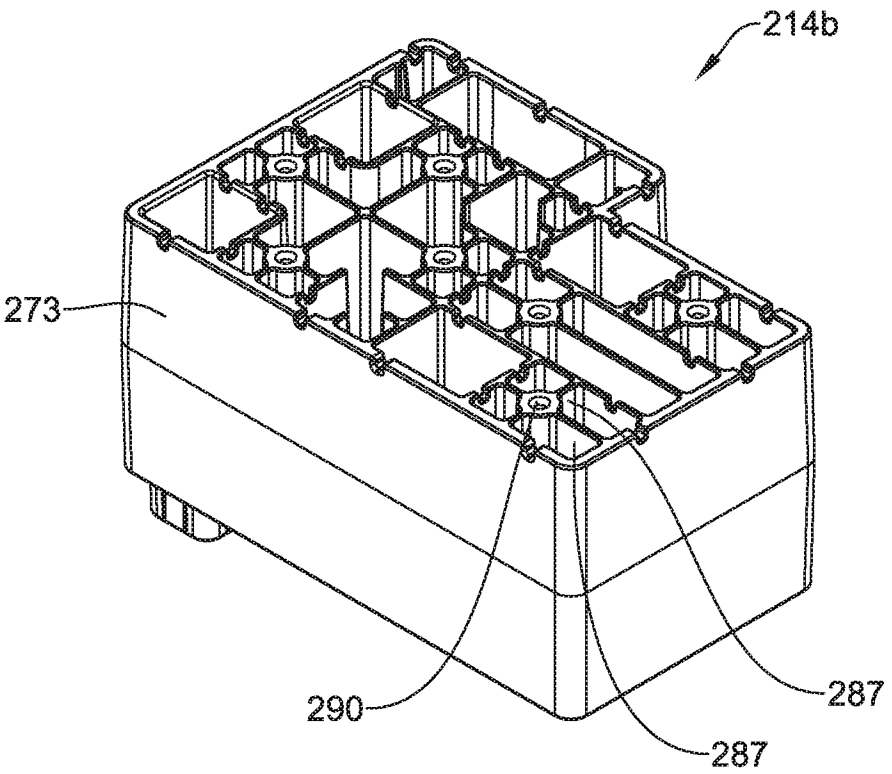

FIGS. 47A-47B are top and bottom perspective views, respectively, of the support block 214*b*. The support block 214*a* may include a base 273, a lip 274, and one or more projections 275. The projections 275 may be utilized to help secure the support block 214*b* relative to other components of the pallet 210, for example by interlocking with a socket or groove along the underside of another board. In at least some instances, the projections 275 may include one or more crush ridges 286. The crush ridges 286, which may be capable of collapsing when another structure is fitted over the projection 275, may be designed to further aid by interlocking with a socket or groove along the underside of another board. The support block 214*b* may also include a plurality of apertures 290, for example that may be designed to be used with a suitable fastener in order to secure the support block 214*b* with one or more other components of the pallet 210. In some instances, the support block 214*b* may include one or more support ribs 287 designed to help provide structural support for the apertures 290. The support block 214*b* may include one or more additional ribs.

Figure 48A:
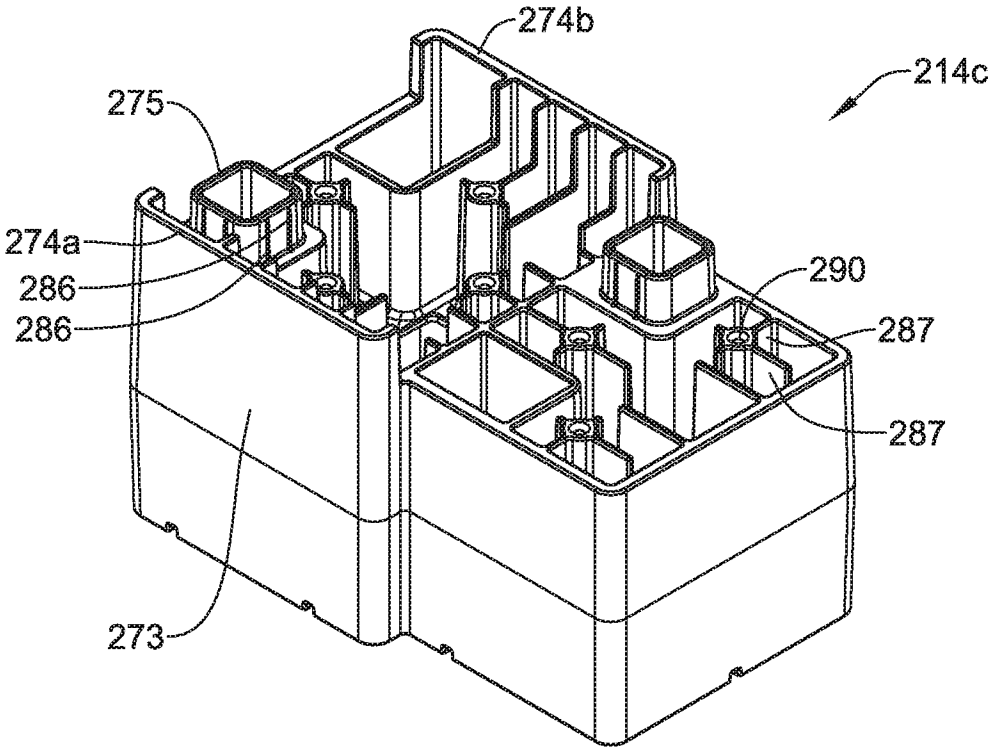
FIGS. 48A-48B are perspective views of an example support member.
Figure 48B:
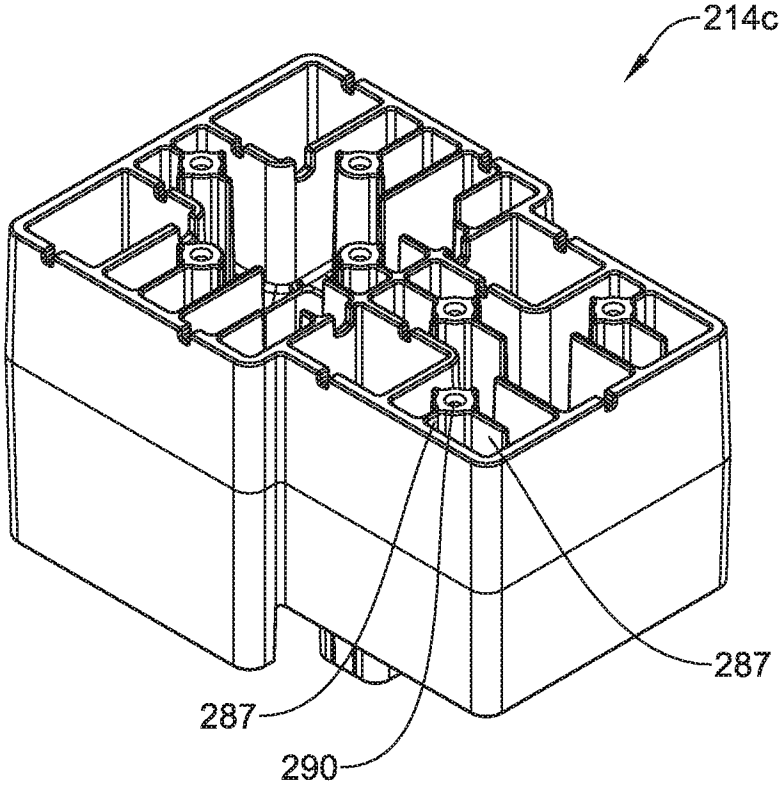

FIGS. 48A-48B are top and bottom perspective views, respectively, of the support block 214*c*. The support block 214*c* may include a base 273, a first lip 274*a*, and a second lip 274*b*, and one or more projections 275. The projections 275 may be utilized to help secure the support block 214*c* relative to other components of the pallet 210, for example by interlocking with a socket or groove along the underside of another board. In at least some instances, the projections 275 may include one or more crush ridges 286. The crush ridges 286, which may be capable of collapsing when another structure is fitted over the projection 275, may be designed to further aid by interlocking with a socket or groove along the underside of another board. The support block 214*c* may also include a plurality of apertures 290, for example that may be designed to be used with a suitable fastener in order to secure the support block 214*c* with one or more other components of the pallet 210. In some instances, the support block 214*c* may include one or more support ribs 287 designed to help provide structural support for the apertures 290. The support block 214*c* may include one or more additional ribs.

Figure 49A:
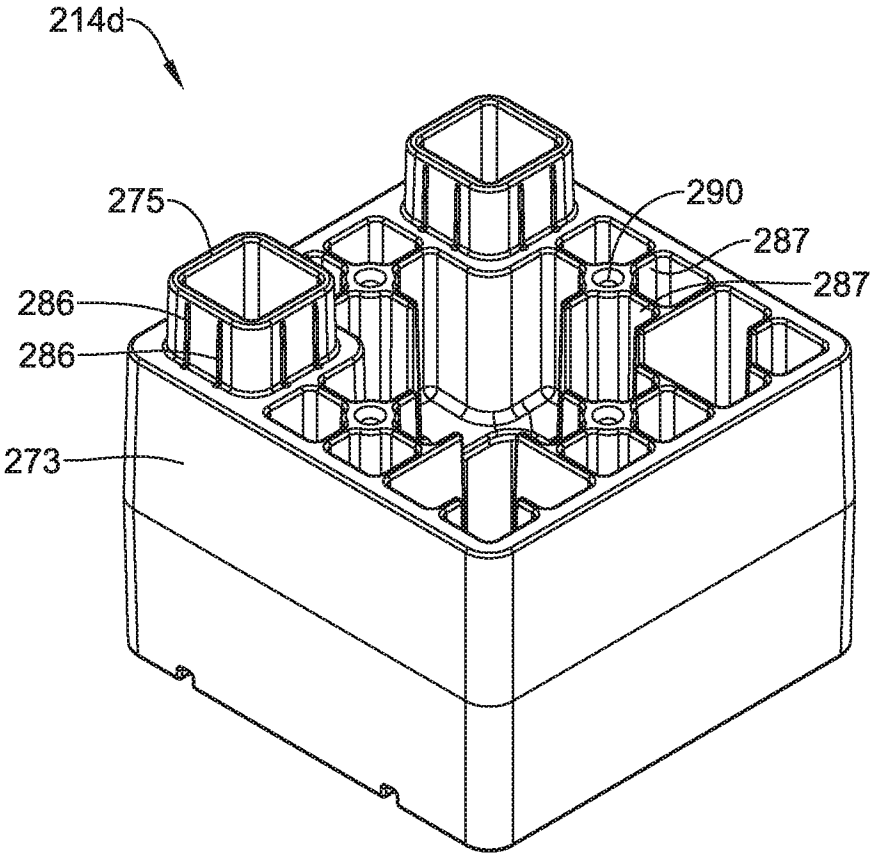
FIGS. 49A-49B are perspective views of an example support member.
Figure 49B:
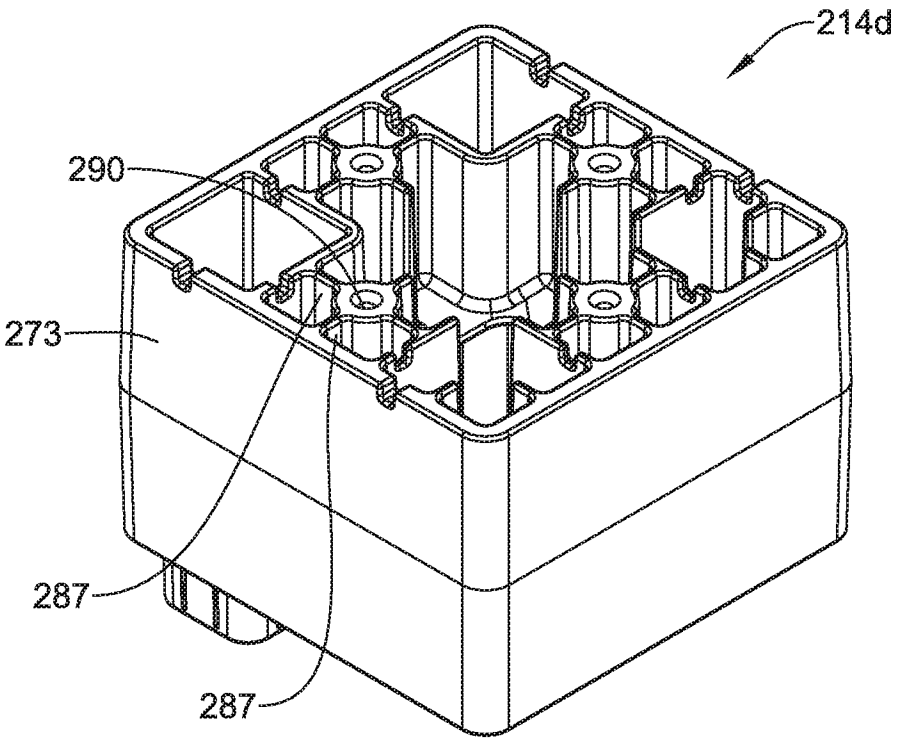

FIGS. 49A-49B are top and bottom perspective views, respectively, of the support block 214*d*. The support block 214*d* may include a base 273 and one or more projections 275. The projections 275 may be utilized to help secure the support block 214*d* relative to other components of the pallet 210, for example by interlocking with a socket or groove along the underside of another board. In at least some instances, the projections 275 may include one or more crush ridges 286. The crush ridges 286, which may be capable of collapsing when another structure is fitted over the projection 275, may be designed to further aid by interlocking with a socket or groove along the underside of another board. The support block 214*c* may also include a plurality of apertures 290, for example that may be designed to be used with a suitable fastener in order to secure the support block 214*d* with one or more other components of the pallet 210. In some instances, the support block 214*d* may include one or more support ribs 287 designed to help provide structural support for the apertures 290. The support block 214*d* may include one or more additional ribs.

In general, the support blocks 214*a*, 214*b*, 214*c*, and 214*d* may be similar to other support blocks disclosed herein. In some instances, one or more of the support blocks 214*a*, 214*b*, 214*c*, and 214*d* may be formed from a suitable material such as high density polyethylene, nylon, other materials including those disclosed herein, or the like. In the examples shown in FIGS. 46A/B-49A/B, the general dimensions, thickness, and overall configurations of the support blocks 214*a*, 214*b*, 214*c*, and 214*d* are designed to provide a desirable balance of strength, durability, and weight. For example, the support blocks 214*a*, 214*b*, 214*c*, and 214*d* may be formed from a nylon material that is desirable strong and durable. Because the nylon resin used to form the support blocks 214*a*, 214*b*, 214*c*, and 214*d* may be generally heavier than some other materials (e.g., such as high density polyethylene), the support blocks 214*a*, 214*b*, 214*c*, and 214*d* may have fewer projections 275 that other support blocks disclosed herein and/or the ribs 287 may be slightly thinned relative to other support blocks disclosed herein. This may include thinning the ribs 287 relative to the base 273 of the support blocks 214*a*, 214*b*, 214*c*, and 214*d*. For example, portions of the base 273 forming a wall along the exterior/periphery of the support blocks 214*a*, 214*b*, 214*c*, and 214*d* may be thicker than the longitudinal ribs 287 disposed along the interior of the support blocks 214*a*, 214*b*, 214*c*, and 214*d*. These are just examples. A number of additional configurations are contemplated.

Figure 50:
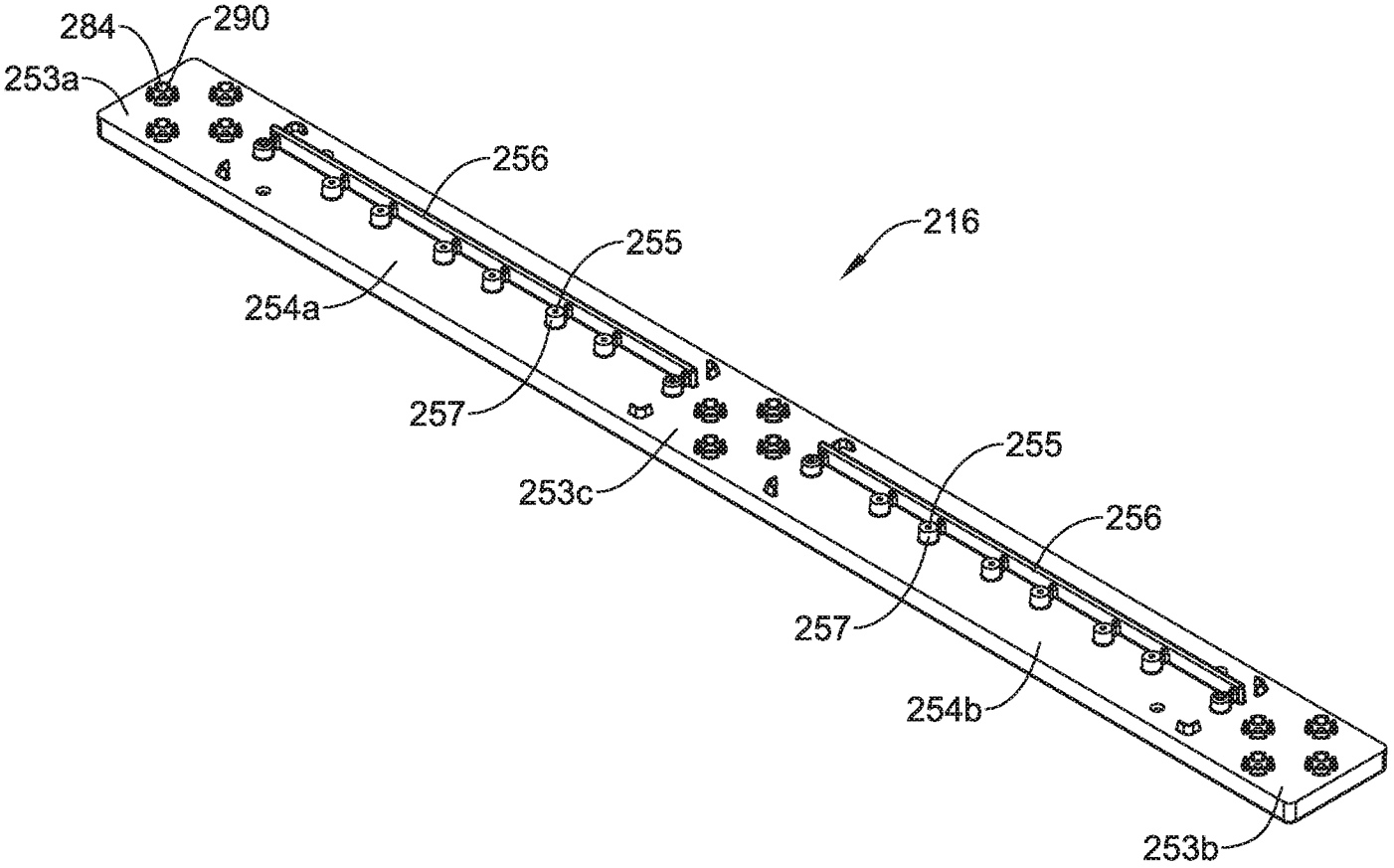
FIG. 50 is a perspective view of an example intermediate board.

FIG. 50 is a perspective view of the intermediate board 216. The intermediate board 216 may include a first end region 253*a*, a second end region 253*b*, and a central region 253*c*. A first section 254*a* may be disposed between the first end region 253*a* and the central region 253*c*. A second section 254*b* may be disposed between the second end region 253*b* and the central region 253*c*. The first section 254*a*, the second section 254*b*, or both may include one or more top surface ribs 256. In this example, each of the first section 254*a* and the second section 254*b* include a single top surface rib 256. Other arrangements are contemplated. The top surface rib 256 may provide additional structural support, aid in assembly, and/or the like. One or more bosses 257 may be disposed along the first section 254*a*, the second section 254*b*, or both. At least some of the bosses 257 may have apertures 255 formed therein. The apertures 255 may be designed to be used with a suitable fastener (e.g., a screw, nail, bolt, or the like) to secure the intermediate board 216 to other structures of the pallet 210. The bosses 257 may be designed to interlock with another structure such as a top board 217 disposed thereon.

In at least some instances, the intermediate board 216 may also include apertures 290 and/or locating members 284. These features may resemble the similarly-named features of other structures/boards disclosed herein.

The intermediate board 216 may include a tension member, a structural member, an impact member, or a combination thereof similar to those disclosed herein.

In some instances, the intermediate board 216 having the single top surface rib 256 may be utilized in other pallets disclosed herein. When doing so, the intermediate board 216 may be arranged so that the rib 256 is disposed closer to an outer periphery of the pallet. Similarly, other intermediate boards disclosed herein (e.g., including intermediate board 16 having a pair of top surface ribs 56) may be utilized for the pallet 210.

Figure 51:
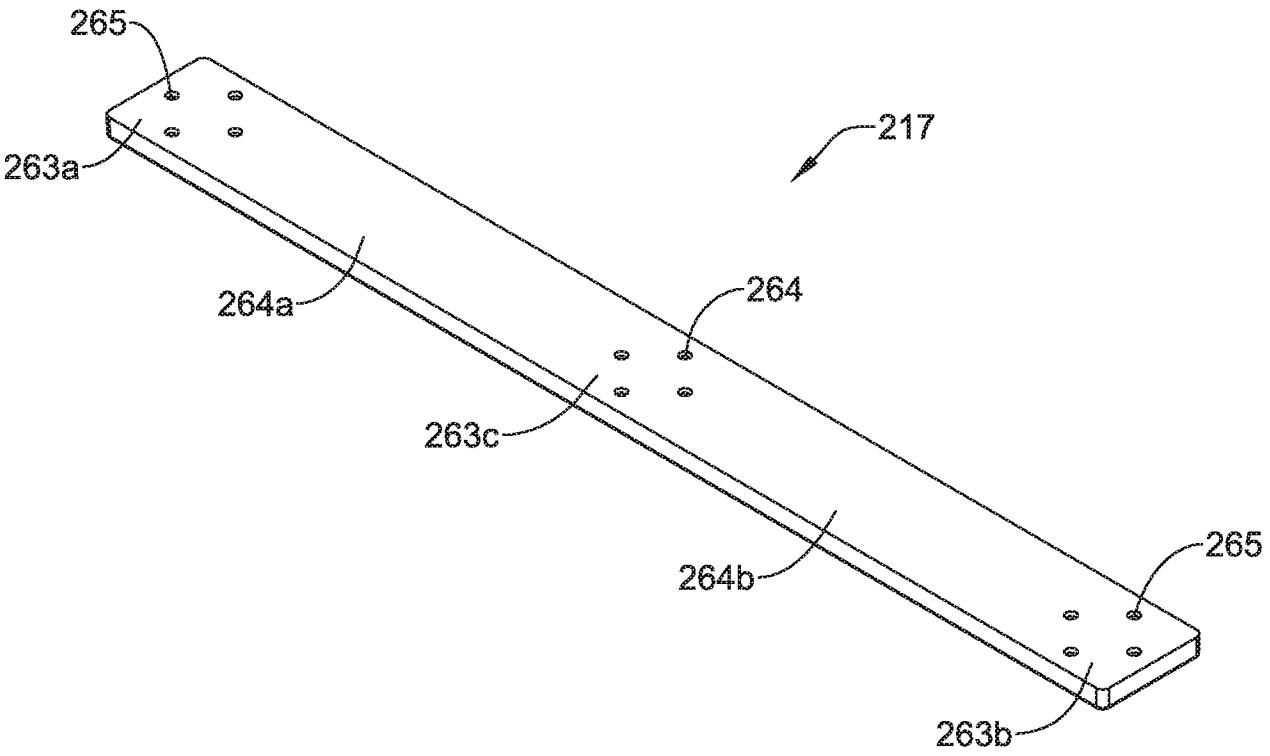
FIG. 51 is a perspective view of an example top end board.

FIG. 51 is a perspective view of one of the top end boards 217. The top end board 217 may include a first end region 263*a*, a second end region 263*b*, and a central region 263*c*. A first section 264*a* may be disposed between the first end region 263*a* and the central region 263*c*. A second section 264*b* may be disposed between the second end region 263*b* and the central region 263*c*. A plurality of apertures 265 may be disposed along the top end board 217.

Figure 52:
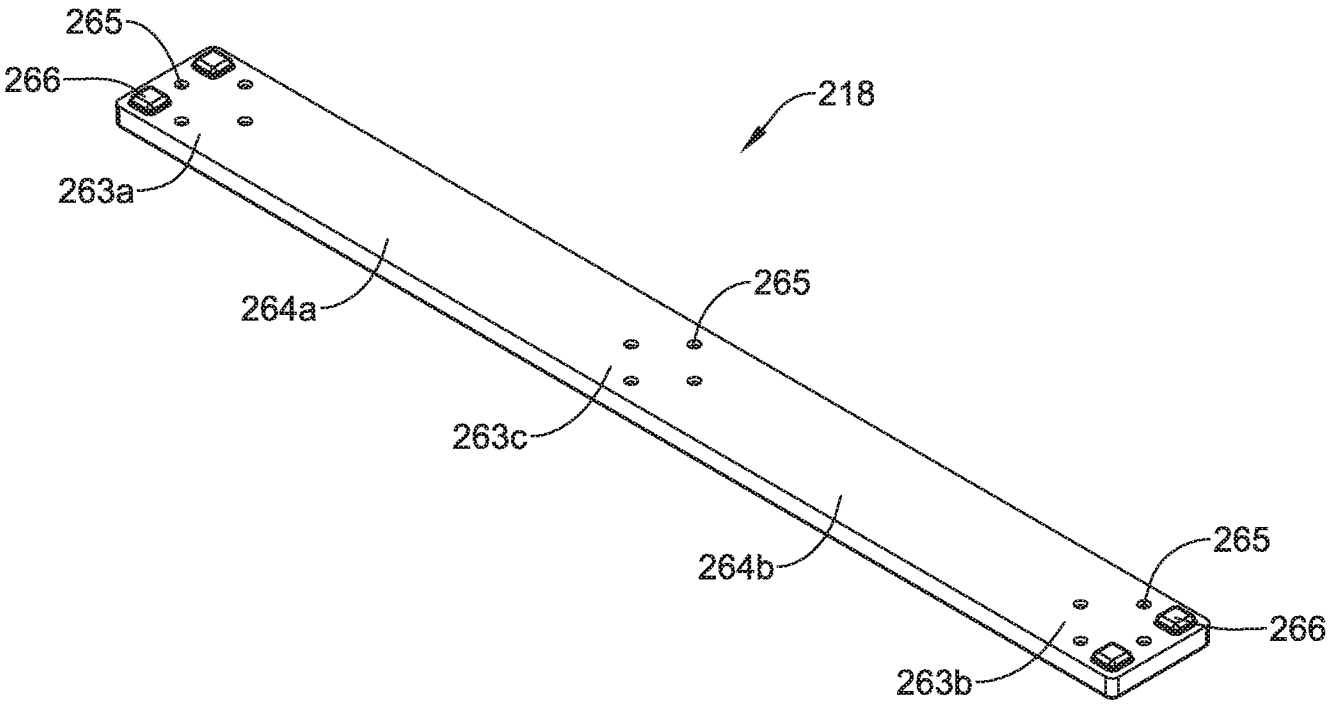
FIG. 52 is a perspective view of an example top central board.

FIG. 52 is a perspective view of the top central board 218. The top central board 218 may include a first end region 263*a*, a second end region 263*b*, and a central region 263*c*. A first section 264*a* may be disposed between the first end region 263*a* and the central region 263*c*. A second section 264*b* may be disposed between the second end region 263*b* and the central region 263*c*. A plurality of apertures 265 may be disposed along the top end board 218.

In at least some instances, the top central board 218 may include one or more projections 266. The projections 266 may be attached to the top central board 218 or may be integral parts of the top central board 218. The projections 266 may serve as stops or structural features that allow goods placed on the pallet 210 to engage so that the good can be substantially prevented from sliding off of the pallet 210. In addition, the projections 266 may aid in stacking a plurality of pallets 210 upon one another. For example, the projections 266 may interlock with grooves or sockets formed along the bottom surface of a base board of an adjacent pallet 210. In some instances, the projections 266 are disposed along the first end region 263*a*, the second end region 263*b*, or both. However, this is not intended to be limiting. The projections 266 may be disposed along any suitable portion of the top central board 218 such as along the central region 263*c*, the first section 264*a*, the second section 264*b*, and/or combinations thereof. In some instances, the top end boards 217 may also include projections 266 (not shown). In other instances, the top end boards 217 are free of projections 266.

The top central board 218 and/or the top end boards 217 may include a tension member, a structural member, an impact member, or a combination thereof similar to those disclosed herein.

Figure 53:
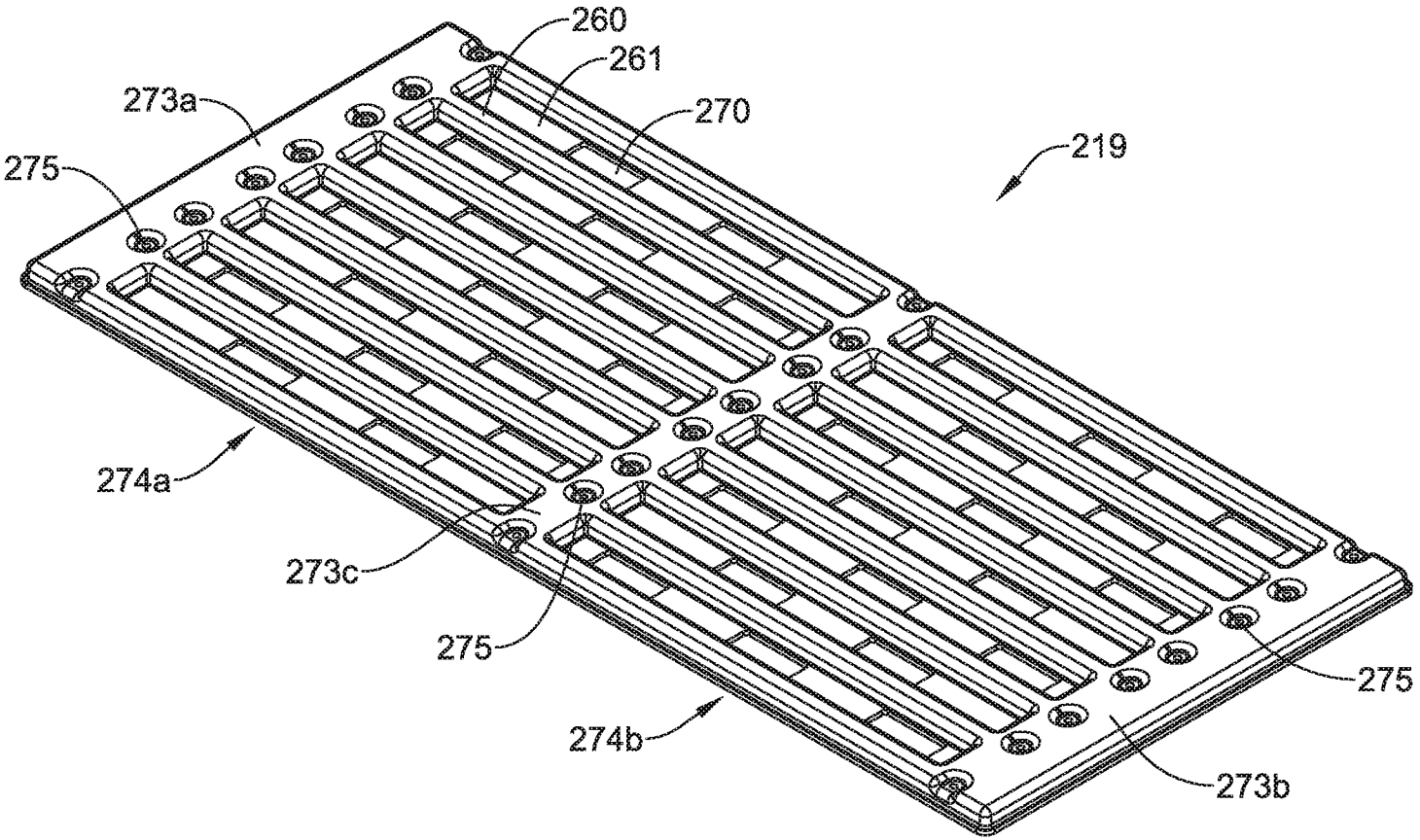
FIG. 53 is a perspective view of an example top panel.

FIG. 53 is a perspective view of the top panels 219. The panels 219 may have a first end region 273*a*, a second end region 273*b*, and a central region 273*c*. A first section 274*a* may be disposed between the first end region 273*a* and the central region 273*c*. A second section 274*b* may be disposed between the second end region 273*b* and the central region 273*c*. The panel 219 may include a plurality of depressions or dimples 275. The dimples 275 may be used to secure the panel 219 to other components of the pallet 210 (e.g., via a screw, bolt, nail, or the like). For example, the dimples 275 may be designed to fit over, fit between, interlock with, and/or otherwise engage with the bosses 257 of the intermediate board 216. The dimples 275 may have apertures formed therein (e.g., openings that a fastener may pass through). The first section 274*a* and the second section 274*b* may be arranged as a plurality of ribs or projections 260 with recessed regions 261 between the ribs 260. The recessed regions 261 may include a plurality of openings 270. The openings 270 may be arranged in a pattern. For example, one of the recessed regions 261 may end in an opening 270 adjacent to a first end region 273*a* and at the opposite end of the recessed region 261, an opening 270 may be spaced from the second end region 273*b*. The arrangement may vary among the recessed regions 261. Such an offset pattern of the openings 270 may allow a number of pallets 210 to be stacked upon one another in a way so that there is not a direct fluid pathway through a stacked group of pallets 210. Instead, water (e.g., which may come from a sprinkler) may cascade through a stack of pallets 210, which may improve the fire rating of the pallets 210.

Figure 54:
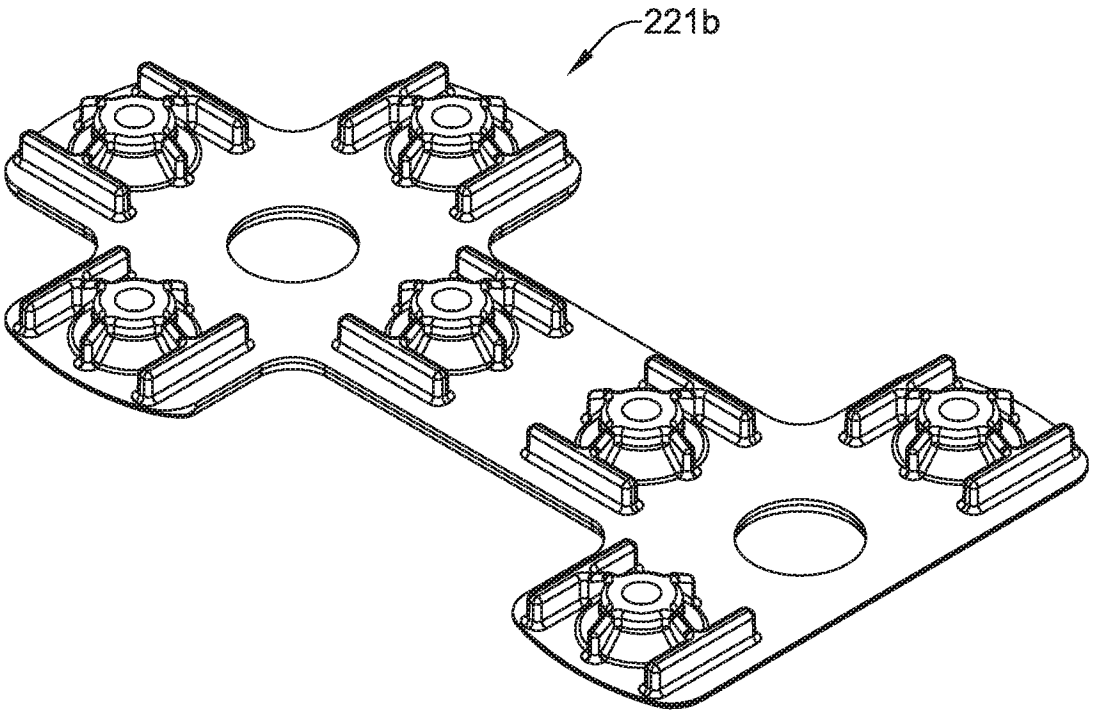
FIG. 54 is a perspective view of an example wear pad.

As indicated above, the pallet 210 may include one or more wear pads including wear pads 221*a* (which may be similar in form and function to the wear pads 21) and wear pads 221*b*. FIG. 54 illustrates an example wear pad 221*b*, which may be described as a long or large wear pad 221*b*. Wear pads 221*b* are generally designed to be attached to one or more of the base boards 215*a*, 215*b* and the wear pads 221*b* may function as structures that allow the pallet 210 to be more easily moved, allow the pallet 210 to be less easily moved or otherwise resist motion, and/or allow the pallet 210 to have enhanced durability. For example, the wear pads 221*b* may include a friction-reducing surface or coating that provides a level of slipperiness that allows the pallet 110 to be more easily moved across a surface. The friction-reducing may take the form of a lubricous coating. Alternatively, the wear pads 221*b* may include a friction-increasing surface or coating that helps to reduce the pallet 210 moving or slipping across a surface. The friction-increasing surface may take the form of a tacky or sticky surface coating, a texturing, or the like. In at least some instances, the wear pads 221*b* are formed from or otherwise include a durable material (e.g. such as a durable polymer, metal, ceramic, carbon fiber, combinations thereof, or the like) designed to withstand wear. In addition, the wear pads 221*b* may be attached to the base boards 215*a*, 215*b* using a suitable fastener (e.g., a screw, nail, bolt, or the like) and may be easily replaced if desired.

While some pallets may utilize two different types of wear pads (e.g., the wear pads 221*a*, 221*b*), is not required. In some instances, the pallet 210 (and/or other pallets disclosed herein) may utilize only wear pads 221*a* or may only utilize wear pads 221*b*. When doing so, the wear pads may be suitably arranged to support the pallet in the desired manner.

Figure 55:
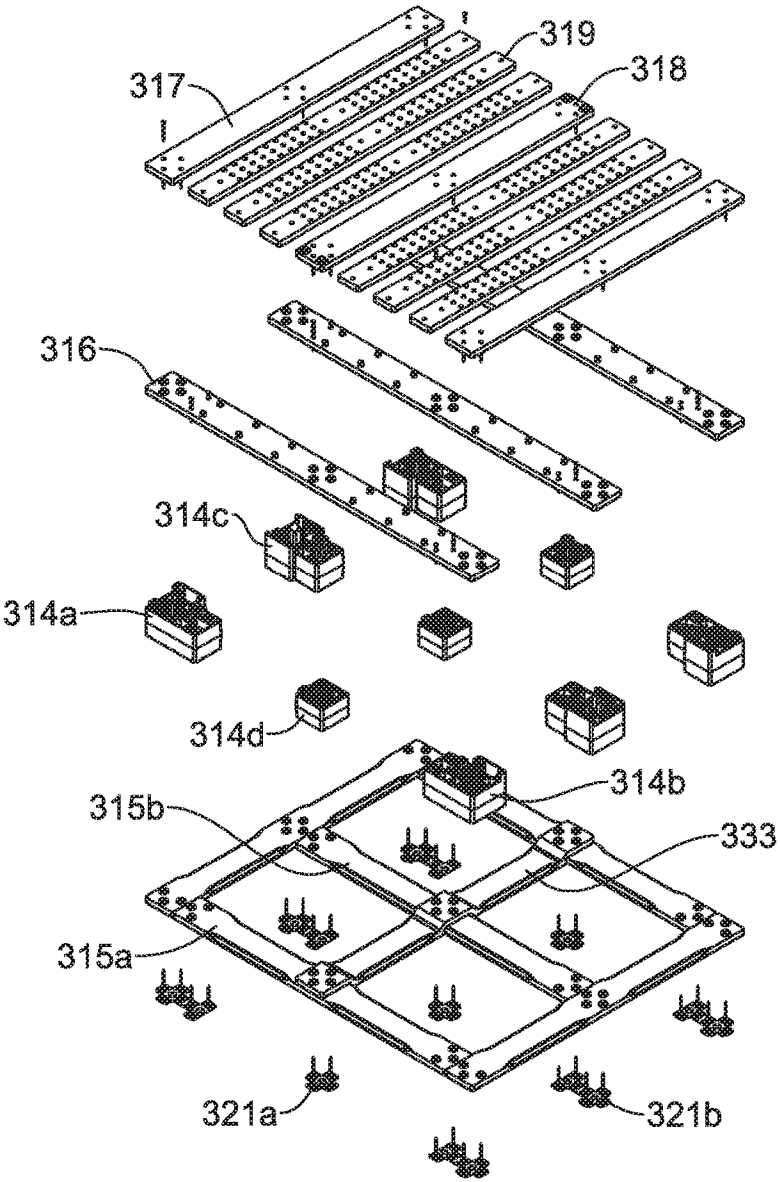
FIG. 55 is an exploded view of an example pallet.

FIG. 55 is an exploded view of another example pallet 310 that may be similar in form and function to other pallets described herein. The pallet 310 may include a plurality of base boards (e.g., including a plurality of peripheral base boards 315*a* and a central base board 315*a* lurality of wear pads (e.g., including wear pads 321*a* and wear pads 321*b*) coupled to one or more of the base boards (e.g., the base boards 315*a*, 315*b*), a cross member 333, a plurality of support blocks (e.g., including support blocks 314*a*, 314*b*, 314*c*, and 314*d*), a plurality of intermediate boards 316, a pair of top end boards 317, a top central board 318, and a plurality of top boards 319. In general, the various components of the pallet 310 may include a number of structural features similar to other pallets disclosed herein. Thus, disclosure of features of the various components of the pallets 10, 110, 210 may be attributed to similar (e.g., like-named) components of the pallet 310.

A number of the components of the pallet 310 may be the same or similar to the components of the pallet 210. For example, the peripheral base boards 315*a* may be the same or similar to the peripheral base boards 215*a*, the central base board 315*b* may be the same or similar to the central base board 215*b*, the cross member 333 may be the same or similar the cross member 233, the support blocks depicted in FIG. 54 (e.g., the support blocks 314*a*, 314*b*, 314*c*, and 314*d*) may be the same or similar to the support blocs depicted in FIG. 42 (e.g., the support blocks 214*a*, 214*b*, 214*c*, and 214*d*), the top end boards 317 may be the same or similar to the top end boards 217, and the top central board 318 may be the same or similar to the top central board 218.

Figure 56:
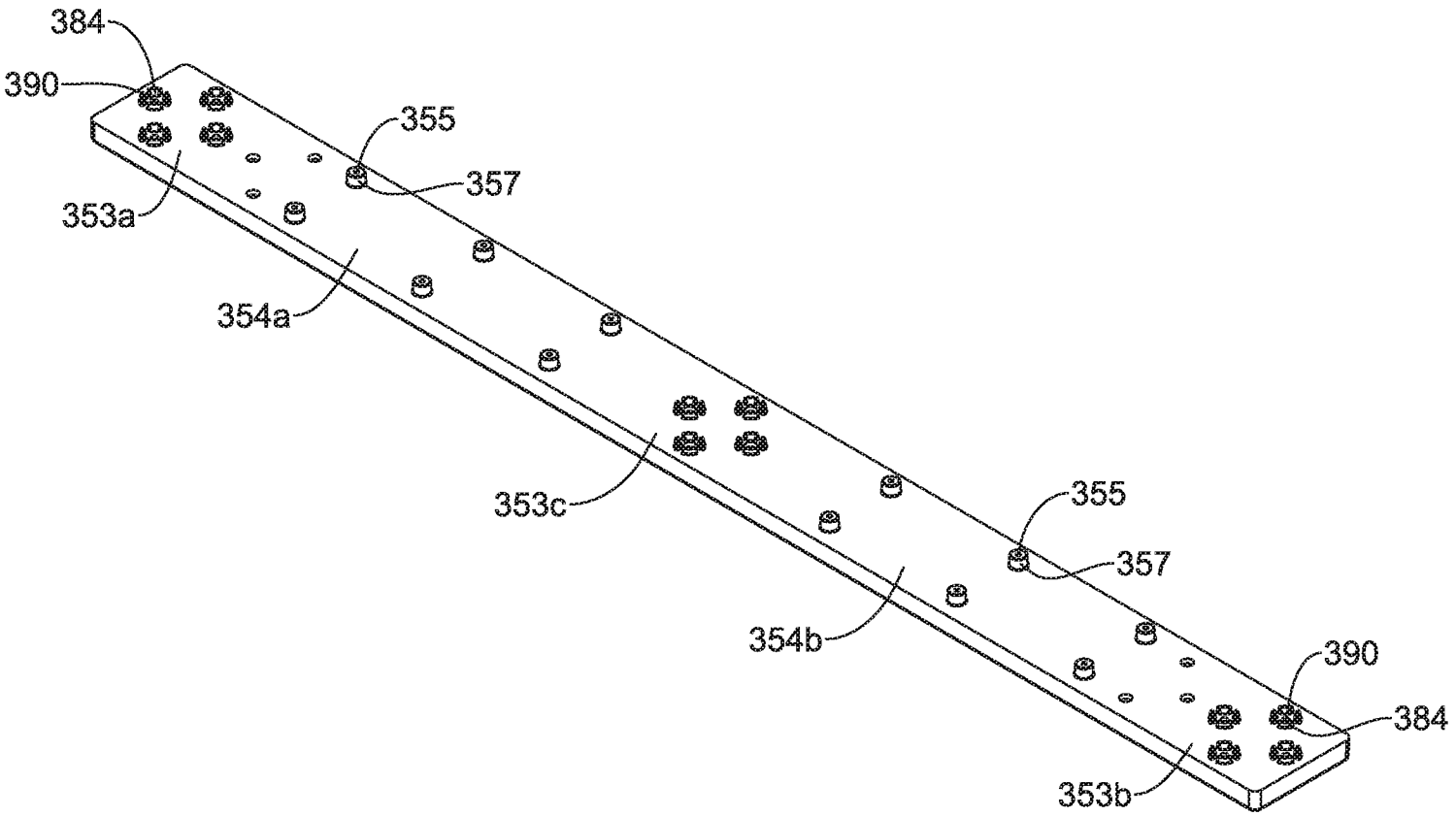
FIG. 56 is a perspective view of an example intermediate board.

FIG. 56 is a perspective view of the intermediate board 316. The intermediate board 316 may include a first end region 353*a*, a second end region 353*b*, and a central region 353*c*. A first section 354*a* may be disposed between the first end region 353*a* and the central region 353*c*. A second section 354*b* may be disposed between the second end region 353*b* and the central region 353*c*. In this example, the first section 354*a* and the second section 354*b* are free of top surface ribs. One or more bosses 357 may be disposed along the first section 354*a*, the second section 354*b*, or both. At least some of the bosses 357 may have apertures 355 formed therein. The apertures 355 may be designed to be used with a suitable fastener (e.g., a screw, nail, bolt, or the like) to secure the intermediate board 316 to other structures of the pallet 310. The bosses 357 may be designed to interlock with another structure such as a top board 317 disposed thereon.

In at least some instances, the intermediate board 316 may also include apertures 390 and/or locating members 384. These features may resemble the similarly-named features of other structures/boards disclosed herein.

The intermediate board 316 may include a tension member, a structural member, an impact member, or a combination thereof similar to those disclosed herein.

Figure 57:
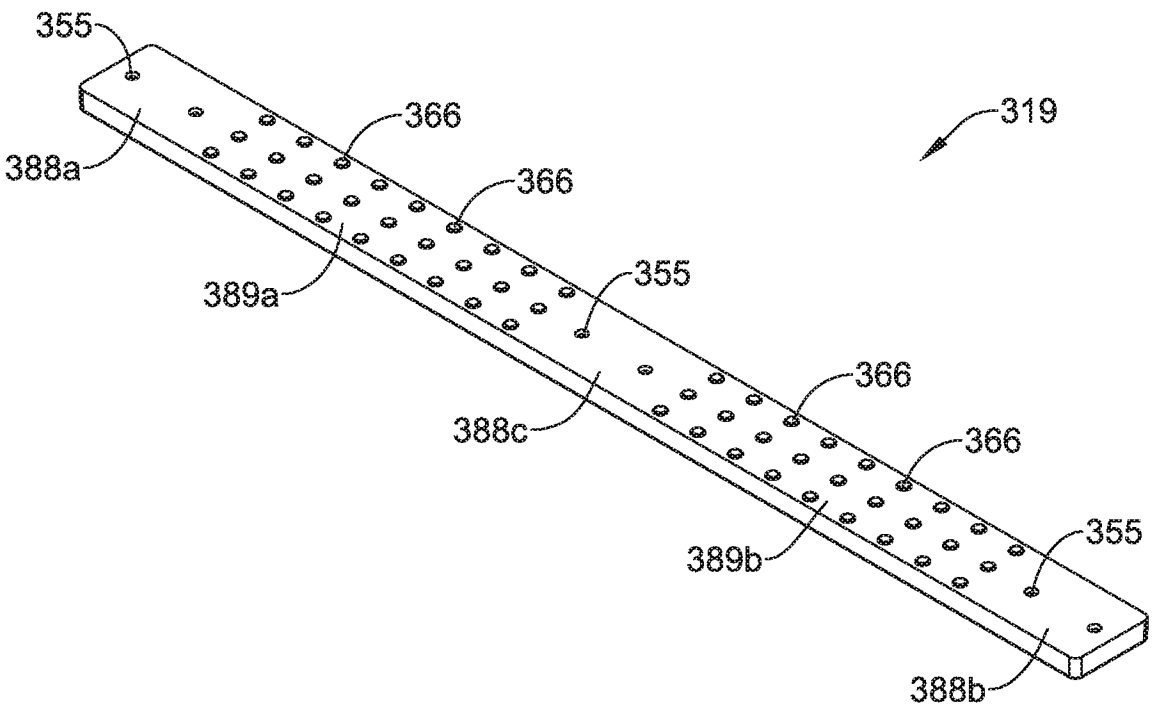
FIG. 57 is a perspective view of an example top board.

FIG. 57 is a perspective view of the top boards 319. The top boards 319 may include a first end region 388*a*, a second end region 388*b*, and a central region 388*c*. A first section 389*a* may be disposed between the first end region 388*a* and the central region 388*c*. A second section 389*b* may be disposed between the second end region 388*b* and the central region 388*c*. The first end region 388*a*, the second end region 388*c*, the central region 388*c*, or combinations thereof may have apertures 355 formed therein. The apertures 355 may be designed to be used with a suitable fastener (e.g., a screw, nail, bolt, or the like) to secure the top boards 319 to other structures of the pallet 310 (e.g., such as the intermediate boards 316).

In some instances, the top boards 319 may include a plurality of projections 366. The projections 366 may be attached to the top boards 319 or may be integral parts of the top board 319 (e.g., the projections 366 are part of a common mold that is used to form the top board 319). The projections 366 may serve as stops or structural features that allow goods placed on the pallet 310 to engage so that the good can be substantially prevented from sliding off of the pallet 310. In some instances, the projections 366 are disposed along the first region 389*a*, the second region 389*b*, or both. However, this is not intended to be limiting. The projections 366 may be disposed along any suitable portion of the top board 319. The projections may have a height in the range of about 0.01-0.1 inches, or about 0.02-0.075 inches, or about 0.04-0.07 inches, or about 0.05-0.06 inches, or about 0.055 inches.

The top boards 319 may include a tension member, a structural member, an impact member, or a combination thereof similar to those disclosed herein.

Figure 58:
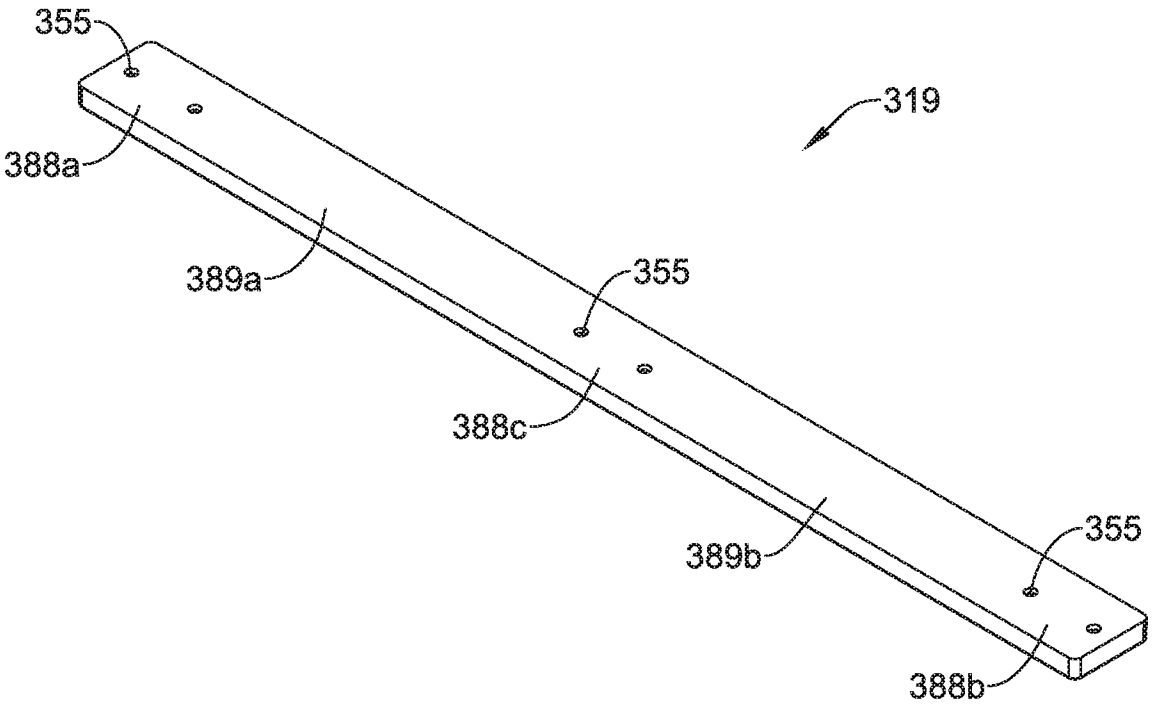
FIG. 58 is a perspective view of an example top board.

FIG. 58 is a perspective view of an alternative top board 319' that lacks the projections 366. In this example, the top boards 319' may include a first end region 388*a*, a second end region 388*b*, and a central region 388*c*. A first section 389*a* may be disposed between the first end region 388*a* and the central region 388*c*. A second section 389*b* may be disposed between the second end region 388*b* and the central region 388*c*. The first end region 388*a*, the second end region 388*c*, the central region 388*c*, or combinations thereof may have apertures 355 formed therein. The apertures 355 may be designed to be used with a suitable fastener (e.g., a screw, nail, bolt, or the like) to secure the top boards 319' to other structures of the pallet 310 (e.g., such as the intermediate boards 316). In some instances, one or more of the top boards 319 (e.g., having projections 366) may be replaced with the top boards 319'.

The top boards 319' may include a tension member, a structural member, an impact member, or a combination thereof similar to those disclosed herein.

The pallets 10, 110, 210, and 310 and/or the various components thereof may include a number of materials including polymers, carbon fiber, glass fiber, ceramics, or the like. Some examples of suitable polymers may include polytetrafluoroethylene (PTFE), ethylene tetrafluoroethylene (ETFE), fluorinated ethylene propylene (FEP), polyoxymethylene (POM, for example, DELRIN® available from DuPont), polyether block ester, polyurethane (for example, Polyurethane 85A), polypropylene (PP), polyvinylchloride (PVC), polyether-ester (for example, ARNITEL® available from DSM Engineering Plastics), ether or ester based copolymers (for elastomers example, butylene/poly(alkylene ether) phthalate and/or other polyester such as HYTREL® available from DuPont), polyamide (for example, DURETHAN® available from Bayer or CRISTAMID® available from Elf Atochem), elastomeric polyamides, block polyamide/ethers, polyether block amide (PEBA, for example available under the trade name PEBAX®), ethylene vinyl acetate copolymers (EVA), silicones, polyethylene (PE), Marlex high-density polyethylene, Marlex low-density polyethylene, linear low density polyethylene (for example REXELL®), polyester, polybutylene terephthalate (PBT), polyethylene terephthalate (PET), polytrimethylene terephthalate, polyethylene naphthalate (PEN), polyetheretherketone (PEEK), polyimide (PI), polyetherimide (PEI), polyphenylene sulfide (PPS), polyphenylene oxide (PPO), poly paraphenylene terephthalamide (for example, KEVLAR®), polysulfone, nylon, nylon-12 (such as GRILAMID® available from EMS American Grilon), perfluoro(propyl vinyl ether) (PFA), ethylene vinyl alcohol, polyolefin, polystyrene, epoxy, polyvinylidene chloride (PVdC), poly(styrene-b-isobutylene-b-styrene) (for example, SIBS and/or SIBS 50A), polycarbonates, ionomers, other suitable materials, or mixtures, combinations, copolymers thereof, polymer/metal composites, and the like.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example embodiment being used in other embodiments. The invention's scope is, of course, defined in the language in which the appended claims are expressed.

What is claimed is:

1. A composite pallet, comprising:

a base layer including a first base board, a second base board, and a cross-member extending between the first base board and the second base board;

wherein the cross-member includes a first end region designed to be detachably coupled to the first base board, a second end region designed to be detachably coupled to the second base board, and at least one curved section positioned between the first end region and the second end region;

wherein the cross-member includes a polymer;

an intermediate layer coupled to the base layer, the intermediate layer including a plurality of intermediate boards;

a top layer coupled to the intermediate layer, the top layer including a plurality of top boards; and wherein the top layer includes a first end board having a top surface, a bottom surface, and a plurality of longitudinal ribs disposed along the bottom surface.

2. The composite pallet of claim 1, wherein the first base board has a first central region, wherein the second base board has a second central region, wherein the first end region of the cross-member is attached to the first central region, and wherein the second end region of the cross-member is attached to the second central region.

3. The composite pallet of claim 1, wherein the cross-member has a central region and wherein the at least one curved section extends between the first end region and the central region.

4. The composite pallet of claim 3, wherein the cross-member includes a second curved region extending between the central region and the second end region.

5. The composite pallet of claim 3, wherein the first base board and the second base board are designed to lie within a plane, wherein a region of the cross-member lies within the plane, and wherein the at least one curved section curves out from the plane.

6. The composite pallet of claim 1, further comprising a wear pad coupled to the first base board.

7. The composite pallet of claim 1, further comprising a plurality of support blocks that are positioned between the base layer and the intermediate layer.

8. The composite pallet of claim 7, wherein a push support member is coupled to at least one of the plurality of support blocks.

9. The composite pallet of claim 1, wherein the plurality of top boards includes a second end board.

10. The composite pallet of claim 9, wherein the plurality of top boards include a structural board positioned between the first end board and the second end board.

11. The composite pallet of claim 10, wherein the top layer includes a first panel disposed between the first end board and the structural board.

12. The composite pallet of claim 11, wherein the top layer includes a second panel disposed between the second end board and the structural board.

13. The composite pallet of claim 1, wherein the first base board includes a longitudinal axis and wherein the first base board includes plurality of longitudinal ribs extending along the longitudinal axis.

14. The composite pallet of claim 13, wherein the first base board includes a plurality of transverse ribs extending between two or more adjacent longitudinal ribs.

15. The composite pallet of claim 1, wherein the first base board, the second base board, or both include a tension member, a structural member, an impact member, or a combination thereof.

16. The composite pallet of claim 1, wherein at least one of the plurality of intermediate boards include a tension member, a structural member, an impact member, or a combination thereof.

17. The composite pallet of claim 1, wherein the plurality of intermediate boards includes a first intermediate board, wherein the first intermediate board includes a top surface, and wherein a top-side rib is disposed along the top surface.

18. The composite pallet of claim 1, wherein at least one of the plurality of top boards include a tension member, a structural member, an impact member, or a combination thereof.

19. A composite pallet, comprising:

a base layer including a plurality of base boards;

an intermediate layer detachably coupled to the base layer, the intermediate layer including a plurality of intermediate boards;

a plurality of support blocks disposed between the base layer and the intermediate layer;

a top layer detachably coupled to the intermediate layer, the top layer including a first end board, a second end board, a structural board positioned between the first end board and the second end board, and a first panel disposed between the structural board and the first end board;

wherein the first end board includes a longitudinal rib and a tension member disposed within the longitudinal rib; and wherein at least one of the first end board, the second end board, the structural board, and the first panel include a polymer.

20. A composite pallet, comprising:

a base layer including a first base board and a second base board;

a cross-member extending between the first base board and the second base board;

wherein the cross-member includes one or more curved sections;

wherein the cross-member includes a polymer;

a support block detachably coupled to the first base board, the second base board, or both;

an intermediate layer detachably coupled to the base layer, the intermediate layer including an intermediate board coupled to the support block;

a top layer detachably coupled to the intermediate layer, the top layer including a first end board, a second end board, a structural board positioned between the first end board and the second end board, a first panel disposed between the structural board and the first end board, and a second panel disposed between the structural board and the second end board; and wherein the structural board includes a top surface, a bottom surface, and a structural member disposed adjacent to the bottom surface, the structural member including a plurality of fibers.

* * * * *